US009016218B2

(12) United States Patent
Fujiura et al.

(10) Patent No.: US 9,016,218 B2
(45) Date of Patent: Apr. 28, 2015

(54) SEWING MACHINE

(71) Applicant: NSD Corporation, Nagoya-shi (JP)

(72) Inventors: Mitsuhiro Fujiura, Nagoya (JP); Hirotsugu Uenishi, Nagoya (JP); Yoshichika Takizawa, Nagoya (JP); Tatsuhiro Kurashima, Nagoya (JP); Masayoshi Ono, Nagoya (JP)

(73) Assignee: NSD Corporation, Nagoya-shi (JP)

( * ) Notice: Subject to any disclaimer, the term of this patent is extended or adjusted under 35 U.S.C. 154(b) by 0 days.

(21) Appl. No.: 14/128,212

(22) PCT Filed: Sep. 25, 2012

(86) PCT No.: PCT/JP2012/074483
§ 371 (c)(1),
(2) Date: Dec. 20, 2013

(87) PCT Pub. No.: WO2013/047477
PCT Pub. Date: Apr. 4, 2013

(65) Prior Publication Data

US 2014/0109814 A1 Apr. 24, 2014

(30) Foreign Application Priority Data

Sep. 26, 2011 (JP) ..... 2011-210001

(51) Int. Cl.

| | |
|---|---|
| ***D05B 21/00*** | (2006.01) |
| ***D05B 19/08*** | (2006.01) |
| ***D05B 69/10*** | (2006.01) |
| ***D05B 19/12*** | (2006.01) |
| ***D05B 47/04*** | (2006.01) |
| ***D05C 11/08*** | (2006.01) |
| *D05B 47/00* | (2006.01) |
| *D05B 69/00* | (2006.01) |

(52) U.S. Cl.
CPC ..... *D05B 69/10* (2013.01); *D05B 19/12* (2013.01); *D05B 47/04* (2013.01); *D05C 11/08* (2013.01); *D05B 19/08* (2013.01)

(58) Field of Classification Search
USPC ..... 112/184, 229, 254, 255, 245, 102.5, 112/220, 278, 279, 189, 190, 196, 241, 242, 112/243, 248, 470.04, 228
See application file for complete search history.

(56) References Cited

U.S. PATENT DOCUMENTS

| | | | | | |
|---|---|---|---|---|---|
| 3,408,832 | A | * | 11/1968 | Abe et al. | 66/146 |
| 3,425,376 | A | * | 2/1969 | Per et al. | 112/220 |
| 4,215,641 | A | * | 8/1980 | Dobrjanskyj et al. | 112/278 |
| 4,471,705 | A | * | 9/1984 | Takenoya et al. | 112/254 |
| 4,590,879 | A | * | 5/1986 | Matsubara et al. | 112/278 |

(Continued)

*Primary Examiner* — Ismael Izaguirre
(74) *Attorney, Agent, or Firm* — Locke Lord LLP

(57) ABSTRACT

To provide a sewing machine that can control tension on a needle thread and tension on a bobbin thread on a per-stitch basis; that enables even heads of a multi-head embroidery sewing machine to form an identical embroidery; and that enables even a plurality of sewing machines to form identical embroidery. A memory device stores for each stitch of embroidery data a needle thread control torque value and a bobbin thread control torque value. In a needle thread torque control zone, an upstream grip section main body is closed, and a downstream grip section main body is opened. A needle thread motor is subjected to torque control in accordance with the needle thread control torque value. In the meantime, in a position control zone, the upstream grip section body is opened, and the downstream grip section body is closed, thereby subjecting the needle thread motor to position control.

20 Claims, 47 Drawing Sheets

(56) References Cited

U.S. PATENT DOCUMENTS 5,404,824 A * 4/1995 Hiraoka et al. ..... 112/254
5,458,075 A * 10/1995 Tice et al. ..... 112/470.04
5,660,129 A * 8/1997 Murata et al. ..... 112/470.04
5,791,272 A * 8/1998 Akahane et al. ..... 112/220
2006/0065175 A1* 3/2006 Ota et al. ..... 112/228
2012/0097084 A1* 4/2012 Takizawa et al. ..... 112/229
2013/0125802 A1* 5/2013 Takizawa et al. ..... 112/245

* cited by examiner

FIG. 17

92a

EMBROIDERY DATA

| STITCH | STITCH WIDTH (mm) | STITCHING DIRECTION (DEGREE) | THREAD TYPE |
|---|---|---|---|
| STITCH 1 | ○○ | ○○ | A |
| STITCH 2 | ○○ | ○○ | A |
| STITCH 3 | ○○ | ○○ | A |
| ⋮ | ⋮ | ⋮ | ⋮ |
| STITCH n | ○○ | ○○ | B |
| ⋮ | ⋮ | ⋮ | ⋮ |

FIG. 18

92b

NEEDLE THREAD CONTROL TORQUE DATA AND
BOBBIN THREAD CONTROL TORQUE DATA

| STITCH | NEEDLE THREAD CONTROL TORQUE VALUE (N·m) | BOBBIN THREAD CONTROL TORQUE VALUE (N·m) |
|---|---|---|
| STITCH 1 | ○○ | ○○ |
| STITCH 2 | ○○ | ○○ |
| STITCH 3 | ○○ | ○○ |
| ⋮ | ⋮ | ⋮ |

FIG. 19

92c

ZONE POSITION DATA

| | | STARTING POINT | END POINT |
|---|---|---|---|
| NEEDLE THREAD | TORQUE CONTROL ZONE (MAIN SPINDLE ANGLE) | $Z_1$ DEGREE | $Z_2$ DEGREE |
| | POSITION CONTROL ZONE (MAIN SPINDLE ANGLE) | $Z_3$ DEGREE | $Z_4$ DEGREE |
| BOBBIN THREAD | TORQUE CONTROL ZONE (MAIN SPINDLE ANGLE) | $Z_5$ DEGREE | $Z_6$ DEGREE |

FIG. 20

92d

SHUTTLE ACTUATION DATA

| MAIN SPINDLE ANGLE | MIDDLE SHUTTLE ANGLE |
|---|---|
| $a_0$ | $d_0$ |
| $a_1$ | $d_1$ |
| $a_2$ | $d_2$ |
| ⋮ | ⋮ |
| $a_n$ | $d_n$ |

FIG. 21

MAIN SPINDLE DATA (POSITION)

| TIME | MAIN SPINDLE ANGLE |
|---|---|
| $t_0$ | $a_0$ (=0) |
| $t_1$ | $a_1$ |
| $t_2$ | $a_2$ |
| ⋮ | ⋮ |
| $t_n$ | $a_n$ |

FIG. 28

ANGLE CORRESPONDENCE DATA

| MAIN SPINDLE ANGLE | NEEDLE THREAD MOTOR ANGLE |
|---|---|
| $a_x$ | Cn |
| $a_{x+1}$ | Cn-1 |
| $a_{x+2}$ | Cn-2 |
| $a_{x+3}$ | Cn-3 |
| ⋮ | ⋮ |
| $a_{y-3}$ | C3 |
| $a_{y-2}$ | C2 |
| $a_{y-1}$ | C1 |
| $a_y$ | C0 |

| | | |
|---|---|---|
| (a) | FOUR POLES ON BOTH SIDES |  |
| (b) | TWO POLES ON ONE SIDE |  |
| (c) | FOUR POLES ON BOTH SIDES |  |
| (d) | TWO POLES ON ONE SIDE |  |

FIG. 42

92e

NEEDLE THREAD TORQUE TABLE AND BOBBIN THREAD TORQUE TABLE

| STITCH WIDTH (mm) | STITCHING DIRECTION (DEGREE) | THREAD TYPE | NEEDLE THREAD CONTROL TORQUE VALUE (N·m) | BOBBIN THREAD CONTROL TORQUE VALUE (N·m) |
|---|---|---|---|---|
| ○○ | ○○ | A | ○○ | ○○ |
| ○○ | ○○ | A | ○○ | ○○ |
| ○○ | ○○ | A | ○○ | ○○ |
| ⋮ | ⋮ | ⋮ | ⋮ | ⋮ |
| ○○ | ○○ | B | ○○ | ○○ |
| ⋮ | ⋮ | ⋮ | ⋮ | ⋮ |

SEWING MACHINE

TECHNICAL FIELD

The present invention relates to a sewing machine (particularly to an embroidery sewing machine) and, particularly, to control of needle thread tension and bobbin thread tension in a sewing machine.

As shown in FIG. 46, in a related-art sewing machine, a needle thread J runs out of a thread roll 298 wound around a needle thread bobbin and reaches a thread take-up lever 12*a* via a pretension component 296, a tension disc 295, a rotary tension component 294, and a tension spring (generally called a "high tension spring") 293 and subsequently a sewing needle 12*ba*.

More specific explanations are now given to a portion of the sewing machine shown in FIG. 46, and the portion assumes a configuration shown in FIG. 47. A needle bar case 2314 that slides in a horizontal direction with respect to an arm 2312 has a needle bar case main body 2330 equipped with the thread take-up levers 12*a*, needle bars 12*b*, the tension springs 293, and others; and a needle thread adjustment member mounting section 2340 fixedly put on an upper surface of the needle bar case main body 2330. The needle thread adjustment member mounting section 2340 is equipped with the tension discs 295 and the rotary tension components 294 for adjusting tension of respective needle threads. Needle thread guides 1300 are placed above the respective tension discs 295, and needle thread guides 1302 are placed beneath the respective rotary tension components 294.

The related-art sewing machine is also equipped with a machine sewing thread feeding device described in connection with Patent Document 1. In relation to the machine sewing thread feeding device described in connection with Patent Document 1, the thread feeding device has a needle thread downstream gripper, an upper looper thread downstream gripper, and a lower looper thread downstream gripper. The needle thread downstream gripper grips a needle thread guided from a needle thread upstream gripper; the upper looper thread downstream gripper grips an upper looper thread guided from an upper looper thread upstream gripper; and the lower looper thread downstream gripper grips a lower looper thread guided from a lower looper thread upstream gripper. At the time of formation of a stitch, the needle thread downstream gripper is opened, whereupon the needle thread is drawn from the needle thread downstream gripper by a stitch forming device. During cloth feeding, the needle thread downstream gripper is closed. Similarly, at the time of formation of a stitch, the upper looper thread downstream gripper is opened, whereupon an upper looper thread is drawn from the upper looper thread downstream gripper by the stitch forming device. During cloth feeding, the upper looper thread downstream gripper is likewise closed. Moreover, at the time of formation of a stitch, the lower looper thread downstream gripper is also opened, whereupon a lower looper thread is drawn from the lower looper thread downstream gripper by the stitch forming device. During cloth feeding, the lower looper thread downstream gripper is closed. During feeding of a cloth, the upstream grippers are opened, and the downstream grippers are closed. A draw-in member moves while drawing a thread, thereby piling up the thread. On the contrary, during formation of a stitch, the upstream grippers are closed, and the downstream grippers are opened, the draw-in member moves to a position where the member does not draw the thread, and the thread is released.

The applicants of the invention have already filed a patent application pertinent to an "Embroidery Sewing Machine" described in connection with Patent Document 2 and another patent application pertinent to a "Sewing-machine Bobbin Thread Tension Controller and Sewing Machine" described in connection with Patent Document 3.

RELATED ART DOCUMENTS

Patent Documents

[Patent Document 1] Unexamined Japanese Patent Application Laid-Open No. 9-19583

[Patent Document 2] Unexamined Japanese Patent Application Laid-Open No. 2010-178785

[Patent Document 3] International Publication No. WO 2010/147023

[Patent Document 4] International Publication No. WO 2012/014610

SUMMARY OF THE INVENTION

Problem that the Invention is to Solve

However, in the related art configurations shown in FIG. 46 and FIG. 47, the needle thread J constantly experiences frictional resistance originating from the tension disc 295 and frictional resistance originating from the rotary tension component 294, and the frictional resistance is unstable (not constant) in light of their resistance values. For this reason, difficulty is encountered in controlling tension exerted on the needle thread on a per-embroidery-stitching basis. In the case of a multi-head embroidery sewing machine, it is difficult for each of heads to make values of resistance exerted on the needle thread by the tension disc and the rotary tension component tantamount to each other. Further, embellishing process fabric with identical embroidery has been difficult. Thus, it has been hard to considerably, highly enhance the sameness of embroidery produced by the respective heads. Likewise, it has been found to difficult to adorn process fabric with the same embroidery with a plurality of embroidery sewing machines and pursue considerable enhancement of the sameness of the embroidery.

Moreover, in the machine sewing thread feeding device described in connection with Patent Document 1, only the draw-in member moves, at the time of formation of a stitch, to the position where the thread is not drawn in. Accordingly, thread tension cannot be controlled. In an ordinary sewing machine, a period during which the thread take-up levers move upwards corresponds not to a period of formation of stitches but to a cloth feeding period. In the thread feeding device described in connection with Patent Document 1, since the downstream grippers are closed in the period during which the thread take-up levers ascend, controlling thread tension is originally impossible.

Moreover, in a machine-sewing bobbin thread tension controller and a sewing machine descried in connection with Patent Document 3, there has been a demand for a method of controlling tension of a bobbin thread on a per-stitch basis by use of the bobbin thread tension controller. In addition, in a sewing machine described in connection with Patent Document 4, a demand has existed for a method of controlling tension on a needle thread on a per-stitch basis.

Accordingly, a problem to which the invention seeks a solution corresponds to an objective that is to provide a sewing machine capable of: controlling magnitudes of tension exerted on a needle thread and a bobbin thread, in particular, tension exerted on the needle thread and the bobbin thread on a per-stitch basis; embellishing process fabric with the same embroidery by use of respective heads of a multi-head embroidery sewing machine, in particular, considerably, highly enhancing the sameness of embroidery formed by the respective heads; and adorning the process fabric with the same embroidery even by means of a plurality of sewing machines, in particular, considerably, highly enhancing the sameness of the embroidery.

Means for Solving the Problems

The invention has been conceived to solve the problems. A first configuration provides a sewing machine comprising:

- a plurality of sewing units(1206), each of which includes:
  - thread take-up lever (12*a*-1 to 12*a*-9) formed in a swayable manner;
  - a needle thread control section (1230) that is disposed at an upstream position in a needle thread path of the thread take-up lever, that controls tension on a needle thread, and that includes
    - an upstream grip section (1240) including
      - an upstream grip section main body (1241) which grips a needle thread in a pinching manner and
      - an upstream actuation section (1250) that performs, with respect to the upstream grip section main body, switching between a closed state in which the needle thread is gripped and an open state in which the needle thread is released from a gripped state,
    - a downstream grip section (1260) that is disposed at a downstream position in the needle thread path of the upstream grip section and that has
      - a downstream grip section main body (1261) which grips a needle thread in a pinching manner and
      - a downstream actuation section (1270) that performs, with respect to the downstream grip section main body, switching between a closed state in which the needle thread is gripped and an open state in which the needle thread is released from a gripped state, and
    - a turning section (1280)that turns the needle thread between the upstream grip section main body and the downstream grip section main body and that has
      - a turning arm (1281) which contacts the needle thread and
      - a needle thread motor (1286) which turns the turning arm;
  - an outer shuttle(110) which has a guide groove formed in a circular-arc inner peripheral surface;
  - a middle shuttle (150) which rotates along the guide groove of the outer shuttle, which retains the needle thread, at least a rear section and a shaft of which are formed from a non-magnetic substance, and which has
    - a race section (152) that is formed along a peripheral edge of the middle shuttle in the form of a circular arc and which is supported so as to be slidable over the guide groove,
    - a rear section (161) continually extending from an end of a rear-side, that is one side with respect to an axial direction, in an inner circumferential edge of the race, and
    - the shaft (184) which is formed on a front side of the rear section and which is formed along a rotating center of the rear section;
  - a bobbin (300)which has a hole into which the shaft of the middle shuttle is inserted, which is axially supported within the middle shuttle as a result of the shaft being inserted into the hole, and which has
    - a first magnet section (310) that is provided on a rear side surface which is a surface opposing a rear section of the middle shuttle when the bobbin is axially supported by the shaft; and
  - a bobbin thread control section (200) which has
    - a bobbin thread motor (202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and
    - a second magnet section (214) which is rotated by the bobbin thread motor and provided in close proximity to the rear section of the middle shuttle and which rotates the first magnet section;
- a storage section (92) for storing needle thread control torque data for which a needle thread control torque value is stored for each stitch in embroidery data and bobbin thread control torque data for which a bobbin thread control torque value is stored for each stitch in the embroidery data; and
- a control section (90) that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that controls the needle thread motor in each of the sewing units in accordance with position data pertinent to a needle thread motor angle such that an angle of the needle thread motor, which is a position of the needle thread motor in a rotating direction, returns to an initial angular position of the needle thread motor, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from the one dead point to the another dead point of the thread take-up lever.

In the first configuration, a magnitude of tension exerted on the needle thread and the bobbin thread can be controlled in accordance with the needle thread control torque data and the bobbin thread control torque data that are stored in the storage section. In particular, the needle thread control torque value in the needle thread control torque data and the bobbin thread control torque value in the bobbin thread control torque data are specified for each stitch. Accordingly, tension on the needle thread and the bobbin thread can be controlled on a per-stitch basis. Therefore, stitch hardness can be adjusted on a per-stitch basis. Moreover, in each of the sewing units, tension on the needle thread and the bobbin thread can be controlled by means of the needle thread control torque data and the bobbin thread control torque data that are stored in the storage section. Accordingly, the respective sewing units can form the same embroidery on process fabric, so that the sameness of the embroidery formed by the respective sewing units (i.e., the respective heads) can be considerably enhanced.

Further, even in a plurality of sewing machines, the respective sewing machines can form an identical embroidery on process fabric, by making the needle thread control torque data stored in the storage section identical with each other and also making the bobbin thread control torque data stored in the storage section identical with each other. Thus, the sameness of the embroidery formed by the respective sewing machines can be considerably enhanced.

A second configuration, in connection with the first configuration, is characterized by further comprising an input section (94) for inputting and storing into the storage section the embroidery data, the needle thread control torque data, and the bobbin thread control torque data.

A third configuration provides a sewing machine comprising:

a plurality of sewing units (1206), each of which includes:
- thread take-up lever (12*a*-1 to 12*a*-9) formed in a swayable manner;
- a needle thread control section (1230) that is disposed at an upstream position in a needle thread path of the thread take-up lever, that controls tension on a needle thread, and that includes
  - an upstream grip section (1240) including
    - an upstream grip section main body (1241) which grips a needle thread in a pinching manner and
    - an upstream actuation section (1250) that performs, with respect to the upstream grip section main body, switching between a closed state in which the needle thread is gripped and an open state in which the needle thread is released from a gripped state,
  - a downstream grip section (1260) that is disposed at a downstream position in the needle thread path of the upstream grip section and that has
    - a downstream grip section main body (1261) which grips a needle thread in a pinching manner and
    - a downstream actuation section (1270) that performs, with respect to the downstream grip section main body, switching between a closed state in which the needle thread is gripped and an open state in which the needle thread is released from a gripped state, and
  - a turning section (1280) that turns the needle thread between the upstream grip section main body and the downstream grip section main body and that has
    - a turning arm (1281) which contacts the needle thread and
    - a needle thread motor (1286) which turns the turning arm;
- an outer shuttle (110) which has a guide groove formed in a circular-arc inner peripheral surface;
- a middle shuttle (150) which rotates along the guide groove of the outer shuttle, which retains the needle thread, at least a rear section and a shaft of which are formed from a non-magnetic substance, and which has
  - a race section (152) that is formed along a peripheral edge of the middle shuttle in the form of a circular arc and which is supported so as to be slidable over the guide groove,
  - a rear section (161) continually extending from an end of a rear-side, that is one side with respect to an axial direction, in an inner circumferential edge of the race, and
  - the shaft (184) which is formed on a front side of the rear section and which is formed along a rotating center of the rear section;
- a bobbin (300) which has a hole into which the shaft of the middle shuttle is inserted, which is axially supported within the middle shuttle as a result of the shaft being inserted into the hole, and which has
  - a first magnet section (310) that is provided on a rear side surface which is a surface opposing a rear section of the middle shuttle when the bobbin is axially supported by the shaft; and
- a bobbin thread control section (200) which has
  - a bobbin thread motor (202, 1202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and
  - a second magnet section (214) which is rotated by the bobbin thread motor and provided in close proximity to the rear section of the middle shuttle and which rotates the first magnet section;

a storage section (92) for storing a torque table that specifies a needle thread control torque value and a bobbin thread control torque value which correspond to a combination of a value of a stitch width and a value based on a stitching direction; and a control section (90) that detects, according to the torque table, a needle thread control torque value and a bobbin thread control torque value for each stitch in the embroidery data which store, for each stitch, data pertinent to a value of a stitch width and data pertinent to a value representing a stitching direction, thereby generating needle thread control torque data which store, for each stitch, a needle thread control torque value and bobbin thread control torque data which stored, for each stitch, a bobbin thread control torque value; that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that controls the needle thread motor in each of the sewing units in accordance with position data pertinent to a needle thread motor angle such that an angle of the needle thread motor, which is a position of the needle thread motor in a rotating direction, returns to an initial angular position of the needle thread motor, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from the one dead point to the another dead point of the thread take-up lever.

In the third configuration, a magnitude of tension exerted on the needle thread and the bobbin thread can be controlled in accordance with the generated needle thread control torque data and the generated bobbin thread control torque data. In particular, the needle thread control torque value in the needle thread control torque data and the bobbin thread control torque data in the bobbin thread control torque data are specified for each stitch. Accordingly, tension on the needle thread and the bobbin thread can be controlled on a per-stitch basis. Therefore, stitch hardness can be adjusted on a per-stitch basis. Moreover, in each of the sewing units, tension on the needle thread and the bobbin thread can be controlled by means of the generated needle thread control torque data and the generated bobbin thread control torque data. Accordingly, the respective sewing units can form the same embroidery on process fabric, so that the sameness of the embroidery formed by the respective sewing units can be considerably enhanced. To be specific, in each of the sewing units of the sewing machine, tension on the needle thread and the bobbin thread is controlled by means of the generated needle thread control torque data and the generated bobbin thread control torque data. Since each of the sewing units controls tension by means of the same torque data, the respective sewing units can form the same embroidery on process fabric, so that the sameness of the embroidery formed by the respective sewing units (i.e., the respective heads) can be considerably enhanced. Furthermore, even in a plurality of sewing machines, the same needle thread control torque data and the bobbin thread control torque data are generated, so long as the same data are stored in the torque tables of the respective embroidery sewing machines. Hence, the respective sewing machines can embellish process fabrics with the same embroidery. Thus, the sameness of the embroidery formed by the respective sewing units can be considerably enhanced.

Needle thread control torque data and bobbin thread control torque data that conform to embroidery data are generated by use of the torque table. Tension on the needle thread is controlled in accordance with the needle thread control torque data, and tension on the bobbin thread is controlled in accordance with the bobbin thread control torque data. Hence, there is no necessity of generating and inputting the needle thread control torque data and the bobbin thread control torque data separately from each other. Incidentally, in the first and third configurations, the outer shuttle can also be configured as an "outer shuttle (110) which has a guide groove formed on a front side of a circular-arc inner peripheral surface that is one side of the inner peripheral surface in a direction of its axis line." The middle shuttle can also be configured as a "middle shuttle (150) which rotates along the guide groove of the outer shuttle, which retains the needle thread, at least a rear section and a shaft of which are formed from a non-magnetic substance, and which has a race section (152) which is formed along a peripheral edge of the middle shuttle in the form of a circular arc and which is supported so as to be slidable over the guide groove, the rear section (161) which has a continuation from an end of a rear side of the inner peripheral edge of the race section, and the shaft (184) which is formed on a front side of the rear section and which is formed along a rotating center of the rear section." Moreover, in the first and third configurations, the sewing unit can also be configured with an addition of a "middle shuttle presser (130) which is disposed on a front side of the outer shuttle, to thus prevent the middle shuttle housed in the outer shuttle from falling from the outer shuttle."

A fourth configuration, in connection with the third configuration, is characterized by further comprising an output section (94) for outputting to the outside the needle thread control torque data and the bobbin thread control torque data that have been generated in accordance with the torque table. Therefore, even a plurality of sewing machines can operate according to the same needle thread control torque data and the same bobbin thread control torque data, so long as needle thread control torque data and bobbin thread control torque data are output to the outside from the output section and are input to the other sewing machines to thereby make specifics of the torque tables identical with each other. Accordingly, the respective sewing machines can embellish process fabric with the same embroidery, and thus the sameness of the embroidery formed by the respective sewing units can be considerably enhanced.

A fifth configuration, in connection with the third or fourth configuration, is characterized by further comprising an input section (94) for inputting and storing in the storage section embroidery data (which may also be referred to as "embroidery data" that store, for each stitch, data pertinent to a value of a stitch width and data pertinent to a value representing a stitching direction) and data pertinent to the torque table.

A sixth configuration, in connection with any of the third configuration to the fifth configuration, is characterized in that a value based on a stitching direction in the torque table is a value representing a relationship between a direction of a stitch to be controlled and a direction of an immediately preceding stitch.

A seventh configuration, in connection with any of the third configuration to the sixth configuration, is characterized in that a value based on a stitching direction of the torque table is a value of an angular difference between the direction of the stitch to be controlled and the direction of an immediately preceding stitch.

An eighth configuration, in connection with any of the third configuration to the seventh configuration, is characterized in that the embroidery data store, for each stitch, data pertinent to a thread type in addition to the data pertinent to a value of a stitch width and a value based on a stitching direction; that the needle thread control torque value is provided, in the torque table, in correspondence with an additional combination of a thread type as well as with the value of the stitch width and the value based on the stitching direction; and that the bobbin thread control torque value is provided, in the torque table, in correspondence with an additional combination of a thread type as well as with the value of the stitch width and the value based on the stitching direction. Therefore, more suitable torque control becomes possible, so long as the needle thread control torque value and the bobbin thread control torque value have been previously determined in consideration of the thread type as well as the stitch width and the stitching direction.

A ninth configuration, in connection with any of the first configuration to the eighth configuration, is characterized in that the sewing unit further comprises:

a third magnet section (190) provided on an outer periphery portion of the portion that faces the surface of the bobbin provided with the first magnet section in the rear section of the middle shuttle, a shuttle actuation section (250.2250) having a fourth magnet section (270,2270) that is provided in close proximity to the third magnet section and a shuttle actuation motor (252,2252) that rotates the fourth magnet section around an axis line that is to serves as a rotating center of the middle shuttle.

A tenth configuration, in connection with any of the first configuration to the ninth configuration, is characterized in that the guide groove is provided on a front side of a circular-arc inner peripheral surface of the outer shuttle, and wherein a middle shuttle presser (130) for preventing the middle shuttle housed in the outer shuttle from falling from the outer shuttle is provided on a front side of the outer shuttle.

An eleventh configuration, in connection with any of the first configuration to the tenth configuration, is characterized in that the sewing unit further includes an arm (1312) making up an enclosure of the sewing machine;

a needle bar case (1314) that is provided so as to be slidable in a horizontal direction with respect to the arm and that includes first opening sections (1342*b*) made at positions between the upstream grip section main body and the downstream grip section main body in a vertical direction such that a leading end of the turning arm of a turning section can be exposed to the front side, a second opening section (1342*a*) which is provided above the first opening section and on which the upstream magnet section fronts, and a third opening section (1342*c*) which is provided below the first opening section and on which a downstream magnet section fronts;

a plurality of needle bars (12*b*-1 to 12*b*-9) provided in the needle bar case; and needle thread supporting members (1288) that each is provided in the needle bar case and that each supports the needle thread in its horizontal direction at the position of the first opening section, wherein the thread take-up lever is placed while being exposed from a position in the needle bar case below the downstream grip section to a front;

the turning arm is turned while remaining in contact with the needle thread supported by the needle thread supporting member, thereby turning the needle thread;

the upstream grip section main body is placed on a front side of the needle bar case and, and has upstream first plate-like sections (1242*a*) which is formed into a shape of a plate from a magnetic substance; that is, a material attracted by the magnet and which is provided for the respective needle bars and an upstream second plate-like section (1244) which is provided at back side of the upstream first plate-like sections and on a front side of the second opening section and which is formed into a shape of a plate from a non-magnetic substance unattracted by the magnet;

the upstream actuation section is a magnet section serving as the upstream magnet section and secured to the arm-side at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state;

the downstream grip section main body is placed on a front side of the needle bar case and below the upstream grip section main body and has downstream first plate-like sections (1262*a*) which are formed from a magnetic substance which is attracted by the magnet into a shape of a plate and which are provided for the respective needle bars and a downstream second plate-like section (1264) which is provided at back side of the downstream first plate-like sections and on a front side of the second opening section and which is formed into a shape of a plate from a non-magnetic substance unattracted by the magnet; and the downstream actuation section is a magnet section serving as the downstream magnet section and secured to the arm-side at a back side of the downstream second plate-like section and switches between a closed state in which the downstream first plate-like section is attracted by magnetic force, to thus pinch to thereby grip the needle thread between the downstream first plate-like section and the downstream second plate-like section and an open state in which the needle thread is released from the gripped state by means of canceling attraction caused by the magnetic force. Consequently, when the configuration made up of the upstream grip section, the downstream grip section, and the turning section is applied to a multi-needle head, the configuration can be implemented by adoption of only one upstream magnet section of the upstream grip section, only one downstream magnet section of the downstream grip section, and only one turning section. Therefore, an efficient configuration that curbs manufacturing cost can be achieved.

A twelfth configuration, in connection with any of the first through 11 configurations, is characterized in that the control section detects, at a starting point of the position control zone, a current angle position of the needle thread motor in the position control zone, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up lever, and controls a position of the needle thread motor to its angle of the needle thread motor corresponding to the angle of the main spindle motor as the angle of the main spindle motor changes as a result of rotation of the main spindle motor.

Therefore, since angle correspondence data are generated during position control, an angle of the needle thread motor can be subjected to position control according to the angle correspondence data.

The sewing machine can also be configured as follows as a thirteenth configuration. "Specifically, there is provided a sewing machine comprising:

a plurality of sewing units (1206), each of which includes: an arm (1312) making up a housing;

a needle bar case (1314) that is provided so as to be slidable in a horizontal direction with respect to the arm and that includes first opening sections (1342*b*) made at positions between an upstream grip section main body and a downstream grip section main body in a vertical direction such that a leading end of a turning arm of a turning section can be exposed to the front side, a second opening section (1342*a*) which is provided above the first opening section and on which an upstream magnet section fronts, and a third opening section (1342*c*) which is provided below the first opening section and on which a downstream magnet section fronts;

a plurality of thread take-up levers (12*a*-1 to 12*a*-9) that are provided on a front side of the needle bar case in an exposed fashion and that are provided at downstream positions on needle thread paths with respect to a downstream grip section in a swayable manner;

a plurality of needle bars (12*b*-1 to 12*b*-9) provided in the needle bar case;

an upstream grip section (1240) that has an upstream grip section main body (1241) that is placed on a front side of the needle bar case, that pinches to thereby grip the needle thread, and that has upstream first plate-like sections (1242*a*) which is formed from a magnetic substance that is a material attracted by the magnet, and which is provided for the respective needle bars and an upstream second plate-like section (1244) which is provided at back side of the upstream first plate-like sections and on a front side of the second opening section and which is formed from a non-magnetic substance unattracted by the magnet, and an upstream magnet section (1250) that is secured to the arm side and that switches between a closed state in which the needle thread is pinched to thereby grip between the upstream first plate-like section and the upstream second plate-like section by means of attracting the upstream first plate-like section from a back side of the upstream second plate-like section by means of magnetic force and an open state in which the needle thread is released from the gripped state by canceling attraction caused by magnetic force;

the downstream grip section (1260) that is placed at a downstream position along a needle thread path of the upstream grip section and that has the downstream grip section main body (1261) which is placed on a front surface side of the needle bar case and below the upstream grip section main body, which pinches to thereby grip the needle thread, and which has a downstream first plate-like sections (1262*a*) which is formed from a magnetic substance that is a material attracted by a magnet and which is provided for each of the needle bars and a downstream second plate-like section (1264) that is provided at back side of the downstream first plate-like sections and on a front side of the second opening section and that is formed from a non-magnetic substance unattracted by the magnet, and a downstream magnet section (1270) that is secured to the arm side and that switches between a closed state in which the needle thread is pinched to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members (1288) that each is provided in the needle bar case and that each supports the needle thread in its horizontal direction at the position of the first opening section;

a turning section (1280) that turns the needle thread existing between the upstream grip section main body and the downstream grip section main body and that has the turning arm (1281) which contacts the needle thread supported by the needle thread supporting member and a needle thread motor (1286) which is secured to the arm side and which turns the turning arm;

an outer shuttle (110) which has a guide groove formed on a front side of a circular-arc inner peripheral surface that is one side of the inner peripheral surface in a direction of its axis line;

a middle shuttle (150) which rotates along the guide groove of the outer shuttle, which retains the needle thread, at least a rear section and a shaft of which are formed from a non-magnetic substance, and which has a race section (152) that is formed along a peripheral edge of the middle shuttle in the form of a circular arc and which is supported so as to be slidable over the guide groove, a rear section (161) continually extending from an end of a rear-side in an inner circumferential edge of the race, and the shaft (184) which is formed on a front side of the rear section and which is formed along a rotating center of the rear section;

a middle shuttle presser (130) which is disposed at a front side of the outer shuttle, to thus prevent the middle shuttle housed in the outer shuttle from falling from the outer shuttle;

a bobbin (300) which has a hole into which the shaft of the middle shuttle is inserted, which is axially supported within the middle shuttle as a result of the shaft being inserted into the hole, and which has a first magnet section (310) that is provided on a rear side surface which is a surface opposing a rear section of the middle shuttle when the bobbin is axially supported by the shaft; and a bobbin thread control section (200) which has a bobbin thread motor (202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section (214) which is rotated by the bobbin thread motor and provided in close proximity to the rear section of the middle shuttle and which rotates the first magnet section;

a storage section (92) for storing needle thread control torque data for which a needle thread control torque value is stored for each stitch in embroidery data and bobbin thread control torque data for which a bobbin thread control torque value is stored for each stitch in the embroidery data; and a control section (90) that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that detects at a starting point of the position control zone a current angle position of the needle thread motor which is a rotational position of the needle thread motor, generates angle correspondence data which specify an angle of the needle thread motor from a current angle position to an initial angle position of the needle thread motor for each angle of a main spindle motor, i.e., a rotational position of the main spindle motor (20) which rotates a main spindle (22) for transmitting power to the thread take-up lever and the needle bar, controls the position of the needle thread motor to an angle of the needle thread motor corresponding to the angle of the main spindle motor as an angle of the main spindle motor changes as a result of rotation of the main spindle motor, in such a way that the angle of the needle thread motor returns to the initial angle position of the needle thread motor, thereby imparting rotating force to the turning arm in an upward direction to draw the needle thread from an upstream position, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from a bottom dead point to a top dead point of the thread take-up lever, and lets the turning arm recede to a receded position lower than an initial position of the turning arm and the needle bar case slide when processing proceeds to control of a next stitch and when a needle thread to be selected is changed, so that the upstream magnet section, the downstream magnet section, and the turning arm come to a position of the selected needle thread.

The sewing machine can also be configured as follows as a fourteenth configuration. "Specifically, there is provided a sewing machine comprising:

a plurality of sewing units (1206), each of which includes: an arm (1312) making up a housing;

a needle bar case (1314) that is provided so as to be slidable in a horizontal direction with respect to the arm and that includes first opening sections (1342*b*) made at positions between an upstream grip section main body and a downstream grip section main body in a vertical direction such that a leading end of a turning arm of a turning section can be exposed to the front side, a second opening section (1342*a*) which is provided above the first opening section and on which an upstream magnet section fronts, and a third opening section (1342*c*) which is provided below the first opening section and on which a downstream magnet section fronts;

a plurality of thread take-up levers (12*a*-*i* to 12*a*-9) that are provided on a front side of the needle bar case in an exposed fashion and that are provided at downstream positions on needle thread paths with respect to a downstream grip section in a swayable manner;

a plurality of needle bars (12*b*-1 to 12*b*-9) provided in the needle bar case;

an upstream grip section (1240) that has an upstream grip section main body (1241) that is placed on a front side of the needle bar case, that pinches to thereby grip the needle thread, and that has upstream first plate-like sections (1242*a*) which is formed from a magnetic substance that is a material attracted by the magnet, and which is provided for the respective needle bars and an upstream second plate-like section (1244) which is provided at back side of the upstream first plate-like sections and on a front side of the second opening section and which is formed from a non-magnetic substance unattracted by the magnet, and an upstream magnet section (1250) that is secured to the arm side and that switches between a closed state in which the needle thread is pinched to thereby grip between the upstream first plate-like section and the upstream second plate-like section by means of attracting the upstream first plate-like section from a back side of the upstream second plate-like section by means of magnetic force and an open state in which the needle thread is released from the gripped state by canceling attraction caused by magnetic force;

the downstream grip section (1260) that is placed at a downstream position along a needle thread path of the upstream grip section and that has the downstream grip section main body (1261) which is placed on a front surface side of the needle bar case and below the upstream grip section main body, which pinches to thereby grip the needle thread, and which has a downstream first plate-like sections (1262*a*) which is formed from a magnetic substance that is a material attracted by a magnet and which is provided for each of the needle bars and a downstream second plate-like section (1264) that is provided at back side of the downstream first plate-like sections and on a front side of the second opening section and that is formed from a non-magnetic substance unattracted by the magnet, and a downstream magnet section (1270) that is secured to the arm side and that switches between a closed state in which the needle thread is pinched to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members (1288) that each is provided in the needle bar case and that each supports the needle thread in its horizontal direction at the position of the first opening section;

a turning section (1280) that turns the needle thread existing between the upstream grip section main body and the downstream grip section main body and that has the turning arm (1281) which contacts the needle thread supported by the needle thread supporting member and a needle thread motor (1286) which is secured to the arm side and which turns the turning arm;

an outer shuttle (110) which has a guide groove formed on a front side of a circular-arc inner peripheral surface that is one side of the inner peripheral surface in a direction of its axis line;

a middle shuttle (150) which rotates along the guide groove of the outer shuttle, which retains the needle thread, at least a rear section and a shaft of which are formed from a non-magnetic substance, and which has a race section (152) that is formed along a peripheral edge of the middle shuttle in the form of a circular arc and which is supported so as to be slidable over the guide groove, a rear section (161) continually extending from an end of a rear-side in an inner circumferential edge of the race, and the shaft (184) which is formed on a front side of the rear section and which is formed along a rotating center of the rear section;

a middle shuttle presser (130) which is disposed at a front side of the outer shuttle, to thus prevent the middle shuttle housed in the outer shuttle from falling from the outer shuttle;

a bobbin (300) which has a hole into which the shaft of the middle shuttle is inserted, which is axially supported within the middle shuttle as a result of the shaft being inserted into the hole, and which has a first magnet section (310) that is provided on a rear side surface which is a surface opposing a rear section of the middle shuttle when the bobbin is axially supported by the shaft; and a bobbin thread control section (200, 1200) which has a bobbin thread motor (202, 1202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section (214) which is rotated by the bobbin thread motor and provided in close proximity to the rear section of the middle shuttle and which rotates the first magnet section;

a storage section (92) for storing a torque table (92*e*) that specifies a needle thread control torque value and a bobbin thread control torque value which correspond to a combination of a value of a stitch width and a value based on a stitching direction; and a control section (90) that detects, according to the torque table, a needle thread control torque value and a bobbin thread control torque value for each stitch in the embroidery data which store, for each stitch, data pertinent to a value of a stitch width and data pertinent to a value representing a stitching direction, thereby generating needle thread control torque data which store, for each stitch, a needle thread control torque value and bobbin thread control torque data which stored, for each stitch, a bobbin thread control torque value; that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that detects at a starting point of the position control zone a current angle position of the needle thread motor which is a rotational position of the needle thread motor, generates angle correspondence data which specify an angle of the needle thread motor from a current angle position to an initial angle position of the needle thread motor for each angle of a main spindle motor, i.e., a rotational position of the main spindle motor (20) which rotates a main spindle (22) for transmitting power to the thread take-up lever and the needle bar, controls the position of the needle thread motor in each sewing unit to an angle of the needle thread motor corresponding to the angle of the main spindle motor as an angle of the main spindle motor changes as a result of rotation of the main spindle motor, in such a way that the angle of the needle thread motor returns to the initial angle position of the needle thread motor, thereby imparting rotating force to the turning arm in an upward direction to draw the needle thread from an upstream position, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from a bottom dead point to a top dead point of the thread take-up lever, and lets the turning arm recede to a receded position lower than an initial position of the turning arm and the needle bar case slide when processing proceeds to control of a next stitch and when a needle thread to be selected is changed, so that the upstream magnet section, the downstream magnet section, and the turning arm come to a position of the selected needle thread.

The sewing machine can also be configured as follows as a fifteenth configuration. "Specifically, there is provided a sewing machine comprising:

a plurality of sewing units (1206), each of which includes: an arm (1312) making up a housing;

a needle bar housing case (1330) that is disposed so as to be slidable in a horizontal direction with respect to the arm and that houses a plurality of needle bars (12*b*-1 to 12*b*-9);

a tabular plate section (1341) that is disposed on an upper surface of the needle bar housing case and that is provided with first opening sections (1342*b*) made at positions between an upstream grip section main body and a downstream grip section main body in a vertical direction such that a leading end of a turning arm of a turning section can be exposed to the front side, a second opening section (1342*a*) which is provided above the first opening section and on which an upstream magnet section fronts, and a third opening section (1342*c*) that is placed below the first opening section and on which a downstream magnet section fronts;

a plurality of thread take-up levers (12*a*-1 to 12*a*-9) that are axially supported by the needle bar housing case in a swayable manner, that are provided on a front side of the needle bar housing case in an exposed fashion, and that are provided at downstream positions on needle thread paths with respect to a downstream grip section;

an upstream grip section (1240) that has the upstream grip section main body (1241) that is placed on a front side of the plate section, that pinches to thereby grip a needle thread, and that has upstream first plate-like sections (1242*a*) which is formed from a magnetic substance that is a material attracted by the magnet, and which is provided for the respective needle bars and an upstream second plate-like section (1244) which is provided at back side of the upstream first plate-like sections and on a front side of the second opening section and which is formed from a non-magnetic substance unattracted by the magnet, and the upstream magnet section (1250) that is secured to the arm side and that switches between a closed state in which the needle thread is pinched and gripped between the upstream first plate-like section and the upstream second plate-like section by means of attracting the upstream first plate-like section from a back side of the upstream second plate-like section by magnetic force and an open state in which the needle thread is released from the gripped state by canceling attraction caused by magnetic force;

the downstream grip section (1260) that is placed at a downstream position along a needle thread path of the upstream grip section and that has the downstream grip section main body (1261) which is placed below the upstream grip section main body on a front side of the plate section, which pinches to thereby grip the needle thread, and which has downstream first plate-like sections (1262*a*) which is formed from a magnetic substance that is a material attracted by the magnet and provided for respective needle bars and a downstream second plate-like section (1264) which is provided at back side of the downstream first plate-like sections and on a front side of the second opening section and formed from a non-magnetic substance unattracted by the magnet, and the downstream magnet section (1270) that is secured to the arm side and that switches between a closed state in which the needle thread is pinches to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members (1288) that each is provided in the plate section and that each supports the needle thread in its horizontal direction at the position of the first opening section;

the turning section (1280) that turns the needle thread existing between the upstream grip section main body and the downstream grip section main body and that has the turning arm (1281) which contacts the needle thread supported by the needle thread supporting member and a needle thread motor (1286) which is secured to the arm side and which turns the turning arm;

an outer shuttle (110) which has a guide groove formed on a front side of a circular-arc inner peripheral surface that is one side of the inner peripheral surface in a direction of its axis line;

a middle shuttle (150) which rotates along the guide groove of the outer shuttle, which retains the needle thread, at least a rear section and a shaft of which are formed from a non-magnetic substance, and which has a race section (152) that is formed along a peripheral edge of the middle shuttle in the form of a circular arc and which is supported so as to be slidable over the guide groove, a rear section (161) continually extending from an end of a rear-side in an inner circumferential edge of the race, and the shaft (184) which is formed on a front side of the rear section and which is formed along a rotating center of the rear section;

a middle shuttle presser (130) which is disposed at a front side of the outer shuttle, to thus prevent the middle shuttle housed in the outer shuttle from falling from the outer shuttle;

a bobbin (300) which has a hole into which the shaft of the middle shuttle is inserted, which is axially supported within the middle shuttle as a result of the shaft being inserted into the hole, and which has a first magnet section (310) that is provided on a rear side surface which is a surface opposing a rear section of the middle shuttle when the bobbin is axially supported by the shaft; and a bobbin thread control section (200) which has a bobbin thread motor (202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section (214) which is rotated by the bobbin thread motor and provided in close proximity to the rear section of the middle shuttle and which rotates the first magnet section;

a storage section (92) for storing needle thread control torque data for which a needle thread control torque value is stored for each stitch in embroidery data and bobbin thread control torque data for which a bobbin thread control torque value is stored for each stitch in the embroidery data; and a control section (90) that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that detects at a starting point of the position control zone a current angle position of the needle thread motor which is a rotational position of the needle thread motor, generates angle correspondence data which specify an angle of the needle thread motor from a current angle position to an initial angle position of the needle thread motor for each angle of a main spindle motor, i.e., a rotational position of the main spindle motor (20) which rotates a main spindle (22) for transmitting power to the thread take-up lever and the needle bar, controls the position of the needle thread motor to an angle of the needle thread motor corresponding to the angle of the main spindle motor as an angle of the main spindle motor changes as a result of rotation of the main spindle motor, in such a way that the angle of the needle thread motor returns to the initial angle position of the needle thread motor, thereby imparting rotating force to the turning arm in an upward direction to draw the needle thread from an upstream position, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from a bottom dead point to a top dead point of the thread take-up lever, and lets the turning arm recede to a receded position lower than an initial position of the turning arm and the needle bar housing case slide when processing proceeds to control of a next stitch and when a needle thread to be selected is changed, so that the upstream magnet section, the downstream magnet section, and the turning arm come to a position of the selected needle thread.

The sewing machine can also be configured as follows as a sixteenth configuration. "Specifically, there is provided a sewing machine comprising:

a plurality of sewing units (1206), each of which includes: an arm (1312) making up a housing;

a needle bar housing case (1330) that is disposed so as to be slidable in a horizontal direction with respect to the arm and that houses a plurality of needle bars (12*b*-1 to 12*b*-9);

a tabular plate section (1341) that is disposed on an upper surface of the needle bar housing case and that is provided with first opening sections (1342*b*) made at positions between an upstream grip section main body and a downstream grip section main body in a vertical direction such that a leading end of a turning arm of a turning section can be exposed to the front side, a second opening section (1342*a*) which is provided above the first opening sect ion and on which an upstream magnet section fronts, and a third opening section (1342*c*) that is placed below the first opening section and on which a downstream magnet section fronts;

a plurality of thread take-up levers (12*a*-1 to 12*a*-9) that are axially supported by the needle bar housing case in a swayable manner, that are provided on a front side of the needle bar housing case in an exposed fashion, and that are provided at downstream positions on needle thread paths with respect to a downstream grip section;

an upstream grip section (1240) that has the upstream grip section main body (1241) that is placed on a front side of the plate section, that pinches to thereby grip a needle thread, and that has upstream first plate-like sections (1242*a*) which is formed from a magnetic substance that is a material attracted by the magnet, and which is provided for the respective needle bars and an upstream second plate-like section (1244) which is provided at back side of the upstream first plate-like sections and on a front side of the second opening section and which is formed from a non-magnetic substance unattracted by the magnet, and the upstream magnet section (1250) that is secured to the arm side and that switches between a closed state in which the needle thread is pinched and gripped between the upstream first plate-like section and the upstream second plate-like section by means of attracting the upstream first plate-like section from a back side of the upstream second plate-like section by magnetic force and an open state in which the needle thread is released from the gripped state by canceling attraction caused by magnetic force;

the downstream grip section (1260) that is placed at a downstream position along a needle thread path of the upstream grip section and that has the downstream grip section main body (1261) which is placed below the upstream grip section main body on a front side of the plate section, which pinches to thereby grip the needle thread, and which has downstream first plate-like sections (1262*a*) which is formed from a magnetic substance that is a material attracted by the magnet and provided for respective needle bars and a downstream second plate-like section (1264) which is provided at back side of the downstream first plate-like sections and on a front side of the second opening section and formed from a non-magnetic substance unattracted by the magnet, and the downstream magnet section (1270) that is secured to the arm side and that switches between a closed state in which the needle thread is pinches to thereby grip between the downstream first plate-like section and the downstream second plate-like section by means of attracting the downstream first plate-like section from a back side of the downstream second plate-like section by magnetic force and an open state in which the needle thread is released from a gripped state by canceling attraction caused by the magnetic force;

needle thread supporting members (1288) that each is provided in the plate section and that each supports the needle thread in its horizontal direction at the position of the first opening section;

the turning section (1280) that turns the needle thread existing between the upstream grip section main body and the downstream grip section main body and that has the turning arm (1281) which contacts the needle thread supported by the needle thread supporting member and a needle thread motor (1286) which is secured to the arm side and which turns the turning arm;

an outer shuttle (110) which has a guide groove formed on a front side of a circular-arc inner peripheral surface that is one side of the inner peripheral surface in a direction of its axis line;

a middle shuttle (150) which rotates along the guide groove of the outer shuttle, which retains the needle thread, at least a rear section and a shaft of which are formed from a non-magnetic substance, and which has a race section (152) that is formed along a peripheral edge of the middle shuttle in the form of a circular arc and which is supported so as to be slidable over the guide groove, a rear section (161) continually extending from an end of a rear-side in an inner circumferential edge of the race, and the shaft (184) which is formed on a front side of the rear section and which is formed along a rotating center of the rear section;

a middle shuttle presser (130) which is disposed at a front side of the outer shuttle, to thus prevent the middle shuttle housed in the outer shuttle from falling from the outer shuttle;

a bobbin (300) which has a hole into which the shaft of the middle shuttle is inserted, which is axially supported within the middle shuttle as a result of the shaft being inserted into the hole, and which has a first magnet section (310) that is provided on a rear side surface which is a surface opposing a rear section of the middle shuttle when the bobbin is axially supported by the shaft; and a bobbin thread control section (200) which has a bobbin thread motor (202) which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section (214) which is rotated by the bobbin thread motor and provided in close proximity to the rear section of the middle shuttle and which rotates the first magnet section;

a storage section (92) for storing a torque table (92*e*) that specifies a needle thread control torque value and a bobbin thread control torque value which correspond to a combination of a value of a stitch width and a value based on a stitching direction; and a control section (90) that detects, according to the torque table, a needle thread control torque value and a bobbin thread control torque value for each stitch in the embroidery data which store, for each stitch, data pertinent to a value of a stitch width and data pertinent to a value representing a stitching direction, thereby generating needle thread control torque data which store, for each stitch, a needle thread control torque value and bobbin thread control torque data which stored, for each stitch, a bobbin thread control torque value; that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that detects at a starting point of the position control zone a current angle position of the needle thread motor which is a rotational position of the needle thread motor, generates angle correspondence data which specify an angle of the needle thread motor from a current angle position to an initial angle position of the needle thread motor for each angle of a main spindle motor, i.e., a rotational position of the main spindle motor (20) which rotates a main spindle (22) for transmitting power to the thread take-up lever and the needle bar, controls the position of the needle thread motor in each sewing unit to an angle of the needle thread motor corresponding to the angle of the main spindle motor as an angle of the main spindle motor changes as a result of rotation of the main spindle motor, in such a way that the angle of the needle thread motor returns to the initial angle position of the needle thread motor, thereby imparting rotating force to the turning arm in an upward direction to draw the needle thread from an upstream position, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from a bottom dead point to a top dead point of the thread take-up lever, and lets the turning arm recede to a receded position lower than an initial position of the turning arm and the needle bar housing case slide when processing proceeds to control of a next stitch and when a needle thread to be selected is changed, so that the upstream magnet section, the downstream magnet section, and the turning arm come to a position of the selected needle thread.

The first, thirteenth, and fifteenth configurations can also be added with an "input section (94) for inputting, from the outside, embroidery data, needle thread control torque data, and bobbin thread control torque data." Further, in the first, thirteenth, and fifteenth configurations, the storage section can also be embodied as a "storage section (92) for storing needle thread control torque data that store needle thread control torque values in embroidery data for each stitch and bobbin thread control torque data that store bobbin thread control torque values in embroidery data for each stitch." Moreover, in the first, eleventh, and thirteenth configurations, the storage section can also be embodied as a "storage section (92) for storing needle thread control torque data that store needle thread control torque values in embroidery data for each stitch and bobbin thread control torque data that store bobbin thread control torque values in embroidery data for each stitch," and the configurations are further added with an "input section (94) for inputting embroidery data from the outside."

The fourteenth and sixteenth configurations can also be added with an "output section (94) for outputting to the outside needle thread control torque data and the bobbin thread control torque data that are generated in accordance with the torque table." Further, in the third, fourteenth, and sixteenth configurations, the storage section can be embodied as a "storage section (92) for storing a torque table (92*e*) that specifies a needle thread control torque value and a bobbin thread control torque value which correspond to a combination of a value of a stitch width and a value based on a stitching direction," and the configurations can also be added with an "input-output section (94) for inputting, from the outside, embroidery data that store for each stitch data pertinent to a value of a switch width and data pertinent to a value representing a stitching direction and outputting to the outside needle thread control torque data and bobbin thread control torque data that are generated in accordance with the torque table."

In the third, fourteenth, and sixteenth configurations, the storage section can be embodied as a "storage section (92) for storing a torque table (92*e*) that specifies a needle thread control torque value and a bobbin thread control torque value which correspond to a combination of a value of a stitch width and a value based on a stitching direction," and the configurations can also be added with an "input-output section (94) for inputting, from the outside, data pertinent to the torque table and embroidery data that store for each stitch data pertinent to a value of a switch width and data pertinent to a value representing a stitching direction and outputting to the outside needle thread control torque data and bobbin thread control torque data that are generated in accordance with the torque table.

In the third, fourteenth, and sixteenth configurations, the "torque table (92*e*) that specifies a needle thread control torque value and a bobbin thread control torque value which correspond to a combination of a value of a stitch width and a value based on a stitching direction" can also be embodied as a "torque table (92*e*) that specifies a needle thread control torque value corresponding to a combination of a value of a stitch width and a value based on a stitching direction and a bobbin thread control torque value corresponding to a combination of a value of a stitch width and a value based on a stitching direction."

Advantages of the Invention

In the sewing machine of the invention, a magnitude of tension exerted on the needle thread and the bobbin thread can be controlled according to the needle thread control torque data and the bobbin thread control torque data. In particular, the needle thread control torque value in the needle thread control torque data and the bobbin thread control torque value in the bobbin thread control torque data are specified on a per-stitch basis. Therefore, tension exerted on the needle thread and the bobbin thread can be controlled on a per-stitch basis. Consequently, a stitch hardness can be controlled on a per-stitch basis. In each of the sewing units, needle thread tension and bobbin thread tension are controlled according to the needle thread control torque data and the bobbin thread control torque data. Accordingly, each of the sewing units can embellish process fabric with the same embroidery. Thus, the sameness of embroideries made by the respective sewing units can be considerably enhanced.

Even in a plurality of sewing machines, the needle thread control torque data are made identical, and the bobbin thread control torque data are also made identical. Thus, each of the sewing machines can embellish the process fabric with the same embroidery. The sameness of embroideries made by the respective sewing machines can be considerably enhanced.

BRIEF DESCRIPTION OF THE DRAWINGS

[FIG. 17] It is an explanatory view showing a configuration of embroidery data.

[FIG. 18] It is an explanatory view showing a configuration of needle thread control torque data and bobbin thread control torque data.

[FIG. 19] It is an explanatory view showing zone position data.

[FIG. 20] It is an explanatory view showing shuttle actuation data.

[FIG. 21] It is an explanatory view showing main spindle data.

[FIG. 28] It is an explanatory view showing angle correspondence data.

[FIG. 42] It is an explanatory view showing a needle thread torque table and a bobbin thread torque table.

EMBODIMENTS FOR IMPLEMENTING THE INVENTION

Figure 1:
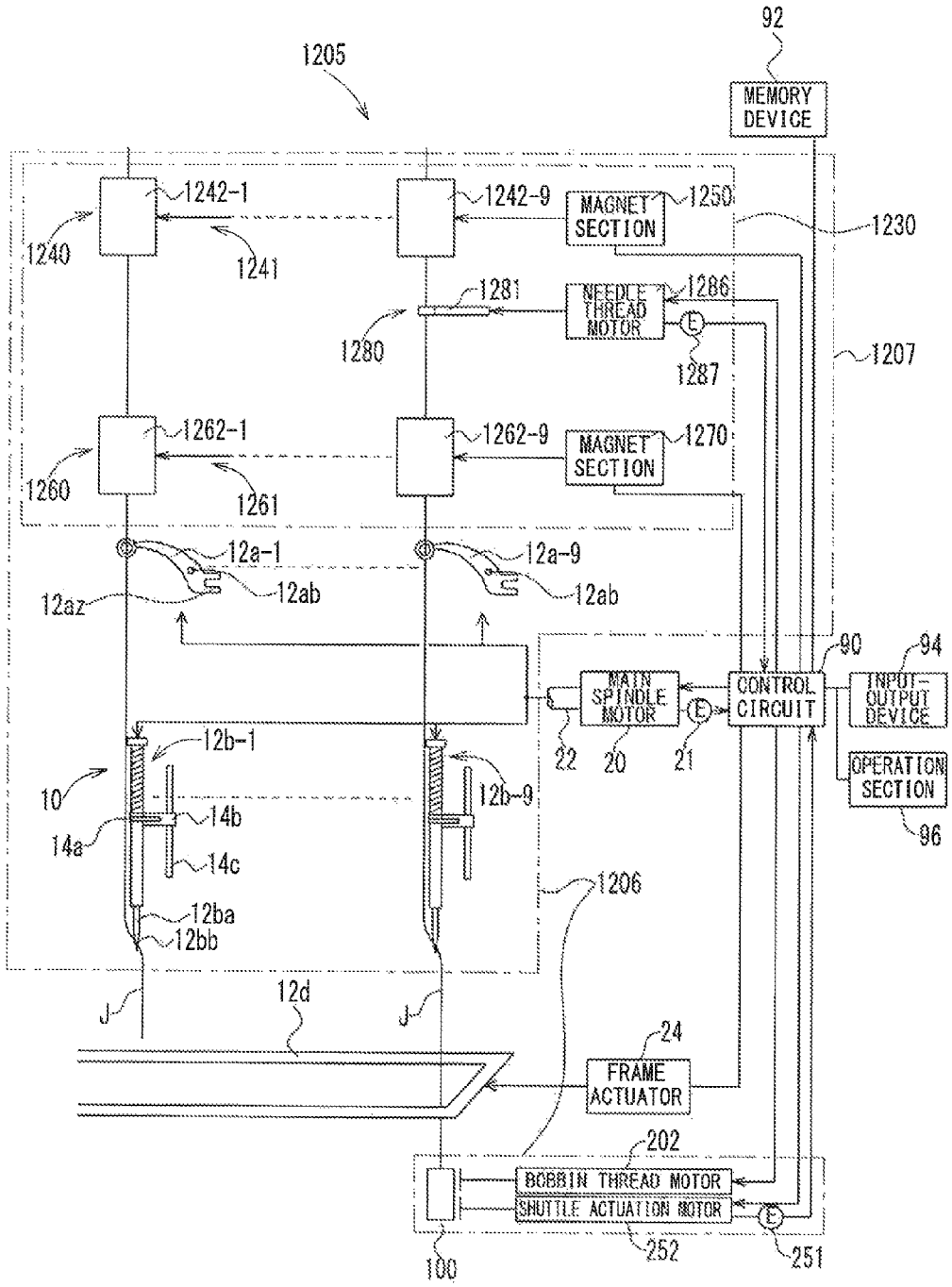
[FIG. 1] It is an explanatory view showing a sewing machine.
Figure 2:
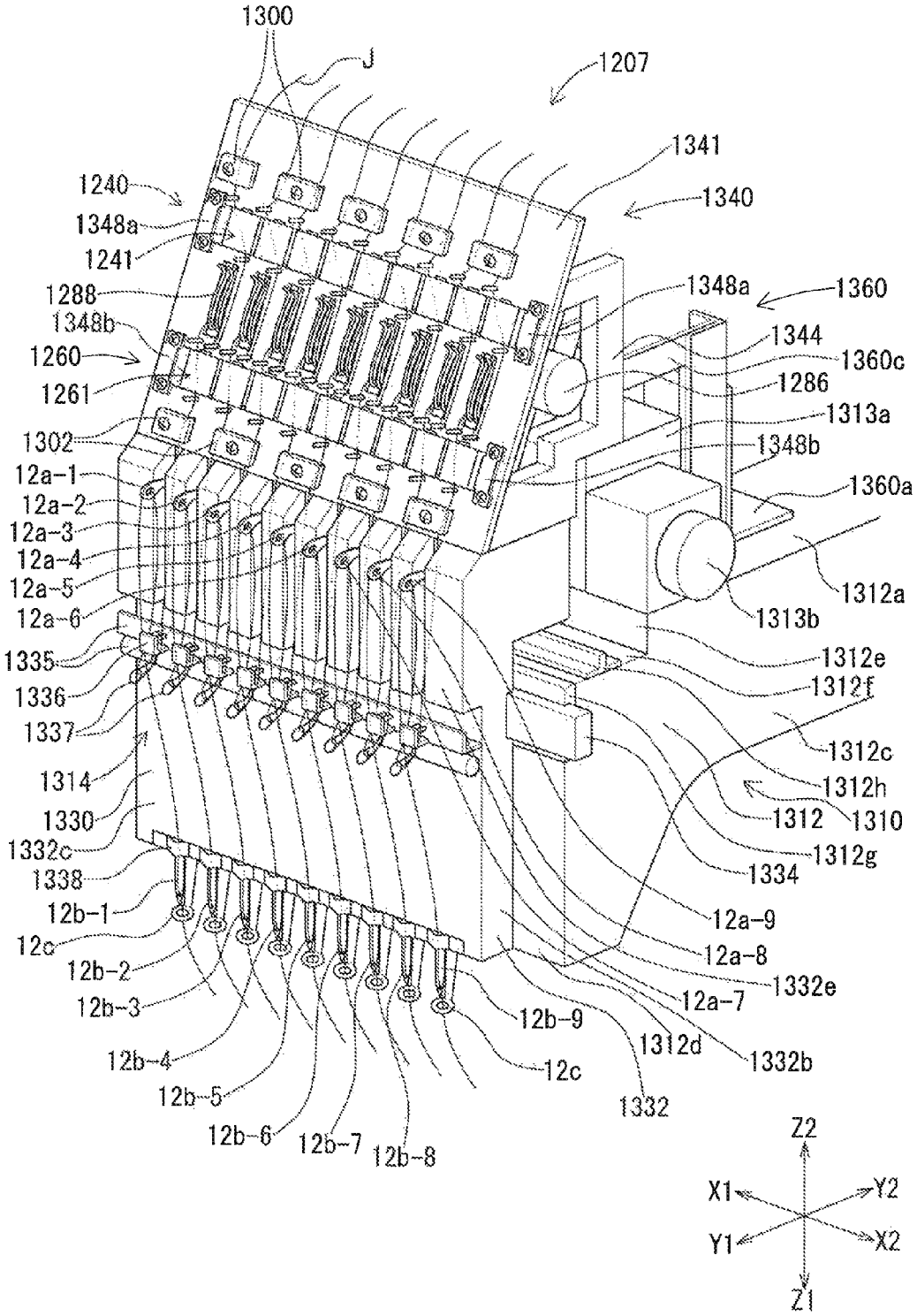
[FIG. 2] It is a forward perspective view showing a head of the sewing machine.
Figure 3:
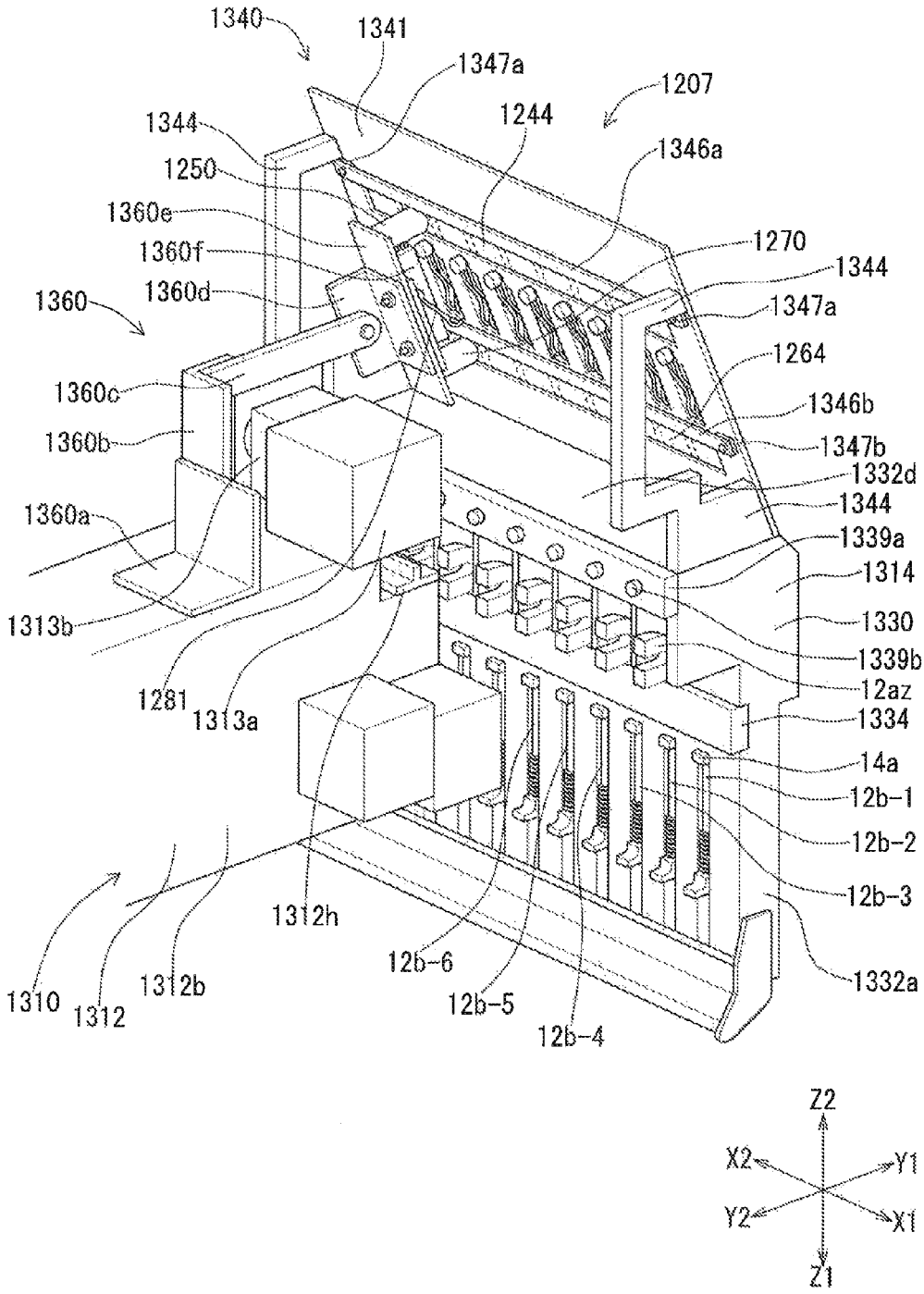
[FIG. 3] It is a backward perspective view showing the head of the sewing machine.

The invention accomplishes, as follows, the objective of providing a sewing machine capable of: controlling magnitudes of tension exerted on a needle thread and a bobbin thread, in particular, tension exerted on the needle thread and the bobbin thread on a per-stitch basis; embellishing process fabric with the same embroidery by use of respective heads of a multi-head embroidery sewing machine, in particular, considerably, highly enhancing the sameness of embroidery formed by the respective heads; and adorning the process fabric with the same embroidery even by means of a plurality of sewing machines, in particular, considerably, highly enhancing the sameness of the embroidery.

First Embodiment

A sewing machine 1205 based on the invention is an embroidery sewing machine, configured as shown in FIGS. 1 through 21, FIG. 38, and FIG. 39, and has a sewing table 3 (see FIG. 9), a head (an embroidery head) 1207, a sewing frame 12*d*, a main spindle motor 20, a main spindle 22, a frame actuator 24, a control circuit 90, a memory device 92, an input-output device 94, an operation section 96, a shuttle 100, a bobbin thread tension control mechanism section (a bobbin thread control section) 200, a shuttle actuation section 250, and a bobbin 300. The sewing machine 1205 is a multi-needle sewing machine; specifically, a nine-needle embroidery sewing machine compatible with nine types of needle threads.

In the sewing machine 1205, the head 1207, the shuttle 100, the bobbin thread tension control mechanism section 200, the shuttle actuation section 250, and the bobbin 300 make up a sewing unit 1206. The sewing unit 1206 is provided in numbers, and the sewing frame 12*d*, the main spindle motor 20, the main spindle 22, the frame actuator 24, the control circuit (control section) 90, the memory device (storage section) 92, the input-output device (the input-output section, the input section) 94, and the operation section 96 are provided commonly for the plurality of sewing units 1206.

Figure 4:
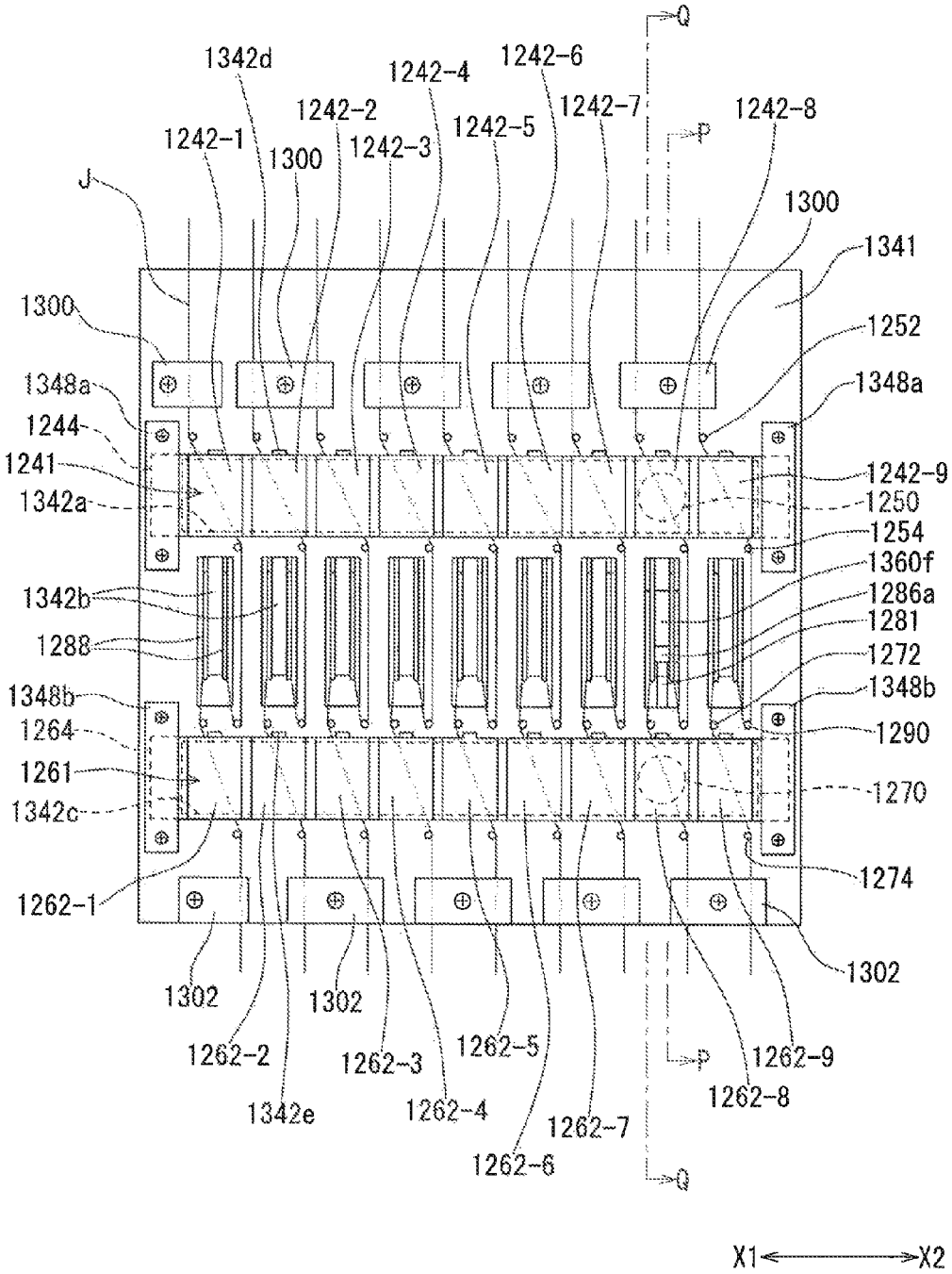
[FIG. 4] It is a front view showing a principal section of the head of the sewing machine.
Figure 5:
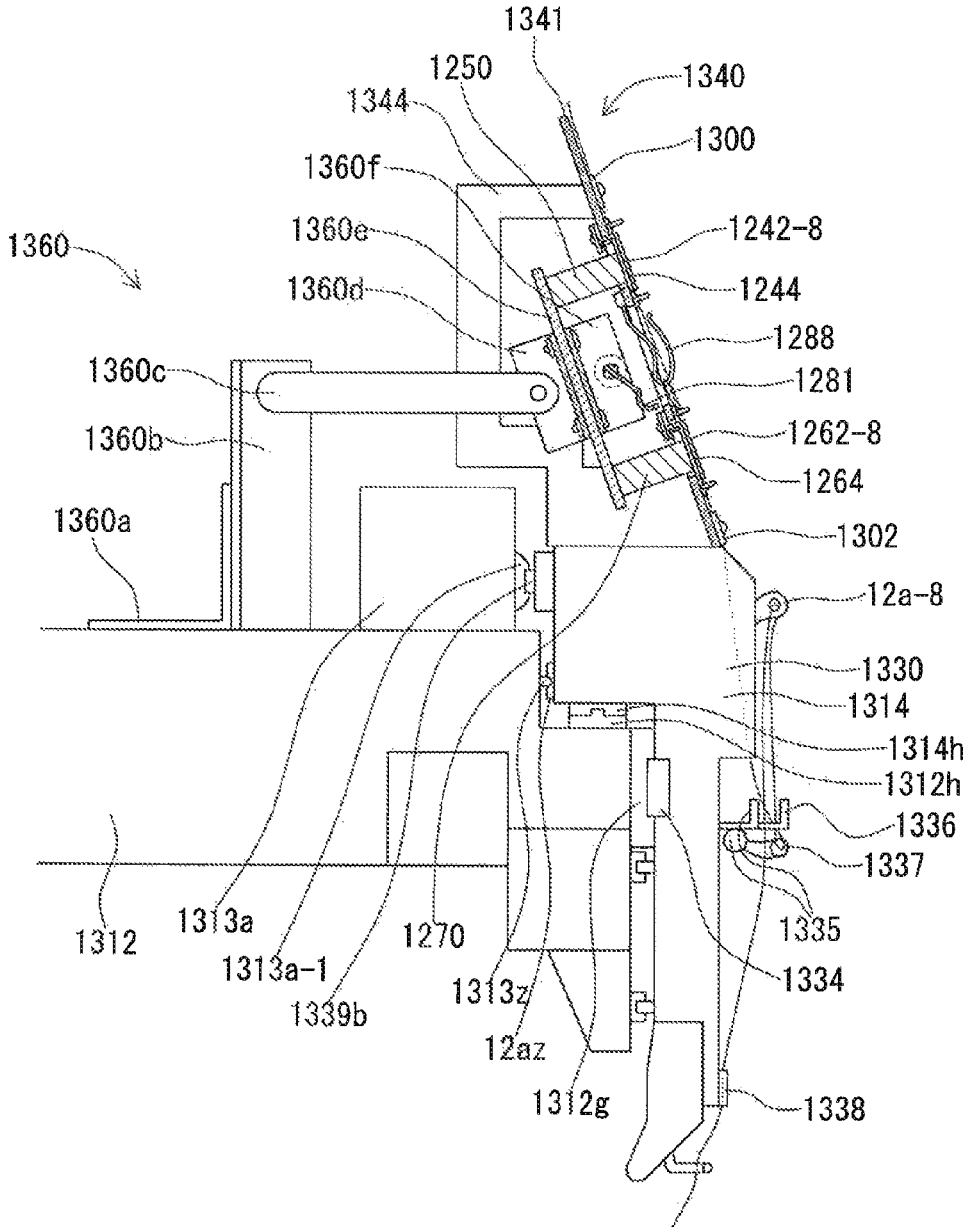
[FIG. 5] It is a fragmentary cross sectional left-side view showing the head of the sewing machine.
Figure 6:
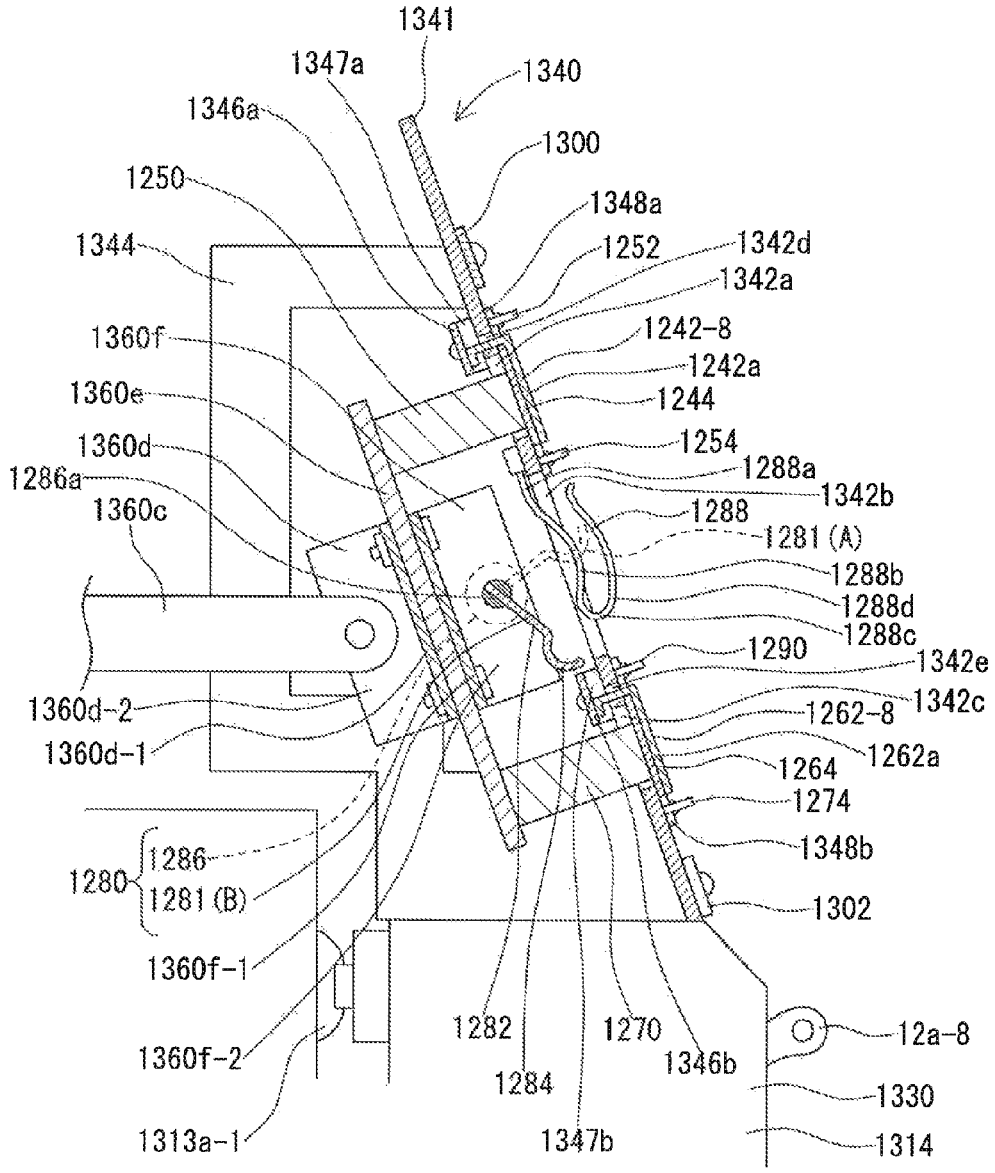
[FIG. 6] It is an enlarged view of the principal section shown in FIG. 5.
Figure 7:
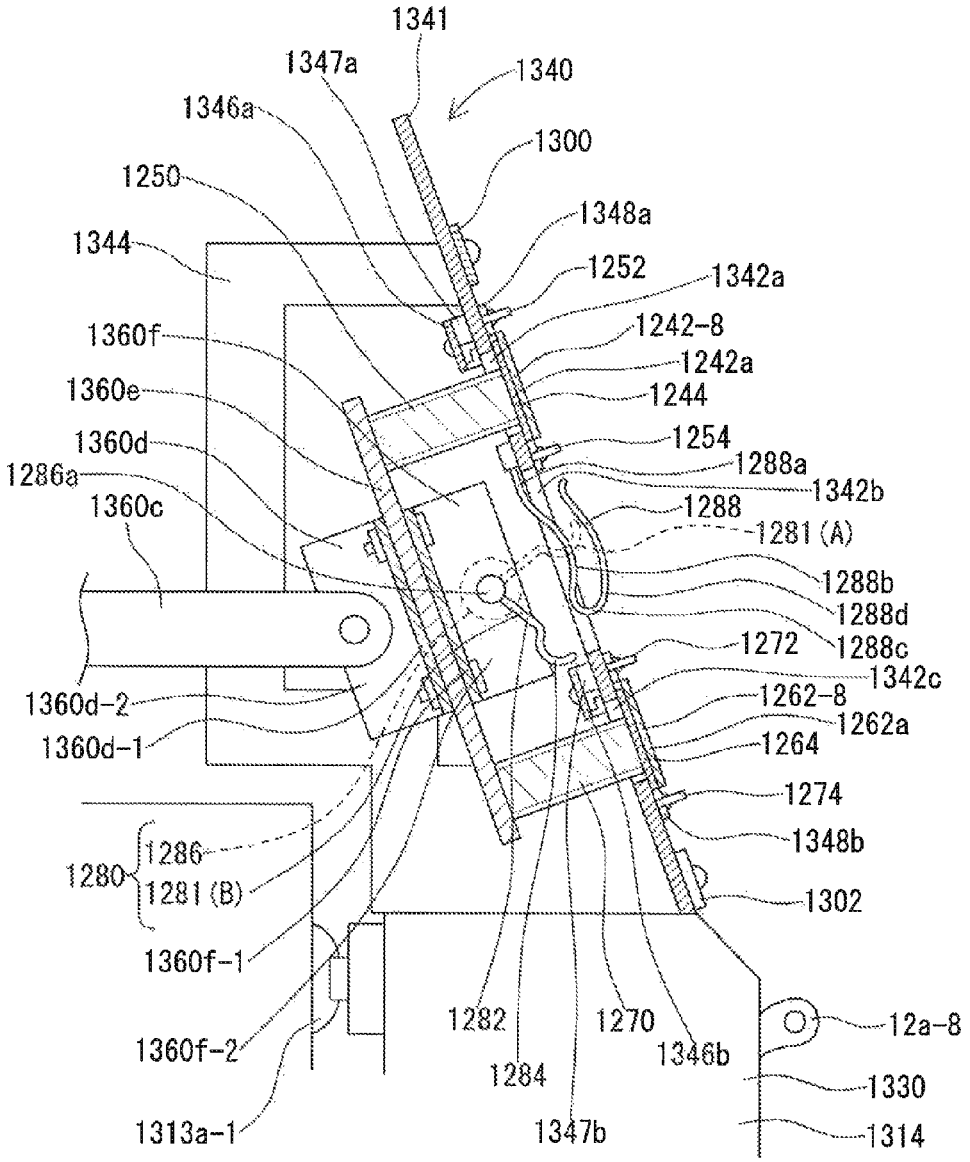
[FIG. 7] It is a fragmentary cross sectional left-side view showing the head of the sewing machine.

FIGS. 5 and 6 are fragmentary cross sectional left-side views showing cutaways of only a needle thread control mounting section 1340 and a needle thread control section 1230 taken along position P-P shown in FIG. 4. FIG. 7 is a fragmentary cross sectional left-side view showing cutaways of only the needle thread control mounting section 1340 and the needle thread control section 1230 taken at position Q-Q shown in FIG. 4. FIG. 5 to FIG. 7 are plots from which the needle thread is omitted.

The sewing machine table 3 assuming a substantially flat shape includes, as shown in FIG. 4, a plate-like table body 4 and a throat plate 5 positioned in an aperture formed in the table body 4. The head 1207 is disposed at an elevated position above an approximately-plate-like sewing machine table 3. Specifically, a frame (not shown) is disposed upright on the upper surface of the sewing machine table. The head 1207 is provided on the front side of the frame. The head 1206 is provided in numbers in the sewing machine 1205.

The head 1207 is structured as shown in FIG. 1 to FIG. 8 and has the machine element group 10, the needle thread control section 1230, the control circuit 90, and a case 1310.

The case 1310 makes up an enclosure of the sewing machine 1205 (specifically, the head 1207). The case 1310 has an arm 1312 (this may also be taken as an "arm section") secured to the frame and a needle bar case 1314 that slides in a horizontal direction with respect to the arm 1312 provided on a front side (Y1 side) of the arm 1312.

The arm 1312 is formed approximately into a shape of a case extended in its front-back direction, making up an enclosure of the sewing machine 1205 (specifically the head 1207). The arm 1312 has a shape enclosed by a square-shaped upper surface section 1312*a*; side surface sections 1312*b* and 1312*c* that continually extend from both lateral ends of the upper surface section 1312*a* in the downward direction and a front-side upper end of each of which has a square cutout; front surface section 1312*d* continually extending from front-side ends of the respective side surface sections 1312*b* and 1312*c* except their upper ends; front surface sections 1312*e* continually extending from the front-side ends in upper end areas of the respective side surface sections 1312*b* and 1312*c*; and upper surface section 1312*f* formed between lower ends of the respective front surface section 1312*e* and upper ends of the respective front surface section 1312*d*. A back-side end of the arm 1312 is connected to the frame.

A rail supporting section 1312*g* is provided on a front side of the arm 1312, and a rail section 1334 provided on a back side of a needle bar case main body 1330 slidably fits on the rail supporting section 1312*g*.

A rail 1312*h* having a shape of an approximately inverted letter T is disposed on the upper surface section 1312*f*. The needle bar case main body 1330 is equipped with a sliding member 1314*h* that slides over the rail 1312*h*.

Power transmission means, such as a cam mechanism or a belt mechanism, for transmitting rotating force of the main spindle 22 to respective machine elements is provided in the arm 1312.

A motor 1313*b* for letting the needle bar case 1314 slide and a clutch housing section 1313*a* are provided on an upper surface of the arm 1312. The clutch housing section 1313*a* is provided with a clutch 1313*a*-1 that is rotated by the motor 1313*b*. The clutch 1313*a*-1 has a helical groove. The helical groove of the clutch 1313*a*-1 is engaged with a cylindrical clutch engagement section 1339*b* provided on a back side of the needle bar case main body 1330. As a result of the clutch 1313*a*-1 being rotated, the needle bar case 1314 slides in the horizontal direction.

The needle bar case 1314 is formed approximately into a shape of a case that can slide in the horizontal direction with respect to the arm 1312. The needle bar case 1314 has the needle bar case main body (a needle bar housing case) 1330 and the needle thread control mounting section 1340.

The needle bar case main body 1330 is structured as shown in FIGS. 2, 3, 5, 6, and 7. The needle bar case main body 1330 has an enclosure section 1332; the rail section 1334 formed on a back side of the enclosure section 1332 along the horizontal direction; and supporting sections 1335, guide members 1336, tension springs (generally called "high tension springs") 1337, and needle thread guides 1338 that are all provided on a front side of the enclosure section 1332.

The enclosure section 1332 assumes a shape of a case that is formed in a vertically-elongated manner when viewed sideways. The enclosure section 1332 has a side surface section 1332*a* that is vertically long when viewed sideways and that has an upper end area protruding to the front and back sides; a side surface section 1332*b* formed symmetrical to the side section 1332*a*; a square-shaped front section 1332*c* interposed between a lower area of the side surface section 1332*a* and a lower area of the side surface section 1332*b*; an upper surface section 1332*d* that is interposed on the level between an upper end of the side surface section 1332*a* and an upper end of the side surface section 1332*b* in the horizontal direction; and a projecting section 1332*e* that is interposed between the front section 1332*c* and the upper surface section 1332*d* and that projects to the front rather than the front section 1332*c*. In relation to the projecting section 1332*e*, a plurality of projecting sections 1332*e* are spaced apart from each other. Opening sections (not shown) used for letting the thread take-up levers 12*a*-1 to 12*a*-9 project to the front are provided among the adjacent projecting sections 1332*e*.

The rail section 1334 is laid on the back side of the enclosure section 1332; assumes a square-rod-shaped cross section; and is formed along the horizontal direction. The rail section 1334 is supported so as to be slidable in the horizontal direction by the rail supporting section 1312*g* secured to the arm 1312. The rail supporting section 1312*g* and the rail section 1334 make up a linear way.

A plurality of cylindrical clutch engagement sections 1339*b* are provided along the horizontal direction, while spaced apart from each other, at an upper end on the back side of the enclosure section 1332 of the needle bar case main body 1330 by way of a horizontally-laid rod-shaped section 1339*a*. As a result of rotation of the motor 1313*b*, the clutch 1313*a*-1 rotates, whereupon the needle bar case 1314 slides in the horizontal direction.

The supporting sections 1335 are mounted on the level (or approximately on the level) to an upper area of a front side of the front section 1332*c* of the enclosure section 1332 along the horizontal direction. The guide members 1336 are provided at intervals for respective thread take-up levers on the supporting sections 1335 and assume the shape of an approximately-L-shaped plate. The tension springs 1337 are provided at intervals for the respective thread take-up levers and attached to the supporting sections 1335 beneath the respective guide members 1336. The tension springs 1337 are provided for guiding the needle threads J fed from above (namely, fed from the downstream grip section 1260) to the respective thread take-up levers while preventing occurrence of a flexure or looseness of the needle thread J. The tension springs 1337 invert the respective needle threads J guided from above and subsequently lead the respective needle threads J to the respective thread take-up levers while exerting tension on the respective needle threads J. The needle thread guides 1338 are provided at a lower end on the front side of the front section 1332*c* along the horizontal direction.

The needle thread control mounting section 1340 is mounted on an upper surface of the needle bar case main body 1330 (particularly the enclosure section 1332). The needle thread control mounting section 1340 has a plate-like plate section 1341; plate section supporting sections 1344 that support the plate section 1341 in an upright position; guide members 1252, 1254, 1272, 1274, and 1290 attached to the plate section 1341; and needle thread guides 1300 and 1302, guide plates 1346*a* and 1346*b*, rest sections 1347*a* and 1347*b*, and presser plates 1348*a* and 1348*b*.

The plate section 1341 assumes a shape of a (or approximately) rectangular plate. Formed in the plate section 1341 are an opening section (a second opening section) 1342*a* on which a magnet section 1250 fronts, a plurality of (nine in the illustrated example) opening sections (first opening sections) 1342*b* on which a turning arm 1281 fronts and that each are used for mounting a pair of needle thread supporting members 1288; and an opening section (a third opening section) 1342*c* on which a magnet section 1270 fronts. The plate section 1341 is formed in the horizontal direction, and upper and lower sides of the plate section 1341 are oriented along the horizontal direction.

The opening section 1342*a* is formed into a horizontally elongated rectangular shape above the opening sections 1342*b*. A vertical width of the opening section 1342*a* is larger than a leading end portion of the magnet section 1250, to thus make it possible to insert the leading end portion of the magnet section 1250 into the opening section 1342*a*. Likewise, the opening section 1342*c* is formed into a horizontally elongated rectangular shape below the opening sections 1342*b*. A vertical width of the opening section 1342*c* is larger than a leading end portion of the magnet section 1270, to thus make it possible to insert the leading end portion of the magnet section 1270 into the opening section 1342*c*.

The opening sections 1342*b* are provided in correspondence with the respective needle bars. The opening sections 1342*b* are formed at a position between a first plate-like section unit in a grip section main body 1241 and a first plate-like section unit in a grip section main body 1261 corresponding to the counterpart first plate-like section unit (i.e., a position between the a first plate-like section 1242*a* and a first plate-like section 1262*a* corresponding to the first plate-like section 1242*a*). Specifically, the opening sections 1342*b* assume a vertically-long rectangular shape. In the illustrated example, a total number of nine opening sections 1342*b* are provided. The opening sections 1342*b* are placed along the horizontal direction at spacing (specifically regular intervals). The opening sections 1342*b* are formed so that a leading end of the turning arm 1281 can project to the front side (Y1 side) of the plate section 1341 (the front side is on the other side of the plate section 1341 with respect to the arm 1312) in an exposed manner.

The plate section supporting section 1344 is provided at each of horizontal ends on the back side of the plate section 1341, assuming an approximately-C-shaped frame. Each of the plate section supporting sections 1344 is attached to an upper surface of the enclosure section 1332. The plate section 1341 is attached to the front side of the enclosure section 1332 and supported by the enclosure section 1332. The plate section 1341 is attached in such a way that a front-side surface of the plate section 1341 faces in an oblique upward direction.

The guide members 1252, 1254, 1272, 1274, and 1290 are provided vertically to a front-side surface of the plate section 1341 upright on the front-side surface of the plate section 1341. The guide member 1252 and the guide member 1254 are provided for each of first plate-like section units 1242-1 to 1242-9. The guide members 1252 are disposed at intervals along an upper side of the opening section 1342*a*. The guide members 1254 are disposed at intervals along a lower side of the opening section 1342*a*. The guide members 1272, the guide members 1274, and the guide members 1290 are provided for each of first plate-like section units 1262-1 to 1262-9. The guide members 1272 are disposed at intervals along an upper side of the opening section 1342*c*. The guide members 1274 are disposed at intervals along a lower side of the opening section 1342*c*. The guide members (the first needle thread path inverting members) 1290 are disposed at intervals along an upper side surface of the opening section 1342*c* while spaced apart from the respective guide members 1272.

The guide members 1252, 1254, 1272, 1274, and 1290 assume a substantially columnar shape.

The needle thread guides 1300 are disposed in an upper region on the front side of the plate section 1341 (a region above the guide members 1252), thereby guiding the respective needle threads in an insertable manner. In the illustrated example, the five needle thread guides 1300 are provided.

The needle thread guides 1302 are disposed in a lower region on the front side of the plate section 1341 (a region beneath the guide members 1274), thereby guiding the respective needle threads in an insertable manner. In the illustrated example, the five needle thread guides 1302 are provided.

The guide plate 1346*a* assumes the shape of an elongated rectangular plate and disposed in the horizontal direction on the back side of the plate section 1341 and along an upper side on a back surface of the opening section 1342*a*. The guide plate 1346*a* is placed on the back side of a retaining section 1242*b* for the first plate-like section units 1242-1 to 1242-9, preventing droppage of the first plate-like section units 1242-1 to 1242-9 from the plate section 1341. The rest section 1347*a* is provided at each of right and left lateral ends of the back side of the plate section 1341 while interposed between the guide plate 1346*a* and the back side of the plate section 1341, thereby forming spacing between the guide plate 1346*a* and the plate section 1341. Thus, the rest section 1347*a* makes it possible for the first plate-like ections units 1242-1 to 1242-9 to make sliding actions in the front-back direction with no difficulty.

The guide plate 1346*b* assumes the shape of an elongated rectangular plate and disposed in the horizontal direction on the back side of the plate section 1341 and along an upper side on a back surface of the opening section 1342*c*. The guide plate 1346*b* is placed on the back side of a retaining section 1262*b* for the first plate-like section units 1262-1 to 1262-9, preventing droppage of the first plate-like section units 1262-1 to 1262-9 from the plate section 1341. The rest section 1347*b* is provided at each of right and left lateral ends of the back side of the plate section 1341 while interposed between the guide plate 1346*b* and the back side of the plate section 1341, thereby forming spacing between the guide plate 1346*b* and the plate section 1341. Thus, the rest section 1347*b* makes it possible for the first plate-like section units 1262-1 to 1262-9 to make sliding actions in the front-back direction with no difficulty.

The presser plates 1348*a* are provided on both sides of the opening section 1342*a* on the front surface of the plate section 1341. Right and left lateral side ends of a second plate-like section 1244 are sandwiched between the presser plates 1348*a* and the plate section 1341. The presser plates 1348*b* are provided on both sides of the opening section 1342*c* on the front surface of the plate section 1341. Right and left lateral side ends of a second plate-like section 1264 are sandwiched between the presser plates 1348*b* and the plate section 1341.

The machine element group 10 is comprised of machine elements to be actuated in the head 1207. The machine elements include the plurality of thread take-up levers, the plurality of needle bars, and the presser feet. However, in the embodiment, the head is equipped with nine thread take-up levers 12*a*-1 to 12*a*-9, nine needle bars 12*b*-1 to 12*b*-9, and nine presser feet 12*e*. The thread take-up levers 12*a*-1 to 12*a*-9, the needle bars 12*b*-1 to 12*b*-9, and the shuttle 100 are actuated by means of transmitting rotating force of the main spindle 22 by way of the power transmission means, like a cam mechanism or a belt mechanism, as in the case of the related-art sewing machine. Incidentally, the number of thread take-up levers, needle bars, and presser feet can also be any number other than nine (e.g., 12).

The thread take-up levers 12*a*-1 to 12*a*-9 are provided in the enclosure section 1332 of the needle bar case main body 1330 of the case 1310 and are formed so as to be able to sway around an axis line (the rotating center) in the horizontal direction (the direction X1-X2) and turn between the bottom dead center (one dead center) and the top dead center (the other dead center). Specifically, the thread take-up levers 12*a*-1 to 12*a*-9 are axially supported by the needle bar case main body 1330 so as to sway around the rotating center (this can also be taken as a"swaying center") 12*ab* (see FIG. 1). Needle threads to be inserted into the respective sewing needles are inserted into the respective thread take-up levers 12*a*-1 to 12*a*-9. Power is transmitted to only a selected, specific thread take-up lever as a result of the needle bar case 1314 sliding in the horizontal direction with respect to the arm 1312, whereupon the specific thread take-up lever is swayed. In other words, base ends 12*az* (see FIG. 3) of the respective thread take-up levers 12*a*-1 to 12*a*-9 are engaged with engagement members 1313*z* of the arm 1312. The thread take-up levers are then swayed as a result of the engagement members 1313*z* turning around a turning center. Leading ends of the respective thread take-up levers 12*a*-1 to 12*a*-9 project to the front (in direction Y1), in an exposed manner, from the respective opening sections provided between the adjacent projecting sections 1332*e* on the front side of the enclosure section 1332. In this respect, leading ends of the respective thread take-up levers 12*a*-1 to 12*a*-9 jut outside in an exposed manner to the front side (side Y1) by way of respective openings opened among adjacent projections 1332*e* among a plurality of projections 1332*e* provided on the front side of the enclosure section 1332.

The needle bars 12*b*-1 to 12*b*-9 are provided in the enclosure section 1332 so as to be movable in the vertical direction. Sewing needles 12*ba* (each of the sewing needles 12*ba* has a pin hole) are fixedly provided at lower ends of the respective needle bars. A needle bar connecting stud 14*a* is fixedly provided at the upper end of each of the needle bars 12*b*. Moreover, a needle bar actuation member 14*b* comes into engagement with the needle bar connecting stud 14*a*. A base needle bar 14*c* provided in the vertical direction is inserted into each of the needle bar actuation member. The needle bar actuation member 14*b* is formed so as to be movable in the vertical direction along the base needle bar 14*c*. Rotating force of the main spindle 22 is transmitted by the power transmission means, whereupon the needle bar actuation member 14*b* is vertically actuated. The needle bars are thereby moved in the vertical direction. The needle bar case 314 slides in the horizontal direction with respect to the arm 1312, whereby the needle bar actuation member is engaged with a specific needle bar connecting stud 14*a*, so that a selected needle bar is vertically actuated. The presser foot 12*e* is provided for each of the needle bars.

The needle thread control section 1230 is for drawing a needle thread from the thread roll (not shown) wound around the needle thread bobbin and controlling tension exerted on the needle threads. The needle thread control section 1230 has an upstream grip section 1240, the downstream grip section 1260, a turning section 1280 (see FIG. 1, FIG. 6, and FIG. 7), and a supporting section (a magnet section and a motor supporting member) 1360.

Incidentally, the upstream grip section 1240 is placed at an upper area of the plate section 1341; namely, an area above the turning sections 1280. The upstream grip section 1240 has the grip section main body (an upstream grip section main body) 1241 and the magnet section (an upstream drive section and an upstream magnet section) 1250 provided on a back side of the grip section main body 1241.

The grip section main body 1241 has the first plate-like section units 1242-1 to 1242-9 provided for the respective needle bars and the second plate-like section (an upstream second plate-like section) 1244 that is provided on the back side of the first plate-like section 1242*a* in the first plate-like section units 1242-1 to 1242-9 and on the front side of the needle bar case 1314 (specifically the plate section 1341).

Figure 8:
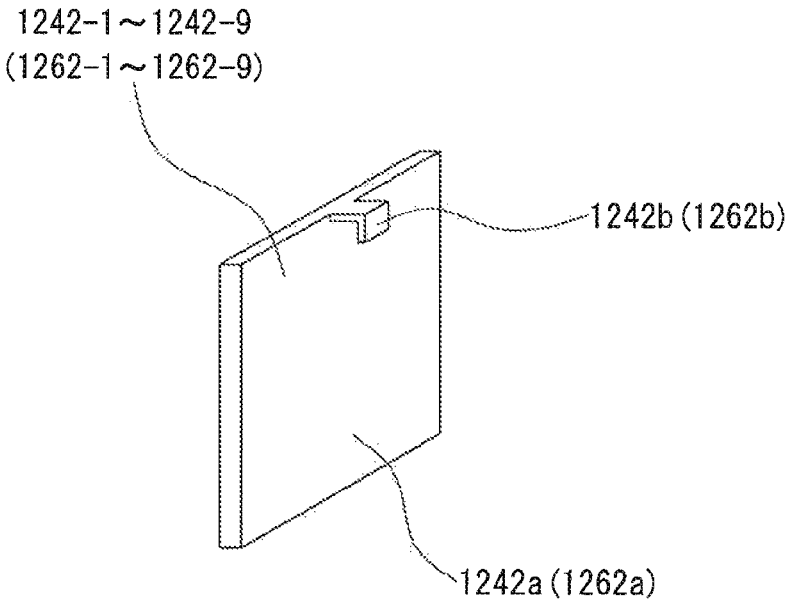
[FIG. 8] It is a backward perspective view of a first plate-like section unit.
Figure 9:
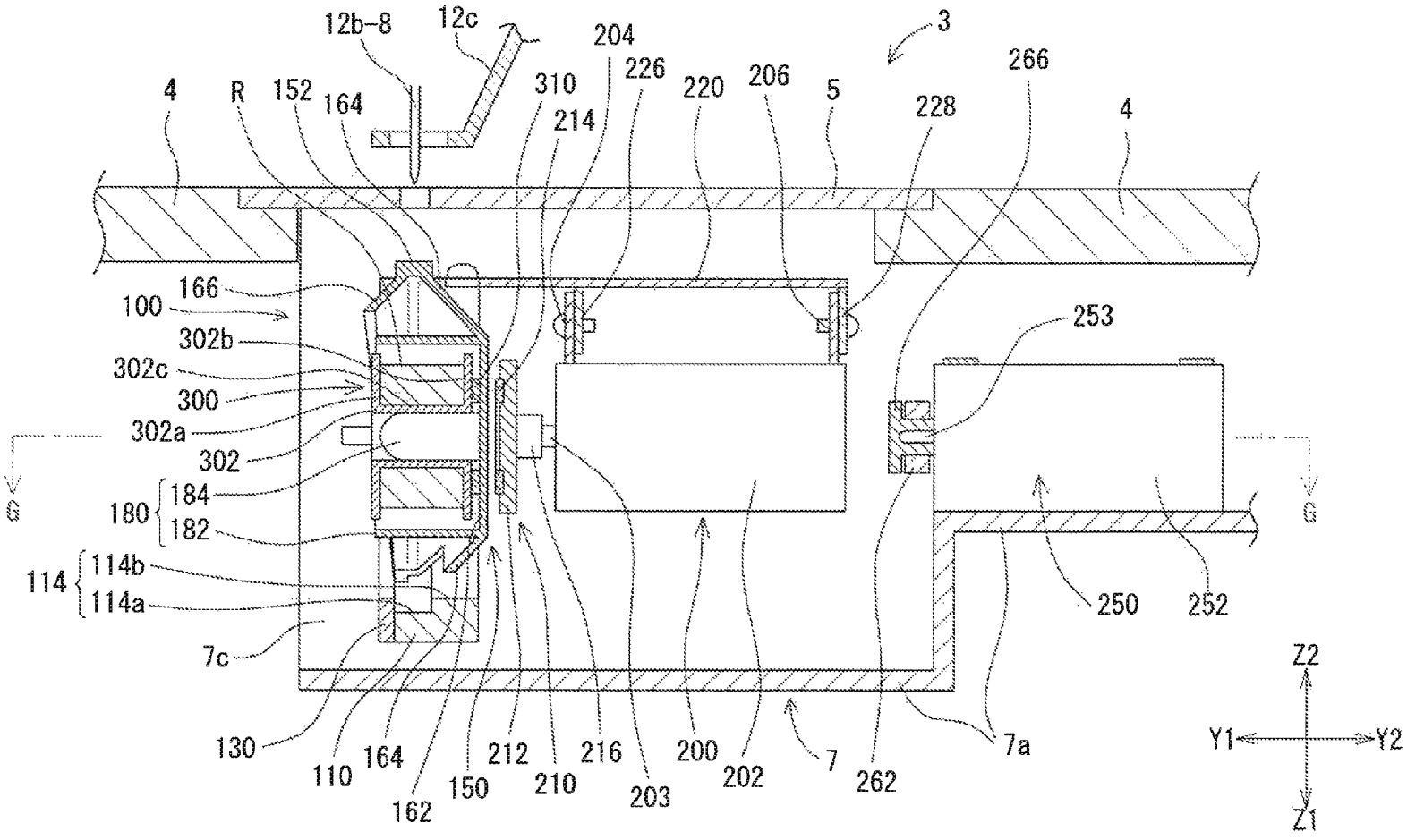
[FIG. 9] It is a longitudinal cross sectional view of a principal section of the sewing machine.
Figure 10:
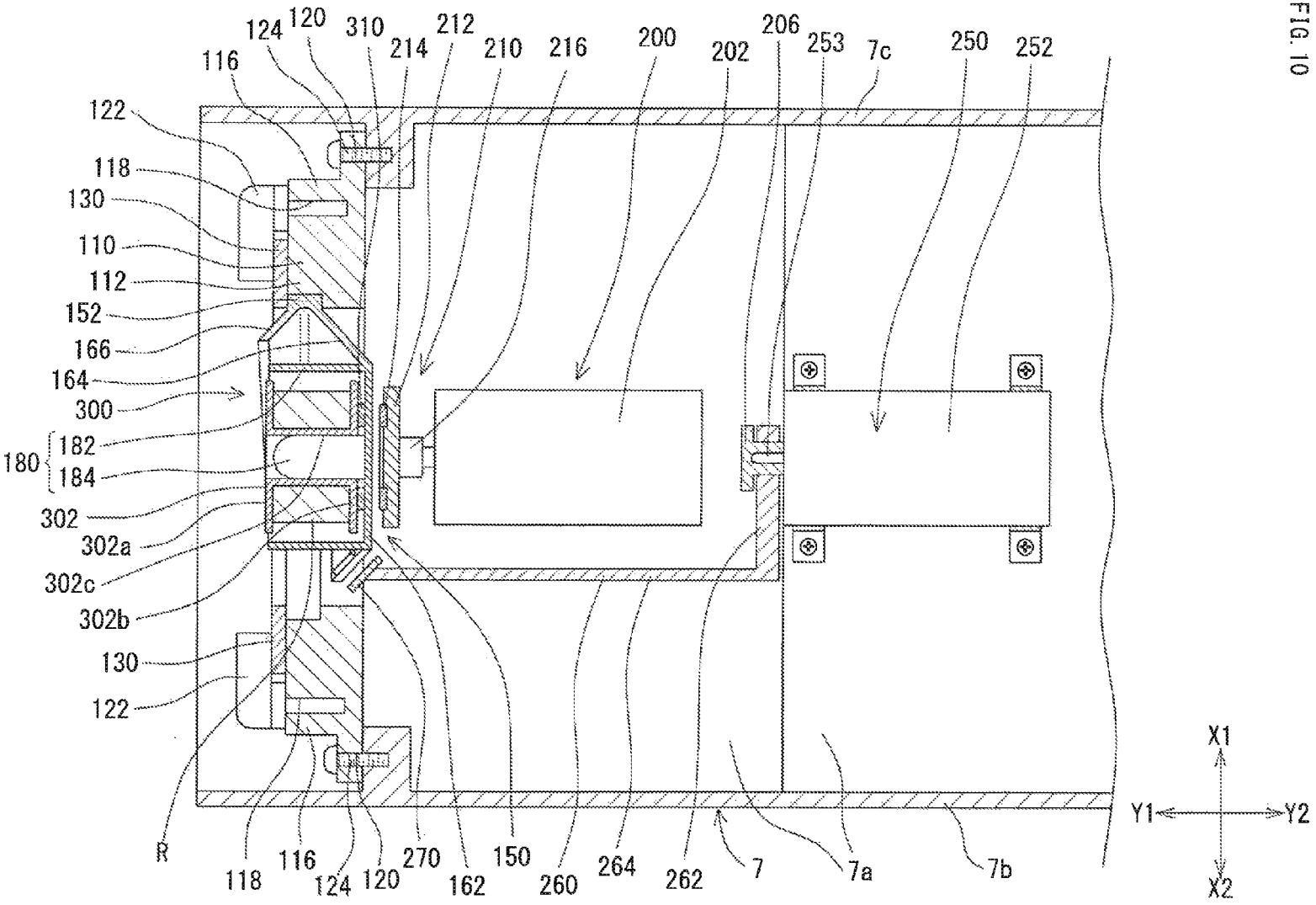
[FIG. 10] It is a transverse cross sectional view of the principal section of the sewing machine, that is, a cross sectional view taken along G-G shown in FIG. 9.
Figure 11:
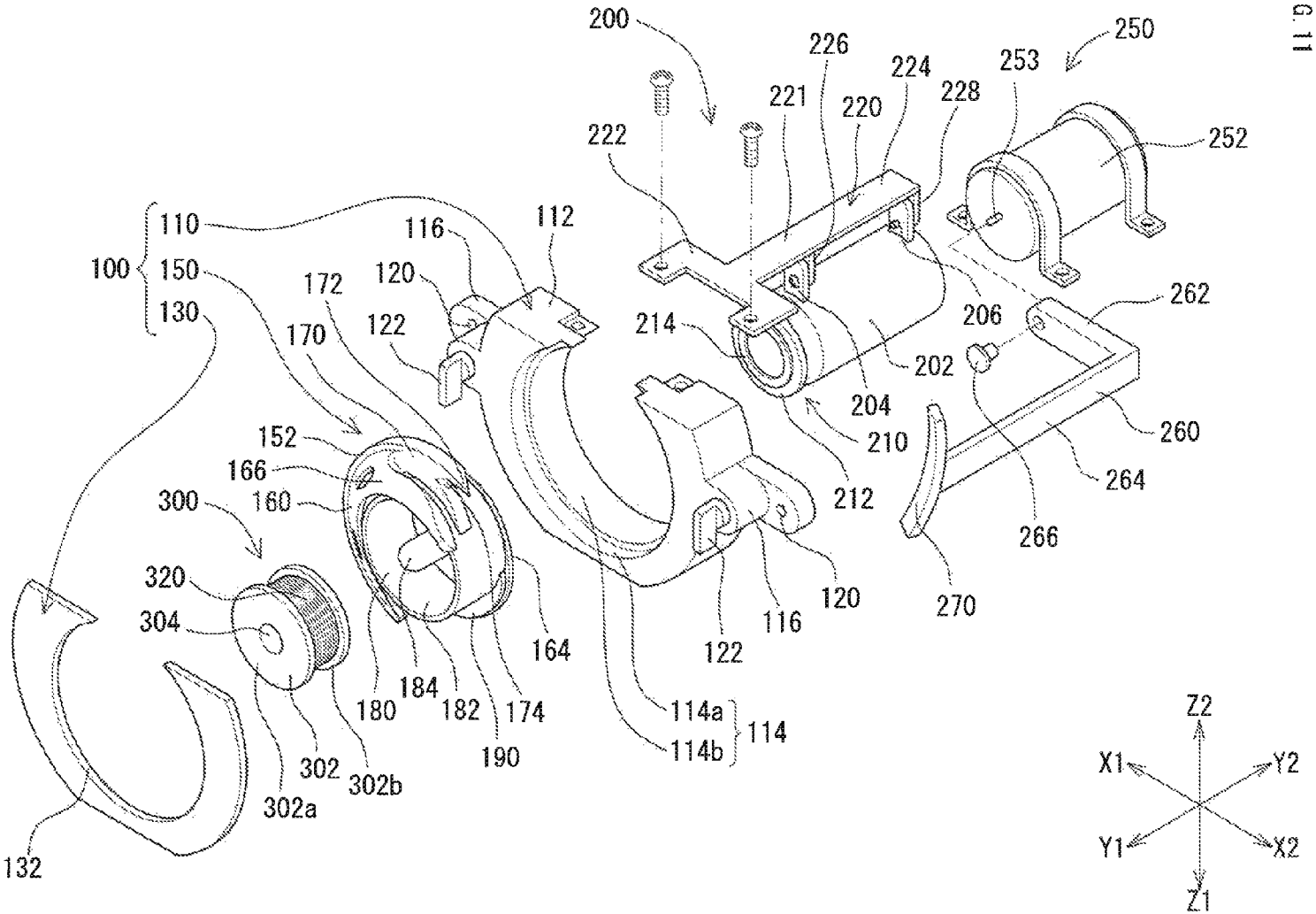
[FIG. 11] It is a forward exploded perspective view of a shuttle, a bobbin thread tension control mechanism section, a shuttle actuation section, and a bobbin of the sewing machine.
Figure 12:
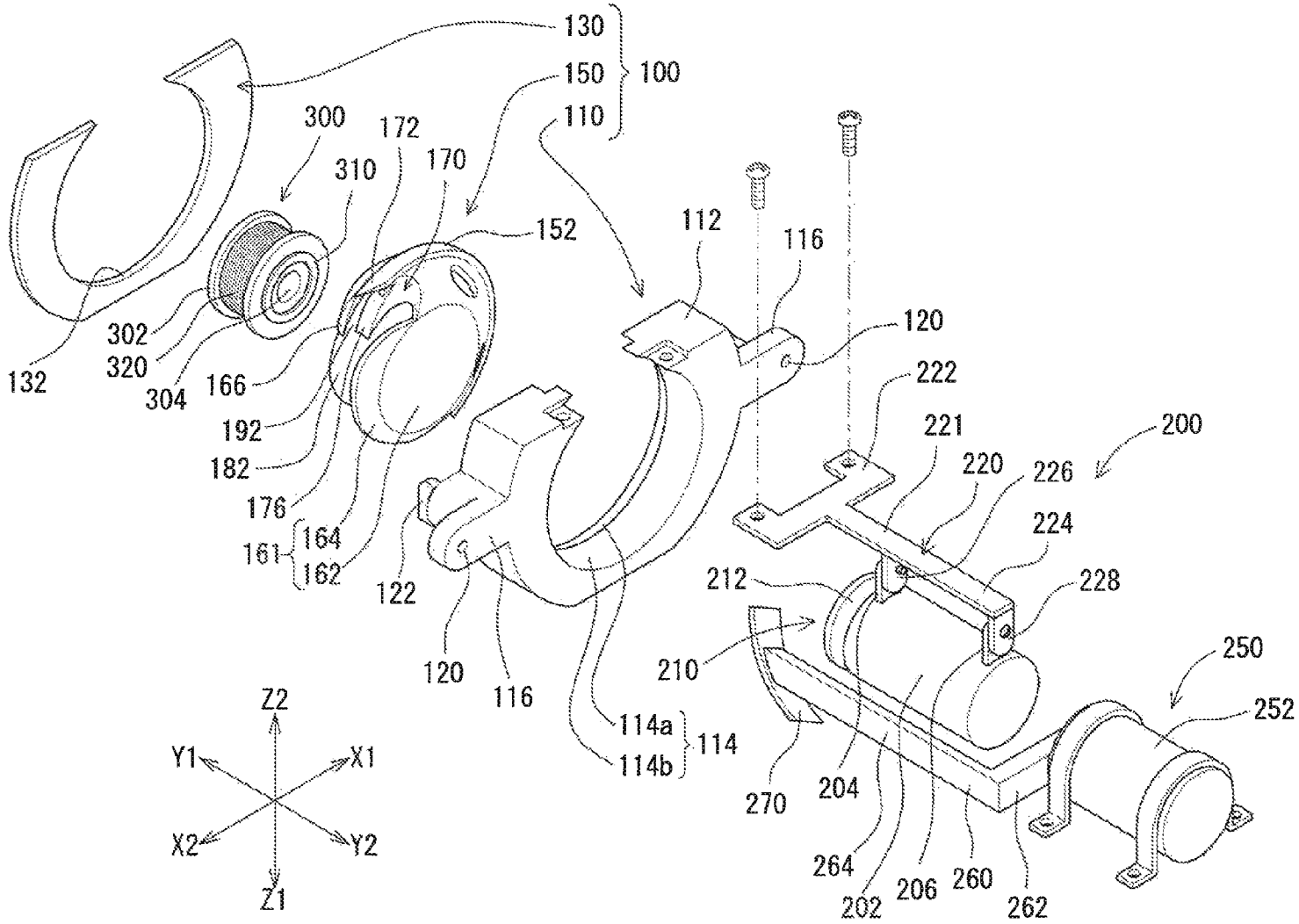
[FIG. 12] It is a backward exploded perspective view of the shuttle, the bobbin thread tension control mechanism section, the shuttle actuation section, and the bobbin of the sewing machine.

As shown in FIG. 8, each of the first plate-like section units 1242-1 to 1242-9 includes the first plate-like section (an upstream first plate-like section) 1242*a* assuming the shape of a square-shaped plate and the retaining section (a mounting member) 1242*b* formed so as to project from an upper end of the first plate-like section 1242*a* to the back. The retaining section 1242*b* assumes the shape of an approximately-L-shaped plate (a shape made by bending a rectangular plate approximately into the letter L). The first plate-like section unit is integrally formed from a material which is attracted by a magnet (a material to which a magnet adheres); that is, a magnetic substance (or a ferromagnetic substance instead). Specifically, each of the first plate-like section units 1242-1 to 1242-9 is formed from metal attracted by a magnet, like iron. The first plate-like section units are formed in (or approximately) a same size and a same shape. As a result of the retaining sections 1242*b* being engaged with retaining holes 1342*d* formed in the plate section 1341, the first plate-like section units 1242-1 to 1242-9 are arranged at spacing (specifically uniform intervals) side by side along the horizontal direction. Spacing exists between two adjacent first plate-like section units. The plurality of (specifically, a total of nine) retaining holes 1342*d* are arranged at spacings (specifically uniform intervals) side by side along the horizontal direction and at an area on the plate section 1341 above the opening section 1342*a*. The first plate-like sections are suspended by means of the plate section 1341 (or may also hang from the plate section) as a result of the retaining sections 1242*b* being engaged with the respective retaining holes 1342*d*. The first plate-like section 1242*a* slides in the vertical direction with respect to the front surface of the second plate-like section 1244, whereby spacing between the first plate-like section 1242*a* and the second plate-like section 1244 varies.

The second plate-like section 1244 is a single plate-like member that is provided at the back side of the first plate-like sections 1242*a* of the respective first plate-like section units 1242-1 to 1242-9 and that assumes the shape of an elongated rectangle. Specifically, the second plate-like section 1244 is formed so as to become, in the horizontal direction, longer than a distance from a left lateral side of the first plate-like section 1242*a* of the first plate-like section unit 1242-1 provided at a left end to a right lateral side of the first plate-like section 1242*a* of the first plate-like section unit 1242-9 provided at a right end when viewed from the front. In addition, the second plate-like section 1244 is formed so as to have, in the vertical direction, (approximately) the same width as a vertical width of each of the first plate-like sections 1242*a* of the first plate-like section units 1242-1 to 1242-9. The left end of the second plate-like section 1244 when viewed from the front is situated more left than the left lateral side of the first plate-like section 1242*a* of the first plate-like section unit 1242-1 and fixed to the plate section 1341 by means of the presser plate 1348*a*. The right end of the second plate-like section 1244 when viewed from the front is situated more right than the right lateral side of the first plate-like section 1242*a* of the first plate-like section unit 1242-9 and fixed to the plate section 1341 by means of the presser plate 1348*a*. Specifically, the second plate-like section 1244 is present on the back of each of the respective first plate-like section units 1242-1 to 1242-9 and in parallel with the respective first plate-like sections of the respective first plate-like section units 1242-1 to 1242-9. The second plate-like section 1244 is formed from a substance unattracted by the magnet (a material to which the magnet does not adhere); that is, a non-magnetic substance, for instance, a film made from a synthetic resin. The second plate-like section 1244 can also be made from aluminum or stainless steel.

The second plate-like section 1244 is made larger than the opening section 1342*a* and provided so as to cover the opening section 1342*a* from the front.

The magnet section 1250 is formed from an electromagnet, and a leading end of the magnet section is formed so as to be placed in the opening section 1342*a* and contact the back side of the second plate-like section 1244. A surface (facing the second plate-like section 1244) of the leading end of the magnet section 1250 works as an attracting surface. The magnet section 1250 assumes a shape of an approximately cylindrical shape (the same also holds true for the magnet section 1270). FIG. 33 to FIG. 35, FIG. 38, FIG. 39, FIG. 42, and FIG. 44 depict the magnet sections 1250 and 1270 while their detailed cross-sectional profiles are omitted. The magnet sections 1250 and 1270 are structurally similar to an ordinary electromagnet and include a core made of a magnetic substance and a coil wound around the core. When energized, the coil generates magnetic force. One magnet section 1250 is provided for the upstream grip section 1240. The control circuit 90 activates the magnet section 1250, whereupon the first magnet section 1242*a* of any one of the first plate-like section units 1242-1 to 1242-9 corresponding to the position of the magnet section 1250 is attracted by the magnetic force. Spacing between the first plate-like section 1242*a* and the second plate-like section 1244 is thus closed. The magnet section 1250 is attached to an upper end of a front surface of a plate-like section 1360*e* in the supporting section 1360 in a direction perpendicular to a back side of the plate section 1341. Specifically, the magnet section 1250 is secured in the direction of the arm 1312.

Figure 32:
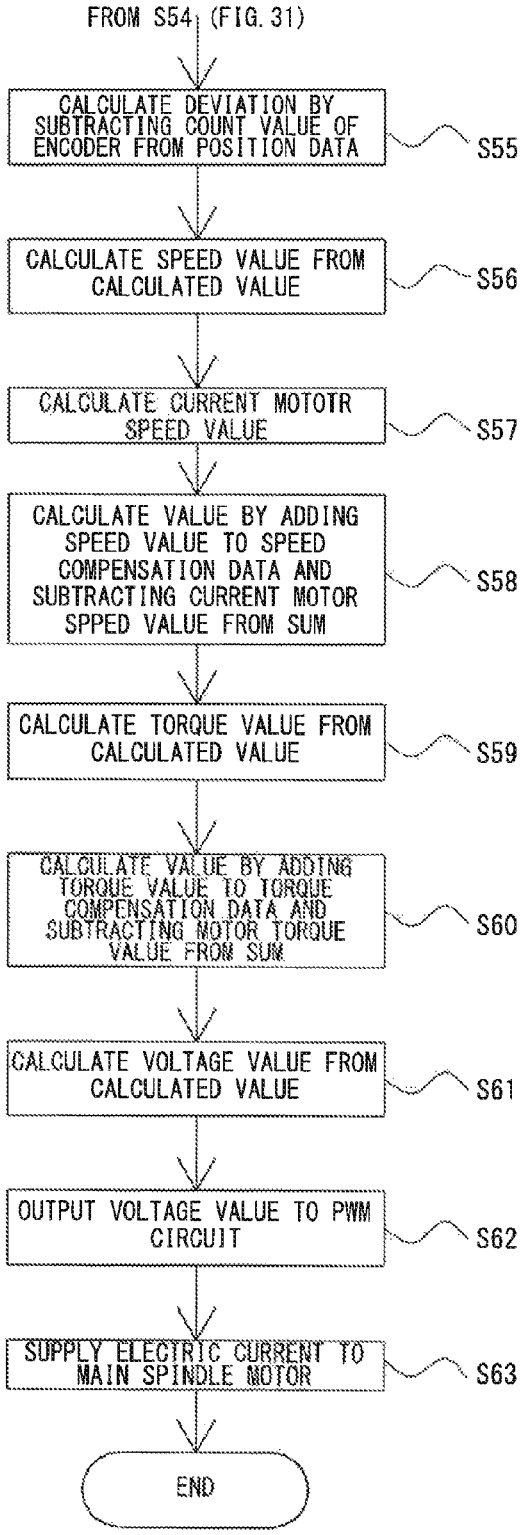
[FIG. 32] It is a flowchart showing the method for controlling a main spindle motor.

When the respective first plate-like sections 1242*a* of the first plate-like section units 1242-1 to 1242-9 are viewed from the front, the guide members (first guide members) 1252 are provided above the respective first plate-like section units 1242-1 to 1242-9, and the guide members (first guide members) 1254 are provided below the respective first plate-like section units 1242-1 to 1242-9. As shown in FIG. 32, the guide members 1252 and 1254 are arranged in such a way that the needle thread J diagonally passes on the back side of each of the first plate-like sections. Each of the guide members 1252 is provided at an upper left point above each of the first plate-like sections when viewed from the front. Each of the guide members 1254 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1244 in a more reliable manner.

The downstream grip section 1260 is placed on a lower area of the plate section 1341; namely, an area below the turning section 1280. The downstream grip section 1260 has the grip section main body (a downstream grip section main body) 1261 and the magnet section (a downstream actuation section or a downstream magnet section) 1270 provided at the back side of the grip section main body 1261.

The grip section main body 1261 has the same structure as that of the grip section main body 1241. The grip section main body 1261 has the first plate-like section units 1262-1 to 1262-9 provided for the respective needle bars and the second plate-like section (a downstream second plate-like section) 1264 that is provided at the back side of the first plate-like sections 1262*a* of the respective first plate-like section units 1262-1 to 1262-9 and on the front side of the needle bar case 1314 (specifically, the plate section 1341).

The first plate-like section units 1262-1 to 1262-9 are structurally similar to the first plate-like section units 1242-1 to 1242-9. As shown in FIG. 8, each of the first plate-like sections 1262*a* of the first plate-like section units 1262-1 to 1262-9 includes the first plate-like section (a downstream first plate-like section) 1262*a* assuming the shape of a square-shaped plate and a retaining section (a mounting member) 1262*b* formed so as to project from an upper end of the first plate-like section 1262*a* to the back. The retaining section 1262*b* assumes the shape of an approximately-L-shaped plate. Specifically, each of the first plate-like section units 1262-1 to 1262-9 is formed from a material which is attracted by the magnet (a material to which the magnet adheres); that is, a magnetic substance (or a ferromagnetic substance instead). The respective first plate-like section units are formed in (or approximately) a same size and a same shape. As a result of the retaining sections 1262*b* being engaged with retaining holes 1342*e* formed in the plate section 1341, the first plate-like section units 1262-1 to 1262-9 are arranged at spacing (specifically uniform intervals) side by side along the horizontal direction. Specifically, spacing exists between two adjacent first plate-like section units. The plurality of (specifically, a total of nine) retaining holes 1342*e* are arranged at spacings (specifically uniform intervals) side by side along the horizontal direction and at an area on the plate section 1341 above the opening section 1342*c* (and below the opening section 1342*b*). The first plate-like sections are suspended by means of the plate section 1341 (or may hang from the plate section) as a result of the retaining sections 1262*b* being engaged with the respective retaining holes 1342*e*. The first plate-like section 1262*a* slides in the vertical direction with respect to the front surface of the second plate-like section 1264, whereby spacing between the first plate-like section 1262*a* and the second plate-like section 1264 varies. In relation to the first plate-like section units 1242-1 to 1242-9 and the first plate-like section units 1262-1 to 1262-9, the first plate-like section units assigned to the same needle thread are placed at the same position with reference to the horizontal direction.

The second plate-like section 1264 is structurally similar to the second plate-like section 1244. The second plate-like section 1264 is a single plate-like member that is provided on the back side of the first plate-like sections 1262*a* of the respective first plate-like section units 1262-1 to 1262-9. Specifically, the second plate-like section 1264 is formed so as to become, in the horizontal direction, longer than a distance from a left lateral side of the first plate-like section 1262*a* of the first plate-like section unit 1262-1 provided at a left end to a right lateral side of the first plate-like section 1262*a* of the first plate-like section unit 1262-9 provided at a right end when viewed from the front. In addition, the second plate-like section 1264 is formed so as to have, in the vertical direction, (or approximately) the same width as a vertical width of each of the first plate-like sections 1262*a* of the first plate-like section units 1262-1 to 1262-9. The left end of the second plate-like section 1264 when viewed from the front is situated more left than the left lateral side of the first plate-like section 1262*a* of the first plate-like section unit 1262-1 and fixed to the plate section 1341 by means of the presser plate 1348*b*. The right end of the second plate-like section 1264 when viewed from the front is situated more right than the right lateral side of the first plate-like section 1262*a* of the first plate-like section unit 1262-9 and fixed to the plate section 1341 by means of the presser plate 1348*b*. Specifically, the second plate-like section 1264 is present at a back side of each of the first plate-like sections of the respective first plate-like section units 1262-1 to 1262-9 and in parallel with the respective first plate-like sections of the respective first plate-like section units 1262-1 to 1262-9. The second plate-like section 1264 is formed from a material unattracted by the magnet (a material to which the magnet does not adhere); that is, a non-magnetic substance.

The second plate-like section 1264 is made larger than the opening section 1342*c* and provided so as to cover the opening section 1342*c* from the front.

Like the magnet section 1250, the magnet section 1270 is formed from an electromagnet, and a leading end of the magnet section is formed so as to be placed in the opening section 1342*c* and contact the back side of the second plate-like section 1264. A surface (facing the second plate-like section 1264) of the leading end of the magnet section 1270 works as an attracting surface. One magnet section 1270 is provided for the downstream grip section 1260 and formed in (or approximately) the same size and the same shape as that of the magnet section 1250. The control circuit 90 activates the magnet section 1270, whereupon the first plate-like section 1262*a* of any one of the first plate-like section units 1262-1 to 1262-9 corresponding to the position of the magnet section 1270 is attracted by the magnetic force. Spacing between the first plate-like section 1262*a* and the second plate-like section 1264 is thus closed. The magnet section 1270 is attached to a lower end of a front surface of the plate-like section 1360*e* in the supporting section 1360 in a direction perpendicular to a back side of the plate section 1341, thereby being secured in the direction of the arm 1312.

The magnet section 1250 and the magnet section 1270 are placed at the same position with reference to the horizontal direction. When the magnet section 1250 and the magnet section 1270 are activated, the magnet sections grip the same needle thread. For instance, in the example shown in FIG. 2, FIG. 3, FIG. 5, and FIG. 7, the magnet section 1250 is situated at the back side of the first plate-like section of the first plate-like section unit 1242-8, and the magnet section 1270 is situated at the back side of the first plate-like section of the first plate-like section unit 1262-8. Therefore, the magnet sections 1250 and 1270 grip the same thread.

When the respective first plate-like sections 1262*a* of the first plate-like section units 1262-1 to 1262-9 are viewed from the front, the guide members (second guide members) 1272 are provided above the respective first plate-like section units 1262-1 to 1262-9, and the guide members (second guide members) 1274 are provided below the respective first plate-like section units 1262-1 to 1262-9. As shown in FIG. 4, the guide members 1272 and 1274 are arranged in such a way that the needle thread J diagonally passes at the back side of each of the first plate-like sections. Each of the guide members 1272 is provided at an upper left point above each of the first plate-like sections when viewed from the front. Each of the guide members 1274 is provided at a lower right point below each of the first plate-like sections when viewed from the front. A longer path can be assured for the needle thread J that is at the back side of each of the first plate-like sections, so that the needle thread J can be caught between the first plate-like sections and the second plate-like section 1264 in a more reliable manner.

The turning section 1280 is placed at an intermediate position between the upstream grip section 1240 and the downstream grip section 1260 along the vertical direction. More specifically, the turning section 1280 is disposed at a downstream position in the direction in which the upstream grip section 1240 feeds a needle thread and an upstream position in the direction in which the downstream grip section 1260 feeds a needle thread. The turning section 1280 is for turning the needle thread between the grip section main body 1241 and the grip section main body 1261 (or an area (a position) of the needle thread located between the grip section main body 1241 and the grip section main body 1261).

The turning section 1280 has a turning arm 1281, a needle thread motor 1286 for turning the turning arm 1281, and an encoder 1287 connected to the needle thread motor 1286. The turning section 1280 has the turning arm 1281 and a needle thread motor 1286 for rotating the turning arm 1281. As shown in FIG. 3, FIG. 5, FIG. 6, and FIG. 7, the turning arm 1281 has a rod-shaped main body section 1282 and a hook section 1284 provided at one leading end of the main body section 1282. An output shaft 1286*a* of the needle thread motor 1286 is fastened to the other leading end of the main body section 1282. Specifically, when viewed sideways, the output shaft is arranged in such a way that the center axis of the output shaft 1286*a* of the needle thread motor 1286 passes through the center axis of the main body section 1282. The hook section 1284 assumes a (or approximately) circular-arc rod shape and is arranged so as to enable the hook section 1284 to hook the needle thread J as a result of turning of the turning arm 1281. Specifically, the hook section 1284 is structured so as to be able to contact and retain the needle thread J laid in parallel to the axis line of the output shaft 1286*a* of the needle thread motor 1286 as a result of the turning arm 1281 being upwardly turned around the output shaft 1286*a* (more specifically, an axis line (a rotating center) of the output shaft 1826*a*) of the needle thread motor 1286. The turning arm 1281 is interposed between the magnet section 1250 and the magnet section 1270 and at the same position where the magnet sections 1250 and 1270 are placed with reference to the horizontal direction; and can retain a selected needle thread.

The needle thread motor 1286 is secured to L-shaped hardware 1360*f*, thereby being secured in the direction of the arm 1312. When the needle thread motor 1286 rotates, the turning arm 1281 is turned upward from the receded position (a position 1281(B) shown in FIG. 6 and FIG. 7) that is obliquely downward on the front, to thus project to the front from the opening section 1342*b* of the plate section 1341. A direction of the output shaft 1286*a* of the needle thread motor 1286 (a direction of an axis line of the output shaft 1286*a*) lies in a horizontal direction (namely, a direction parallel with the back surface of the plate section 1341 and along the horizontal direction). The needle thread motor is configured in such a way that, when the turning arm 1281 is situated at the receded position, the turning arm 1281 will not contact the plate section 1341 or any member provided on the plate section 1341 (e.g., the needle thread supporting member 1288, the guide member 1346*b*, or the like) even if the needle bar case 1314 slides in the horizontal direction. Specifically, the receded position is a position where the turning arm 1281 will not contact the needle bar case 1314 (in particular, the plate section 1341 and any member provided on the plate section 1341) even if the needle bar case 1314 slides in the horizontal direction; at least, a position achieved as a result of the turning arm 281 having turned lower than a position where the turning arm 1281 contacts the needle thread supported by the needle thread supporting member 1288 and also a position where the leading end of the turning arm 1281 will not reach the opening section 1342*b*.

The needle thread supporting members 1288 are placed on both sides of each of the opening sections 1342*b* of the plate section 1341 so as to front on both interior sides of the opening section. Specifically, each of the needle thread supporting members 1288 is made by folding back a wire into a circular-arc shape. The pair of needle thread supporting members 1288 assume the same structure.

Each of the needle thread supporting members 1288 includes a base end section 1288*a*; a circular-arc member 1288*b* formed so as to extend continually from a lower end of the base end section 1288*a*; a connecting member 1288*c* formed so as to extend continually from an end of the circular-arc member 1288*b* that is on its other side with respect to the base end section 1288*a*; and a circular-arc member 1288*d* formed so as to extend continually from an end of the connecting member 1288*c* that is on its other side with respect to the circular-arc member 1288*b*. The needle thread supporting member 1288 is formed integrally from a wire.

The base end section 1288*a* is formed into a vertically-oriented straight line. An upper end of the base end section 1288*a* is attached to a position above the opening section 1342*b* on the back side of the plate section 1341. The circular-arc member 1288*b* is formed (or approximately) concentrically with the rotating center of the needle thread motor 1286 so as to face the opening section 1342*b*. The circular-arc member 1288*b* except its portion is provided in the opening section 1342*b*. The connecting member 1288*c* is formed into an approximately circular-arc shape. A front-side end of the connecting member 1288*c* projects to the front side with reference to the front surface of the plate section 1341. A remaining portion of the connecting member 1288*c* is provided in the opening section 1342*b*. The circular-arc member 1288*d* is formed on a side of the circular-arc member 1288*b* that is on its other side with respect to the axis line (an axis line passing through the rotating center) of the output shaft of the needle thread motor 1286, approximately in parallel with the circular-arc member 1288*b*, and (approximately) concentrically with the rotating center of the needle thread motor 1286. An upper end of the circular-arc member 1288*d* is curved to the front. The circular-arc section 1288*d* projects to the front with reference to the front surface of the plate section 1341. When viewed sideways, the circular-arc member 1288*b* and the circular-arc member 1288*d* are formed concentrically with the rotating center of the needle thread motor 1286. In one of the needle thread supporting members 1288, the circular-arc member 1288*b* and the circular-arc member 1288*d* are formed along a plane perpendicular to an axis line of the output shaft of the needle thread motor 1286 (i.e., an axis line passing through the rotating center) while spaced apart from each other in a direction perpendicular to the axis line of the output shaft. In one needle thread supporting member 1288, the circular-arc member 1288*b* and the circular-arc member

1288*d* are formed at the same position with reference to the horizontal direction. Further, the pair of needle thread supporting members 1288 provided for one needle thread are provided while spaced apart from each other in the horizontal direction. The connecting member 1288*c* connects a lower end of the circular-arc member 1288*b* and *a* lower end of the circular-arc member 1288*d*.

A needle thread is inserted into spacing between the circular-arc member 1288*b* and the circular-arc member 1288*d* from above the pair of needle thread supporting members 1288, to thus be positioned between the pair of connecting members 1288*c*. The needle thread J can thereby be placed between the pair of connecting members 1288*c* with respect to the horizontal direction. Even when the turning arm 1281 upwardly draws the needle thread J, the needle thread J stays at the spacing between the circular-arc member 1288*b* and the circular-arc member 1288*d*. Namely, the needle thread supporting members 1288 support the needle thread at the position of the opening section 1342*b* [namely, the position of the opening section 1342*b* in both the vertical and horizontal directions (specifically, a position beneath the opening section 1342*b*)] in the horizontal direction; more specifically, toward the front side of the opening section 1342*b* (or "a position on the front side of the opening section 1342*b*") in the horizontal direction when viewed from the front. The needle thread supporting members 1288 can also support the needle thread within the opening section 1342*b* with respect to the horizontal direction (namely, a position between the front surface and back surface of the plate section 1341 with respect to the front-back direction).

The rod-shaped guide member (a first needle thread path inverting member) 1290 for guiding the needle thread J fed from above (in other words; from the upstream grip section 1240) to the needle thread supporting member 1288 is secured to a position in the vicinity of a lower side of each of the opening sections 1342*b* and on the front side of the plate section 1341. The guide member 1290 inverts the needle thread guided from above and subsequently leads the needle thread to the needle thread supporting member 1288.

The supporting section 1360 is mounted on the upper surface section 1312*a* of the arm 1312. The supporting section 1360 includes L-shaped hardware 1360*a* mounted on the arm 1312; L-shaped hardware 1360*b* secured to the L-shaped hardware 1360*a*; a rod-shaped plate section 1360*c* secured to the L-shaped hardware 1360*b*; L-shaped hardware 1360*d* secured to the rod-shaped plate section 1360*c*; the plate-like section 1360*e* secured to the L-shaped hardware 1360*d*; and the L-shaped hardware 1360*f* secured to the front surface of the plate-like section 1360*e*.

The plate-like section 1360*e* is provided in (or approximately) parallel with the plate section 1341. One plate-like section 1360*f*-1 of the L-shaped hardware 1360*f* is secured to the plate-like section 1360*e*, whilst another plate-like section 1360*f*-2 standing upright on the plate-like section 1360*f*-1 is provided at right angles to the plate-like section 1360*e*. The plate-like section 1360*f*-2 thereby becomes perpendicular to the plate section 1341. One plate-like section 1360*d*-1 of the L-shaped hardware 1360*d* is secured to the plate-like section 1360*e*. A remaining plate-like section 1360*d*-2 standing on the plate-like section 1360*d*-1 is provided at right angles to the plate section 1341.

There can also be adopted another configuration in which the supporting section 1360 is taken as a portion of constituent elements of the arm 1312; in which the arm 1312 is taken as an arm main body; and in which the arm has an arm main body and the supporting section 1360.

The sewing frame 12*d* is a member for holding the processed fabric in a stretched manner and placed above (or on an upper surface of) the sewing machine table.

The main spindle 22 is rotated by the main spindle motor 20, and rotating force is transmitted by a predetermined power transmission mechanism, thereby actuating respective machine elements, such as the thread take-up levers 12*a*-1 to 12*a*-9, the needle bars 12*b*-1 to 12*b*-9, and presser feet 12*c*, and the shuttle 100. The main spindle motor 20 is configured so as to rotate in one direction. In the case of a multi-head embroidery sewing machine having a plurality of heads, a main spindle common to the respective heads is provided, and the main spindle motor for rotating the main spindle is provided.

The main spindle 22 rotates by rotation of the main spindle motor 20, and the thread take-up lever and the needle bar are thereby actuated. Further, a middle shuttle 150 is rotated by rotation of a shuttle actuation motor 252, thereby embellishing process fabric with embroidery that conforms to embroidery data.

The frame actuator 24 is for actuating the sewing frame 12*d* in both the X-axis direction (direction X1-X2) and the Y-axis direction (direction Y1-Y2) in accordance with a command from the control circuit, and actuates the sewing frame 12*d* in synchronism with vertical movements of the needle bar 12*b*-1 to 12*b*-9. Specifically, the frame actuator 24 is made up of a servo motor for actuating the sewing frame 12*d* in the X-axis direction, a servo motor for actuating the sewing frame 12*d* in the Y-axis direction, and others.

The control circuit 90 is a circuit that controls operation of the main spindle motor 20, operation of the needle thread motor 1286, operation of the magnet section 1250, operation of the magnet section 1270, operation of a bobbin thread motor 202 (this may also be embodied as a bobbin thread tension control motor), and operation of the shuttle actuation motor 252, and controls operation of the individual sections according to the data stored in the memory device 92. Specifically, the control circuit 90 generates main spindle data (see FIG. 21) according to embroidery data read from the memory device 92 and controls operation of the main spindle motor 20 according to the thus-generated main spindle data.

Within the needle thread torque control zone, the control circuit 90 subjects the needle thread motor 1286 to torque control according to the needle thread control torque data that are input from the input-output device 94 and stored in the memory device 92. In a position control zone, the control circuit 90 generates angle correspondence data, such as that shown in FIG. 28, and subjects the needle thread motor 1286 to position control in accordance with the angle correspondence data.

In a zone ranging from the end point of the position control zone to the end point of the torque control zone, the control circuit 90 controls the magnet sections 1250 and 1270 so as to close the upstream grip section 1240 and open the downstream grip section 1260. In the meantime, in a zone ranging from the end point of the torque control zone to the end point of the position control zone, the control circuit 90 controls the magnet sections 1250 and 1270 so as to open the upstream grip section 1240 and close the downstream grip section 1260.

The control circuit 90 controls the shuttle actuation motor 252 according to the generated main spindle data and the shuttle actuation data (refer to FIG. 20). In the bobbin thread torque control zone (the torque control zone is prescribed by zone position data shown in FIG. 19), the control circuit 90 subjects the bobbin thread motor 202 to torque control according to the bobbin thread control torque data that are input from the input-output device 94 and stored in the memory device 92.

Figure 15:
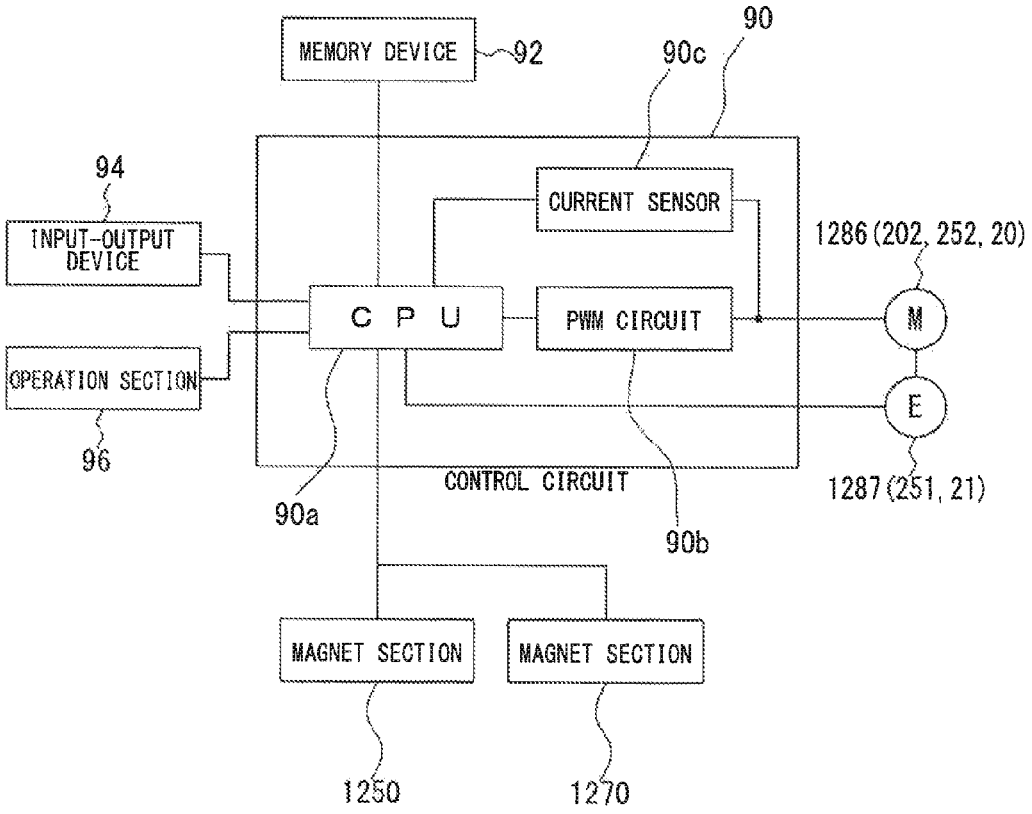
[FIG. 15] It is an explanatory view of a principal section of the sewing machine.

Specifically, as shown in FIG. 15, the control circuit 90 has a CPU 90*a*, a PWM (Pulse Width Modulation) circuit 90*b*, and a current sensor 90*c*. In accordance with data from the memory device 92, the CPU 90*a* outputs to the PWM circuit 90*b* data pertaining to a current value to be fed to the motor. The PWM circuit 90*b* converts an amplitude of the current value output from the CPU 90*a* into a pulse signal having a constant amplitude and feeds the pulse signal to the main spindle motor 20 and the needle thread motor 1286. The current sensor 90*c* converts a pulse signal output from the PWM circuit 90*b* into a current value, multiplies the current value by a constant to calculate a torque value, and outputs the torque value to the CPU 90*a*. The PWM circuit 90*b* and the current sensor 90*c* are provided for each of the main spindle motor 20, the needle thread motor 1286, and the bobbin thread motor 202, to be exact. Each set consisting of the PWM circuit 90*b* and the current sensor 90*c* is connected to a corresponding motor. Specifically, the PWM circuit 90*b* is connected to the CPU 90*a* and the corresponding motor, and the current sensor 90*c* is connected to the CPU 90*a* and *a* junction between the corresponding motor and the corresponding PWM circuit 90*b*.

An encoder 21 for detecting an angle of the main spindle motor 20 (the rotational position of the main spindle motor 20) is interposed between the main spindle motor 20 and the control circuit 90. The encoder 1287 for detecting an angle of the needle thread motor 1286 (a rotational position of the needle thread motor 1286) is interposed between the needle thread motor 1286 and the control circuit 90. An encoder 251 for detecting an angle of the shuttle actuation motor 252 (a rotational position of the shuttle actuation motor 252) is interposed between the shuttle actuation motor 252 and the control circuit 90. The control circuit 90 detects angles of the respective motors (the rotational positions of the respective motors) from information delivered from the respective encoders.

Figure 16:
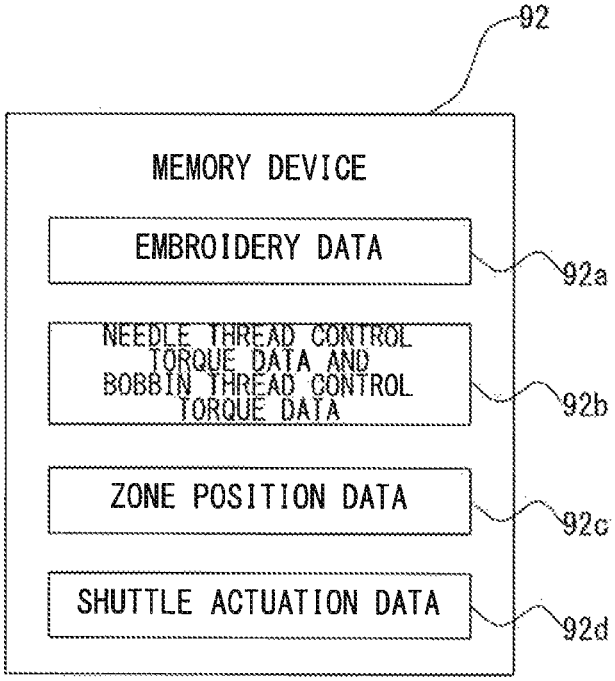
[FIG. 16] It is an explanatory view showing a configuration of a memory device.

As shown in FIG. 16, the memory device 92 stores embroidery data 92*a*, needle thread control torque data and bobbin thread control torque data 92*b*, zone position data (zone data) 92*c*, and shuttle actuation data 92*d*. To be specific, the memory device 92 is a storage section for storing these pieces of data.

As shown in FIG. 17, data pertinent to a stitch width (in other words, a value of a stitch width), a stitching direction (in other words, a value representing a stitching direction), and a thread type are stored for each stitch in relation to the embroidery data 92*a*. The embroidery data 92*a* are input from the outside by way of the input-output device 94 and thereby stored in the memory device 92. The stitching direction referred to herein means data pertinent to an angle value in a predetermined direction (e.g., a single orientation along a horizontal direction). For instance, in an example shown in FIG. 43, when the predetermined direction is taken as HK, an angle value of a stitch ST0 is a value of angle $\alpha 4$, and an angle value of a stitch ST1 is taken as a value of angle $\alpha 1$. The value of the angle $\alpha 1$ is oriented upward with respect to the direction HK and therefore a positive value, and the value of the angle $\alpha 4$ is oriented downward with respect to the direction HK and therefore a negative value. Moreover, in an example shown in FIG. 44(*a*), an angle value of the stitch ST0 is taken as a value of angle $\beta 2$ (a positive value), and an angle value of the stitch ST1 is taken as a value of angle $\beta 1$ (a positive value). In an example shown in FIG. 44 (*b*), an angle value of the stitch ST0 is taken as a value of the angle $\beta 2$ (a negative value), and an angle value of the stitch ST1 is taken as an angle value of the angle $\beta 1$ (a negative value).

As shown in FIG. 18, a needle thread control torque value and a bobbin thread control torque value are stored for each stitch in relation to the needle thread control torque data and the bobbin thread control torque data 92*b*. In this regard, although a needle thread control torque value and a bobbin thread control torque value are stored for each stitch in relation to the needle thread control torque data and the bobbin thread control torque data 92*b*, needle thread control torque data that specify a needle thread control torque value and bobbin thread control torque data that specify a bobbin thread control torque value may also be configured, for each stitch, in a separated manner.

A torque value in the needle thread control torque data determined for each stitch is generated in accordance with a stitch width, a stitching direction, and a thread type of each stitch. For instance, in the case of a large stitch width, tightening of the needle thread must be augmented; therefore, the torque value is increased (the torque value is decreased in the case of a small stitch width). Moreover, when a large angular difference exists between a current stitching direction and a preceding stitching direction, tightening of the needle thread is originally hard, and consequently the torque value is decreased (when a small angular difference exists between the current stitching direction and the preceding stitching direction, the torque value is increased). Furthermore, when a thread has a large thickness, the tightening of the needle thread must be augmented; therefore, the torque value is increased (when the thread has a small thickness, the torque value is decreased). When the needle thread is strongly tightened, the torque value is increased (when the needle thread is weakly tightened, the torque value is decreased). When embroidery is finished tightly, the torque value is increased. As will be described later, the torque value is set to a value at which no hindrance is placed to withdrawal of the needle thread J to be performed by the thread take-up lever. A torque value in the needle thread control torque data determined for each stitch can also be generated in accordance with a stitch width and a stitching direction of each stitch. In an example shown in FIG. 43, an angular difference between a certain stitching direction and a preceding stitching direction is $\alpha 1$-$\alpha 4$.

A torque value in the bobbin thread control torque data determined for each stitch is generated in accordance with a stitch width, a stitching direction, and a thread type of each stitch. For instance, in the case of a large stitch width, tightening of the needle thread must be augmented; therefore, the torque value is increased (the torque value is decreased in the case of a small stitch width). Moreover, when a large angular difference exists between a current stitching direction and a preceding stitching direction, tightening of the needle thread is originally hard, and consequently the torque value is decreased (when a small angular difference exists between the current stitching direction and the preceding stitching direction, the torque value is increased). Furthermore, when a thread has a large thickness, the tightening of the needle thread must be augmented; therefore, the torque value is increased (when the thread has a small thickness, the torque value is decreased). When the bobbin thread is strongly tightened, the torque value is increased (when the bobbin thread is weakly tightened, the torque value is decreased). When embroidery is finished tightly, the torque value is increased. Incidentally, a torque value in the bobbin thread control torque data determined for each stitch can also be generated in accordance with a stitch width and a stitching direction of each stitch.

The needle thread control torque data and the bobbin thread control torque data 92*b* are input from the outside by way of the input-output device 94 and thereby stored in the memory device 92. Specifically, there are stored the needle thread control torque data and the bobbin thread control torque data 92*b* whose specifics correspond to the embroidery data 92*a*.

As shown in FIG. 19, in relation to the zone position data 92*c*, data pertinent to the starting point and the end point of a needle thread torque control zone are stored as information about a main spindle angle (i.e., information about the rotational position of the main spindle motor 20) (a starting point is denoted by reference symbol $Z_1$, and an end point is denoted by reference symbol $Z_2$). Moreover, data pertinent to the starting point and the endpoint of the needle thread position control zone are stored as information about a main spindle angle (i.e., information about the rotational position of the main spindle motor 20) (a starting point is denoted by reference numeral $Z_3$, and an end point is denoted by reference symbol $Z_4$). In addition, data pertinent to the starting point and the end point of a bobbin thread torque control zone are stored as information about a main spindle angle (i.e., information about the rotational position of the main spindle motor 20) (a starting point is denoted by reference symbol $Z_5$, and an end point is denoted by reference symbol $Z_6$).

Figure 36:
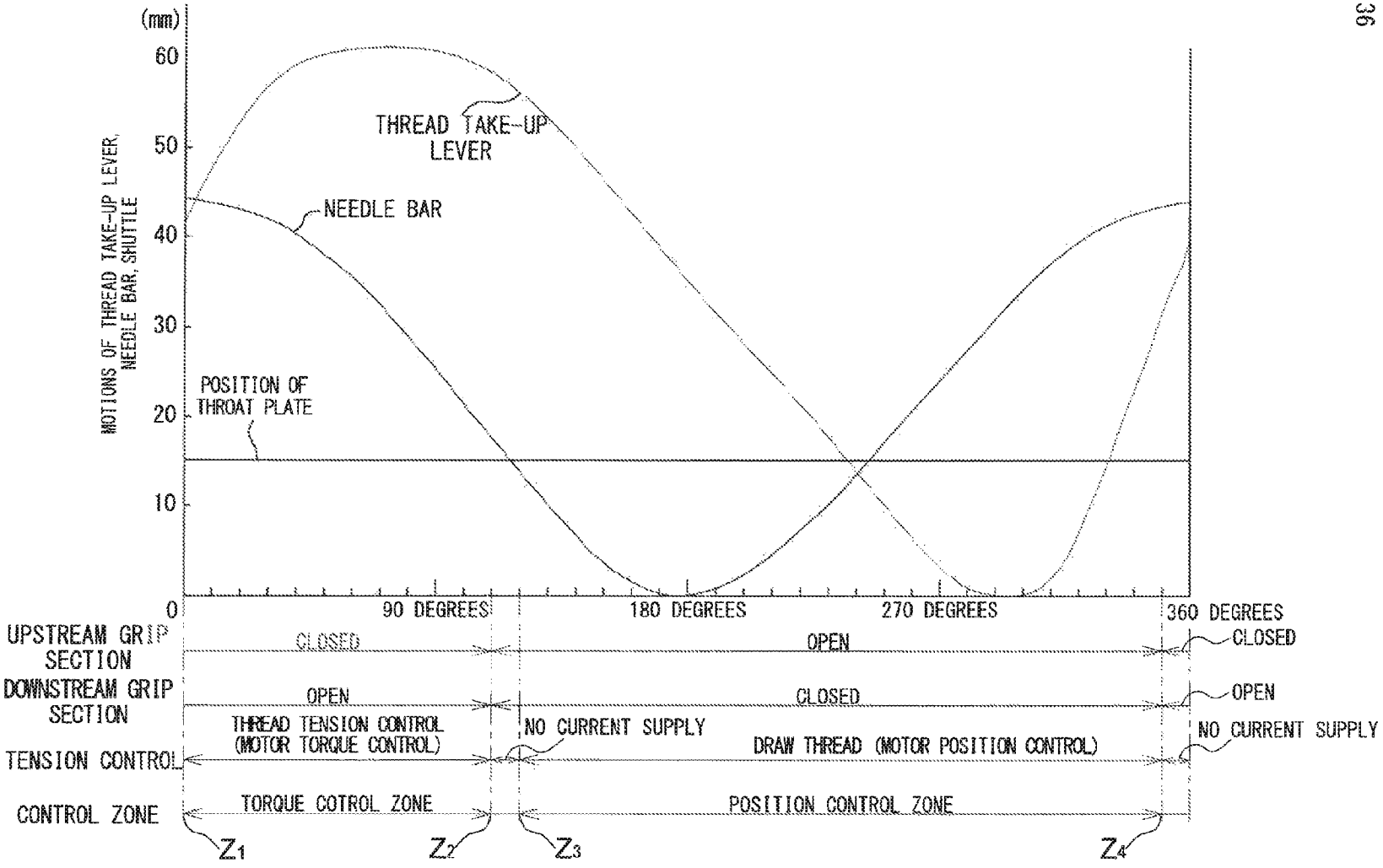
[FIG. 36] It is an explanatory view showing operation of the sewing machine.

As depicted by a motion diagram shown in FIG. 36, the starting point of the needle thread torque control zone is situated behind an endpoint of an immediately preceding position control zone in terms of time. Further, a starting point of a position control zone is situated behind an end point of an immediately preceding torque control zone in terms of time. Torque control and position control of the needle thread are switched after the opening and closing of the grip section main bodies 1241 and 1261 have been reliably switched. For this reason, a predetermined period of time exists between the end point of the torque control zone and the starting point of the position control zone. Further, a predetermined period of time also exists between the end point of the position control zone and the starting point of the torque control zone. These predetermined periods of time are ones for switching the opening and closing of the grip section main bodies 1241 and 1261.

The starting point of the needle thread torque control zone is at any arbitrary position in an area from the bottom dead center (one dead center) to the top dead center (the other dead center) within a turning range of the thread take-up lever (an area in which the thread take-up lever shifts from its bottom dead center to its top dead center) in association with rotation of the main spindle 22. The top dead center of the thread take-up lever (the other dead center) can be said to be an end of the turning range of the thread take-up lever in the direction where the needle thread is pulled from the processed fabric.

The end point in the needle thread torque control zone is any arbitrary position in an area from the top dead center to any position on the way from the top dead center to the bottom dead center of the thread take-up lever and also a position achieved before the sewing needle 12*ba* is inserted into the processed fabric (e.g., a position where a leading end of the sewing needle 12*ba* comes to an elevated position above a throat plate 5). In other words, in order to avoid as much as possible exertion of tension on the needle thread in the middle of sewing the processed fabric, a period during which the needle is being inserted into the processed fabric should not be taken as the torque control zone. Therefore, the end point of the torque control zone can also be the position of the top dead center of the thread take-up lever. Further, the top dead center of the shuttle is not taken as the torque control zone so that the shuttle can be smoothly inserted into the needle thread. Therefore, the end point of the torque control zone comes ahead of the top dead center of the shuttle.

In the needle thread torque control zone, tension is imparted to the needle thread J by means of pulling the needle thread J in a direction opposite to a direction of pull-up of the thread take-up lever 12*a* while the thread take-up lever 12*a* is pulling up the needle thread J. For these reasons, at least a portion of the torque control zone is set in a period during which the thread take-up lever is in the middle of ascending action (a period during which the needle thread is pulled with respect to the processed fabric). Specifically, the torque control zone can be said to be a zone including at least a portion of the area from the bottom dead center to the top dead center of the thread take-up lever. If torque control is performed even after the sewing needle 12*ba* has been inserted, tension will be exerted on the needle thread that is in the middle of sewing operation. For these reasons, the end point of the torque control zone is set to a position achieved before the sewing needle 12*ba* is inserted into the processed fabric.

The starting point of the needle thread position control zone is any arbitrary position in an area from the top dead center to the bottom dead center of the thread take-up lever (i.e., an area where a transition from the top dead center to the bottom dead center of the thread take-up lever takes place). It does not matter whether the starting point is a position achieved before the sewing needle 12*ba* is inserted into the processed fabric (i.e., a point at which the leading end of the sewing needle 12*ba* comes to an elevated position above the throat plate 5) or a position achieved after the sewing needle 12*ba* is inserted into the processed fabric (e.g., a point at which the leading end of the sewing needle 12*ba* becomes lower than the throat plate 5). In order to cause the shuttle to be inserted into the needle thread smoothly, the starting point of the position control zone is set ahead of the top dead center of the shuttle, and the top dead center of the shuttle is placed at any point in the position control zone.

The end point of the needle thread position control zone is at any position in the area from the bottom dead center to the top dead center of the thread take-up lever (i.e., the area where a transition from the bottom dead center to the top dead center of the thread take-up lever takes place). Since the end point is immediately followed by the torque control zone, the end point of the position control zone should preferably be at a position where the sewing needle 12*ba* has already gone out of the processed fabric (e.g., a position where the leading end of the sewing needle 12*ba* comes to an elevated position above the steel plate 13).

Figure 46:
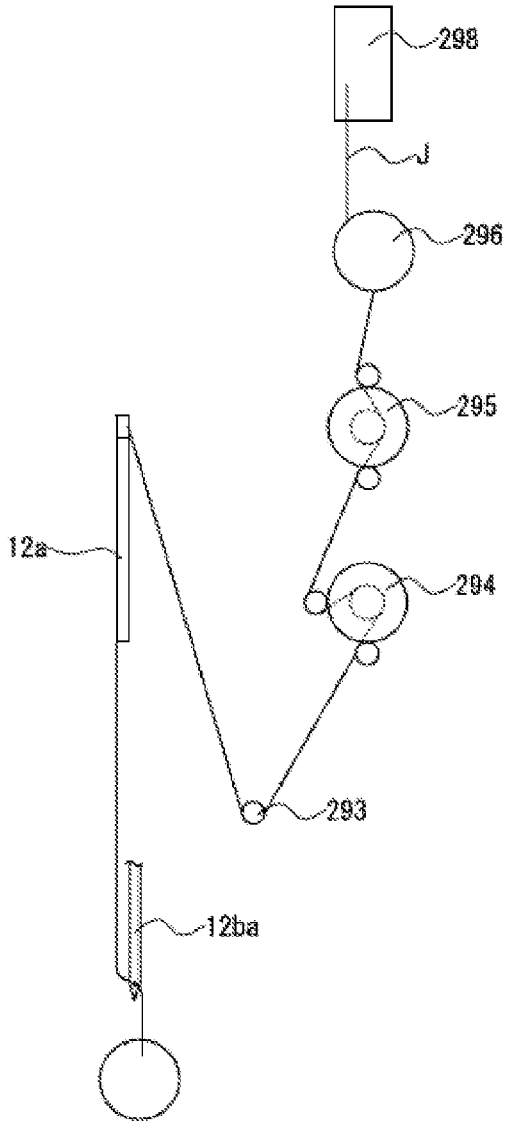
[FIG. 46] It is an explanatory view showing a related-art sewing machine.

In the position control zone the needle thread J is drawn from the thread roll (a thread roll analogous to the thread roll 298 (FIG. 46) in terms of a configuration) (the thread roll is disposed at an upstream position with respect to the needle thread guide 1300). However, in order to minimize the possibility of occurrence of a break in the needle thread by slowly drawing the needle thread while taking as long a time as possible, it is preferable to assure the longest possible position control zone. For instance, a long position control zone can be assured by means of setting the starting point of the position control zone at any arbitrary point ahead of the top dead center of the shuttle within the area from the top dead center to the bottom dead center of the thread take-up lever and setting the end point of the position control zone to any arbitrary point in the area from the bottom dead center to the top dead center of the thread take-up lever. Moreover, the area from the bottom dead center to the top dead center of the thread take-up lever corresponds to an area where the thread take-up lever pulls the needle thread against the processed fabric. Hence, it is preferable that the area be taken as the torque control zone. Consequently, it can preferably be said that the starting point of the torque control zone is taken as a period in the area from the bottom dead center to the top dead center of the thread take-up lever; namely, a period from the instant immediately following release of the sewing needle 12*ba* from an inserted state before the top dead center of the thread take-up lever (or the instant following arrival of the top dead center).

The starting point of the bobbin thread torque control zone is set to any arbitrary position within an area from a point at which the sewing needle is withdrawn from the process fabric to the top dead center, and the end point of the bobbin thread torque control zone is set to any arbitrary position within an area from a position ahead of the top dead center of the thread take-up lever to a point at which the sewing needle runs into the process fabric. For instance, an area from a point where the sewing needle has passed through the process fabric to a position where the thread take-up lever has passed its top dead center is taken as a torque control zone T (see a motion diagram shown in FIG. 37). To be specific, the torque control zone T is set to an area from a middle point between the bottom dead center and the top dead center of the thread take-up lever to the top dead center of the thread take-up lever; at least, at least a portion of an area from the bottom dead center to the top dead center of the thread take-up lever. In other words, in a period from when the sewing needle goes out of the process fabric until when the thread take-up lever is elevated, the thread take-up lever pulls the needle thread up, thereby tightening a knot between the needle thread and the bobbin thread. Accordingly, the bobbin thread motor 202 is subjected to torque control in that period, whereby a degree of tightening of the knot can be controlled; namely, a degree of tightening of the needle thread to the bobbin thread, can be controlled. Specifically, embroidery can be finished more tightly by increasing the torque value of torque control to which the bobbin thread motor 202 is subjected in the period. In the meantime, embroidery can be finished more softly by decreasing the torque value of torque control to which the bobbin thread motor 202 is subjected in the period.

Figure 37:
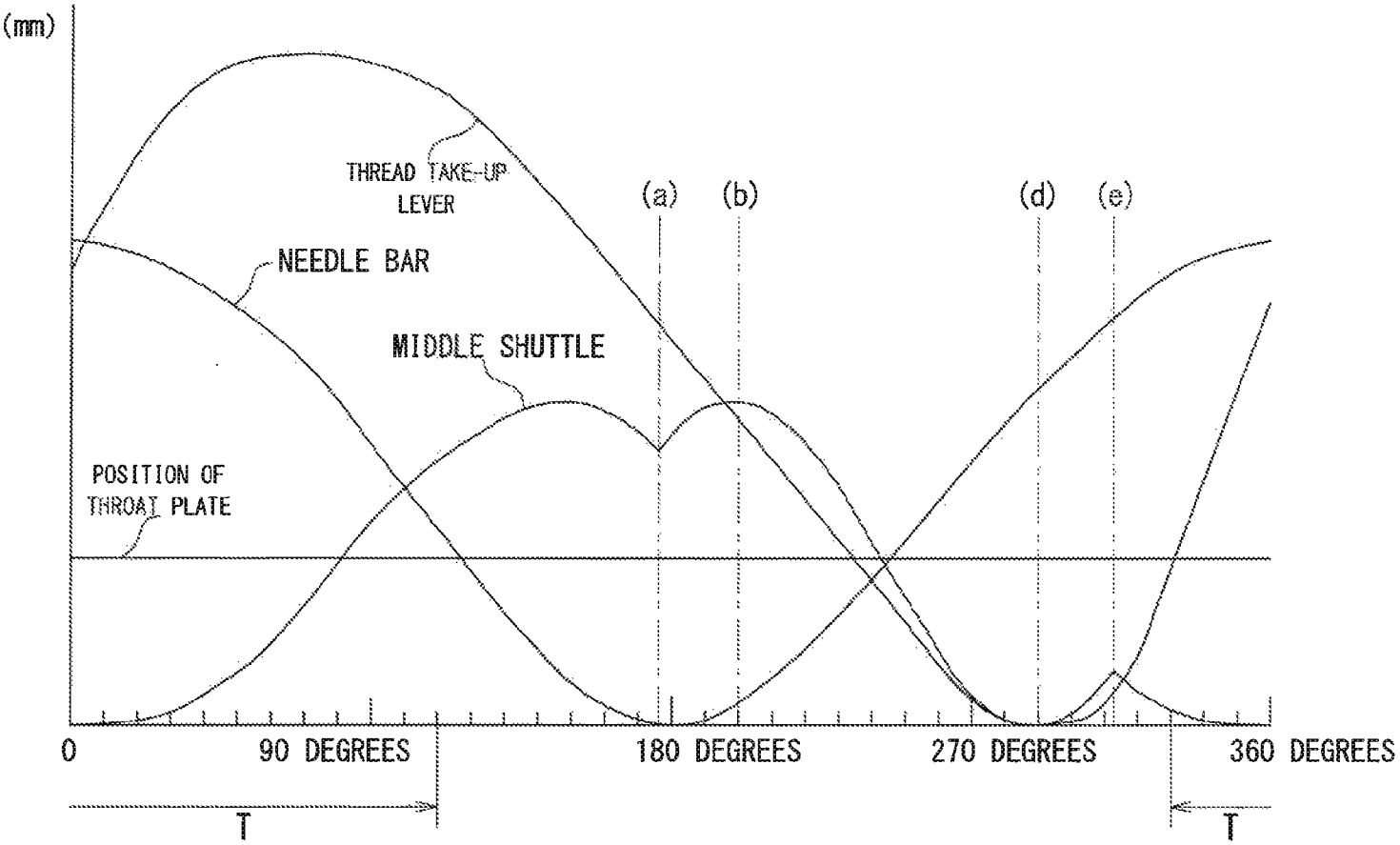
[FIG. 37] It is an explanatory view showing operation of the sewing machine.

A waveform of the thread take-up lever and a waveform of the needle bar plotted in the motion diagram of FIG. 37 are tantamount to a waveform of the thread take-up lever and a waveform of the needle bar plotted in a motion diagram of FIG. 36.

Although the zone position data 92*c* are previously stored in the memory device 92 by way of the input-output device 94, the input-output device 94 can switch specifics of the zone position data 92*c* stored in the memory device 92 as necessary. In this respect, data pertinent to the starting point and the end point of the torque control zone and data pertinent to the starting point and the end point of the position control zone are specified as information about angles of the main spindle; therefore, the term "zone" is used. However, the main spindle motor 20 and the main spindle 22 make rotations in only one direction. In a control zone of one stitch, the greater the main spindle angle, the later it becomes in terms of time. For this reason, a term "period" can also be used in place of the "zone." For instance, a "torque control period" can also be employed in lieu of the "torque control zone"; a "position control period" can be employed in lieu of the "position control zone"; and a "control period" can also be used in lieu of the "control zone."

As shown in FIG. 20, the shuttle actuation data 92*d* are data (angle correspondence data) that specify correspondence between a main spindle angle and an angle of the middle shuttle (a middle shuttle angle). In this regard, the angle of the middle shuttle designates a rotational position of the bobbin thread motor 202. The shuttle actuation data 92*d* are previously stored in the memory device 92 by way of the input-output device 94.

An explanation is now given to the path of the needle threads J. Nine needle threads run along similar paths. Therefore, the needle thread situated at the right end when viewed from the front is taken as an example. The needle thread J guided from a thread roll (not shown) contacts the guide member 1252 by way of the needle thread guide 1300; passes through spacing between the first plate-like section 1242*a* of the first plate-like section unit 1242-9 and the second plate-like section 1244 of the upstream grip section 1240, then contacts the guide member 1254, undergoes inversion on the guide member 1290, and subsequently reaches the needle thread supporting member 1288. The needle thread J passed through the pair of needle thread supporting members 1288 contacts the guide member 1272, passes through spacing between the first plate-like section 1262*a* of the first plate-like section unit 1262-9 and the second plate-like section 1264 of the downstream grip section 1260, then contacts the guide member 1274. In addition, the needle thread J reaches the thread take-up lever 12*a*-9 by way of the needle thread guide 1302 and the tension spring 1337 and further reaches a sewing needle of the needle bar 12*b*-9 from the thread take-up lever 12*a*-9 by way of the needle thread guide 1338. The needle thread travels from the upstream side to the downstream side along the sequence mentioned above.

The input-output device 94 is one which is connected to the CPU 90*a* of the control circuit 90; which primarily exchanges data with the memory device 92; and which has a connector terminal for connection with an external terminal and a connector terminal for connection with a storage medium. Specifically, the input-output device 94 exhibits functions as an input device and an output device. The embroidery data 92*a* and the needle thread control torque data and the bobbin thread control torque data 92*b* are stored in the memory device 92 by way of the input-output device 94.

In this respect, a storage medium that stores the data can also be used while connected to the input-output device 94 in lieu of the memory device 92 rather than the memory device 92 storing the embroidery data 92*a* and the needle thread control torque data and the bobbin thread control torque data 92*b*. In short, the data are read directly from the storage medium. To be specific, in this case, the storage medium functions as a "storage section for storing needle thread control torque data for which a needle thread control torque value is stored for each stitch in the embroidery data and bobbin thread control torque data for which a bobbin thread control torque value is stored for each stitch in the embroidery data."

The operation section 96 is an operation device for operation of the sewing machine 1205 and made up of operation keys, a display screen, and others.

The shuttle 100 is disposed, for each head, at each of positions below the respective heads 1207 and below the upper surface of the sewing machine table 3. Specifically, the shuttles 100 are supported by respective shuttle bases 7 positioned below the sewing machine table 3. In the present embodiment, each of the shuttle bases 7 includes side surfaces 7*b* and 7*c* attached to a lower surface of the table body 4 and a bottom surface 7*a* interposed between a lower end of the side surface 7*b* and *a* lower end of the side surface 7*c*.

As shown in FIGS. 9 through 13, the shuttle 100 has an outer shuttle 110, a middle shuttle presser (a shuttle body presser)130, and a middle shuttle (a shuttle body) 150.

The outer shuttle 110, which is a substantially-ring-shaped member having an open upper portion, includes an outer middle shuttle 112 and mounts 116 projecting from respective sides of the outer middle shuttle 112.

A substantially columnar cutout 114 is formed in the outer middle shuttle 112, and a transverse sectional view of the cutout 114 assumes a circular shape whose upper end is horizontally cut. The cutout 114 makes up a circular-arc inner peripheral surface. A step is formed in the cutout 114 in the form of a circumference, and a part of the cutout facing the middle shuttle presser 130 is formed so as to assume a diameter that is greater than a diameter of a remaining side of the cutout opposite to the step. The cutout 114 includes a large diameter portion (a guide groove) 114*a* facing the middle shuttle presser 130 (i.e., a front side or Y1 side) and a small diameter portion 114*b* that is the opposite of the large diameter portion. The large diameter portion 114*a* is, in a word, provided on the front side; namely, one side of the outer shuttle 110 along an axial direction (a direction Y1-Y2) (a direction of an axis line that is equidistant from the inner periphery and that is at right angles to a radial direction of the inner periphery) of the inner periphery of the outer shuttle 110.

Levers 122 used for fastening the middle shuttle presser 130 to the outer shuttle 110 are attached to both sides of the outer shuttle 110. Further, the mounts 116 used for attaching the outer shuttle 110 to the shuttle base 7 are also projectingly formed on both sides of the outer shuttle 110. Specifically, a support hole 118 used for axially supporting the corresponding lever 122 in a turnable fashion is opened in each of the mounts 116. Further, formed outside the support hole 118 is a hole 120 for insertion of a screw 124 used for fastening the outer shuttle 110 to the shuttle base 7.

The middle shuttle presser 130 is a substantially ring shaped plate member whose upper portion is opened, and a substantially columnar cutout 132 is formed in the middle shuttle presser 130. When viewed from the front, the cutout 132 assumes a shape determined by horizontally cutting an upper end of a circle. An inner diameter of the cutout 132 formed in the middle shuttle presser 130 is made smaller than the outside diameter of the race 152 of the middle shuttle 150 and substantially equal to the inner diameter of the small diameter portion 114*b* of the outer shuttle 110. In the middle shuttle 150 placed in the outer shuttle 110, a part of the middle shuttle 150 facing the middle shuttle presser 130 is thereby covered, so that the middle shuttle 150 will not fall off toward the middle shuttle presser 130.

The middle shuttle presser 130 is brought into contact with a part of the outer shuttle 110 opposite to its part facing the bobbin thread motor 202. The levers 122 are latched onto the middle shuttle presser 130. The outer shuttle 110 and the middle shuttle presser 130 are thereby integrated.

The middle shuttle 150 is placed in a rotatable manner within the outer shuttle 110 to which the middle shuttle presser 130 is attached. The middle shuttle 150 includes the race 152, a main middle shuttle 160, a leading end 170, a bobbin accommodation section 180, and a magnet (a third magnet) 190. A main body configuration section is built from a configuration except the magnet section 190 in the middle shuttle 150; namely, the race 152, the main middle shuttle 160, the leading end 170, and the bobbin accommodation section 180.

The race 152 assumes a shape of a substantially circular-arc plate; namely, a shape defined by forming a circular-arc shape from a rod-shaped plate-like member. An exterior surface of the race 152 is formed so as to be slidable along the large diameter portion 114*a* of the outer shuttle 110.

The entirety of the main middle shuttle 160 is formed from a plate-like member. The main middle shuttle has a rear portion 161 and a front-side tapered portion 166. The rear portion 161 is provided so as to be continual rearwardly from an inner rear-side end of the race 152. The front-side tapered portion 166 is provided so as to be continual forwardly from an inner front-side end of the race 152.

The rear portion 161 has a rear-side body 162 assuming a circular plate-like shape and a rear-side tapered portion 164. The rear-side tapered portion 164 is provided so as to be continual from the inner rear-side end of the race 152 as well as from an edge of the rear-side body 162.

Specifically, the rear-side body 162, which has an outer diameter that is smaller than the inner diameter of the race 152, forms a plane that is at right angles with respect to a an axis line (an axis line passing through the rotating center) of the middle shuttle 150. The rear-side body 162 is situated rearwardly with reference to the rear-side end of the race 152.

The rear-side tapered portion 164 is formed like a substantially tapered plate and between the rear-side inner end of the race 152 and the edge of the rear-side body 162. The rear-side tapered portion 164 also assumes a shape defined by cutting away a portion of a cone (strictly speaking, a side portion of a cone) formed between the rear-side inner end of the race 152 and the edge of the rear-side body 162. Specifically, the rear-side tapered portion 164 is made up of a first region 164*a* and a second region 164*b*. The first region 164*a* corresponds to an area that, when viewed from the front, extends from a lower end position P to a position Q which is situated in a left circumferential direction with reference to a position of a thread guard 174 (the position Q substantially matches a position of a base end of a cutout 192 situated between a pointed portion 176 of the leading end 170 and the front-side tapered portion 166, in a circumferential direction). The second region 164*b* is an area of the rear-side tapered portion except the first region 164*a*. The first region 164*a* is formed so as to extend from a peripheral end of the rear-side body 162 to the inner end of the race 152. When viewed from the front, a width of the first region is made so as to assume a with respect to a direction of a straight line running through a center of the rear-side body 162. The second region 164*b* is formed so as to become narrower in width than the first region 164*a*. When viewed from the front, the width of the second region is made so as to assume $\beta$ with respect to the direction of the straight line running through the center of the rear-side body 162, so that a relationship of $\alpha>\beta$ stands. The width $\beta$ is determined as a width that does not pose any hindrance when the needle thread put on the thread guard 174 departs from the thread guard 174, to thus be pulled upward, and that allows mounting of the magnet section 190. The width $\beta$ is determined to be about one-half of the width $\alpha$ or less. However, the width $\beta$ makes up the following geometry. Namely, the width $\beta$ remains substantially constant in a region from the position P to a position S that is situated between a position attained through a 90-degree counterclockwise turn from the position P when viewed from the front and a position attained through a 180-degree counterclockwise turn from the position P. Further, the width $\beta$ becomes gradually smaller counterclockwise from the position S to an end of the first region 164*a* spaced counterclockwise from the position S when viewed from the front. In the embodiment shown in FIG. 13, an angle that the position P forms with the position Q when viewed from the front ranges from 140 to 150 degrees, and an angle that the position P forms with the position S ranges from 120 to 130 degrees. Substantially elliptical apertures K are opened in several positions on the rear-side tapered portion 164.

Figure 13:
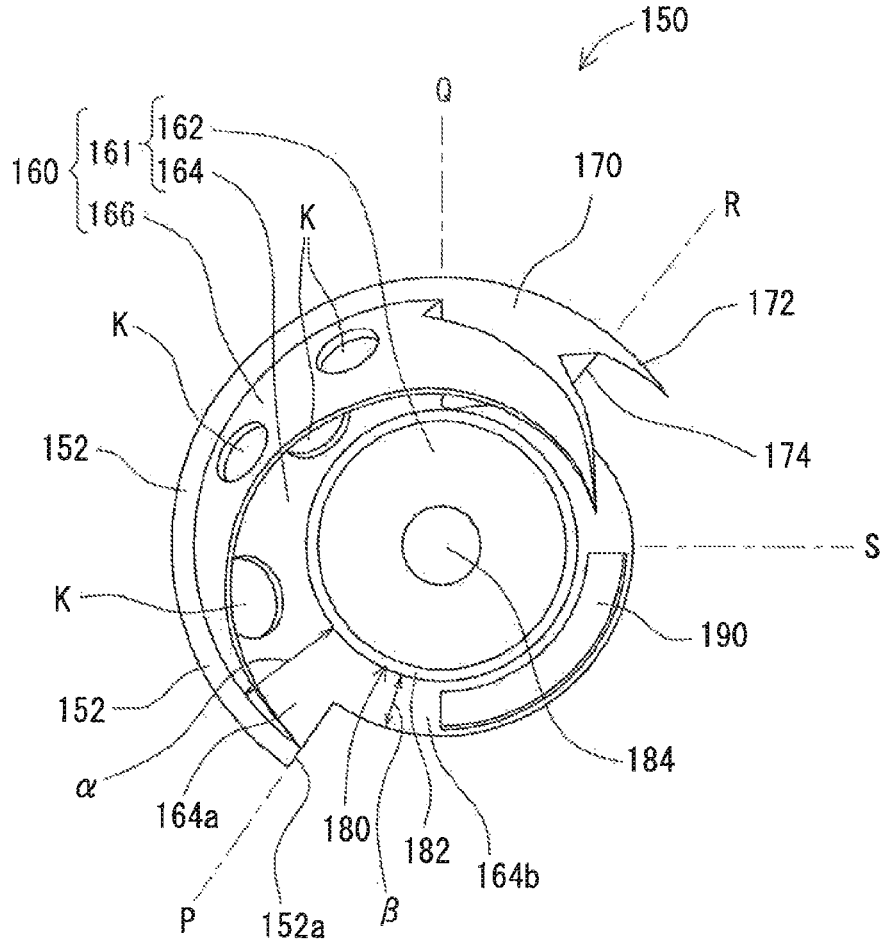
[FIG. 13] It is a front view of a middle shuttle.

The front-side tapered portion 166 is formed from the inner front-side end of the race 152 toward the front side and is formed into a plate that extends, while being sloped toward the inside (i.e., toward the center of rotation). Specifically, the front-side tapered portion 166 is formed from a portion of a conical shape that is a symmetrical image of a conical shape made by the rear-side tapered portion 164. When viewed from the front, the front-side tapered portion 166 is formed so as to become narrower in the clockwise direction from the position Q. Even in the counterclockwise direction, the front-side tapered portion 166 is formed so as to become narrower toward a tail end 152*a* of the race 152 from the position Q. A clockwise end of the front-side tapered portion 166 achieved when viewed from the front is formed so as to project further outside than is a point 172 along the circumferential direction. A counterclockwise end of the front-side tapered portion 166 achieved when viewed from the front is formed up to a position of the tail end 152*a* in the circumferential direction. As shown in FIG. 13, a front-side end of the front-side tapered portion 166 is formed much outside when compared with an outer periphery of a cylindrical tubular portion 182. The front-side tapered portion 166 is formed so as not to lie in the way of the bobbin 300 when the bobbin is housed in the bobbin accommodation section 180.

The leading end 170 is formed so as to extend from an end of the race 152 (i.e., an end opposite to the tail end 152*a*) in the circumferential direction. An exterior surface of the leading end 170 is formed along an outer peripheral surface of the race 152, and the sharp point 172 is formed at an extremity of the leading end 170. The thread guard 174, forming a plane perpendicular to the circumferential direction, is provided on the inside of a base end of the point 172. The pointed portion 176, assuming a sharp geometry projecting from the thread guard 174 in the circumferential direction, is formed on the inside of the thread guard 174. The sharp cutout 192 is formed between the pointed portion 176 and the front-side tapered portion 166, so as to become bifurcated by means of the pointed portion 176 and the leading end of the front-side tapered portion 166. A rear side of the leading end 170 (i.e., an area between the rear side of the pointed portion 176 and the rear-side tapered portion 164) is formed in a smooth recess toward the end of the rear-side tapered portion 164.

The bobbin accommodation section 180 has the cylindrical tubular portion 182 and a shaft 184. The cylindrical tubular portion 182 is fixed to a front-side surface of the rear-side body 162. Specifically, an outside diameter of the tubular portion 182 is essentially identical with the diameter of the rear-side body 162. The tubular portion 182 is fixed to the front side of the rear-side body 162. The tubular portion 182 is naturally formed to a size that enables accommodation of the bobbin 300. A longitudinal direction (a direction Y1-Y2) of the tubular portion 182 is formed so as to become equal to or longer than the bobbin 300 in its longitudinal direction. The shaft 184, formed in an axial shape that can be inserted into the bobbin 300, is fixed to the front-side surface of the rear-side body 162. Namely, the shaft 184 is made in such a way that an axis line (an axis line passing through the rotating center) (or referred to also as an "axial center core") of the shaft 184 is aligned to an axis line (an axis line passing through the rotating center) (or referred to also as an "axial center core") of the tubular portion 182. By means of presence of the tubular portion 182, it is possible to prevent a bobbin thread R wound around the bobbin 300 from getting loose from the bobbin 300. In particular, it may be a case where a wound bobbin thread will bulge out of the bobbin depending on a material of the bobbin thread; for instance, where the bobbin thread is polyester. For this reason, the fall of the bobbin thread R from the bobbin 300 can be prevented by means of presence of the tubular portion 182.

The magnet section 190, a permanent magnet, is affixed to a front-side surface of the second region 164*b* of the rear-side tapered portion 164. Specifically, the magnet section 190 is provided in a region outside of the tubular portion 182 on a front-side surface of the second region 164*b* of the rear-side tapered portion 164 (to be more specific, a region having the same width as that of the second region 164*b*), so as to extend from a right end to a lower end when viewed from the front. The magnet section 190, assuming a fan-shaped plate, is formed so as to make a curve matching a shape of the front-side surface of the rear-side tapered portion 164. The magnet section 190 can also be fixedly provided on a rear surface of the second region 164*b* of the rear-side tapered portion 164. In other words, the magnet section 190 is provided on a front side or a rear side of an outer-peripheral-side area (i.e., the rear-side tapered portion 164) of the rear portion 161 of the middle shuttle 150; more specifically, a portion (i.e., the rear-side body 162) of the rear portion 161 facing an area of the bobbin 300 where a magnet section 310 is provided. A magnet section 270 can be caused to approach the magnet section 190 without obstructing the bobbin thread tension control mechanism section 200.

A structure of the middle shuttle 150 except the magnet section 190 (at least the rear portion 161 and the bobbin accommodation section 180) is made of a substance unattracted by the magnet (a material to which the magnet does not adhere); that is, a non-magnetic substance (e.g., aluminum and stainless steel). Specifically, the magnet section 310 is provided in the bobbin 300. The structure of the middle shuttle 150 except the magnet section 190 is made of a non-magnetic substance so as to prevent the magnet section 310 from adhering to the rear-side body 162.

The bobbin thread tension control mechanism section 200 is provided at a rear side (Y2 side) of the outer shuttle 110 (on a Y2 side) (which may also be a rear direction) and has the bobbin thread motor 202, a rotary disc 210 attached to a rotary shaft 203 of the bobbin thread motor 202, and a support 220 for supporting the bobbin thread motor 202 in the outer shuttle 110.

The bobbin thread motor 202 is disposed at a rear side of the middle shuttle 150 (in other words in a "direction of the rear side"), built so as to be rotatable in both forward and backward directions, and an axis line (an axis line passing through a rotating center) (or referred to also as an "axial center core") of the rotary shaft 203 is aligned to an axis line (an axis line passing through the rotating center) (or referred to also as an "axial center core") of the shaft 184 in the middle shuttle 150. Mounts 204 and 206 to be used for mounting the motor to the support 220 are provided at a front-side end and a rear-side end of an upper end of the bobbin thread motor 202.

Figure 14:
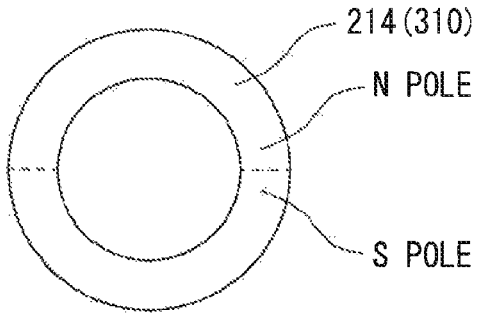
[FIG. 14] It is an explanatory view showing a configuration of a magnet section.
Figure 38:
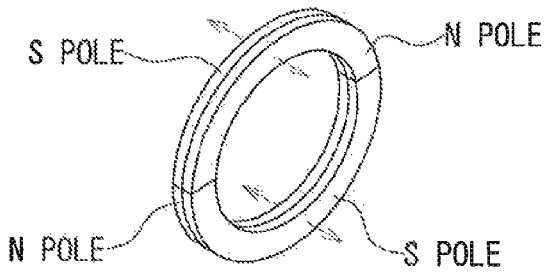
[FIG. 38] It is an explanatory view showing an example of the magnet section.
Figure 38:
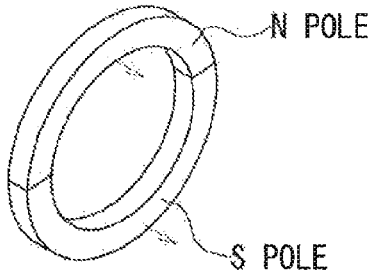
Figure 38:
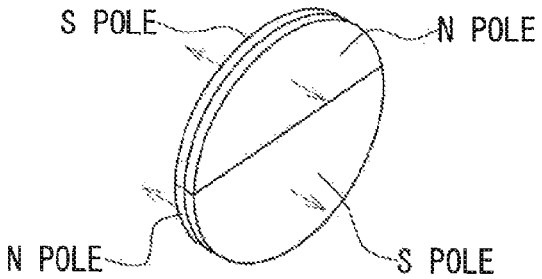
Figure 38:
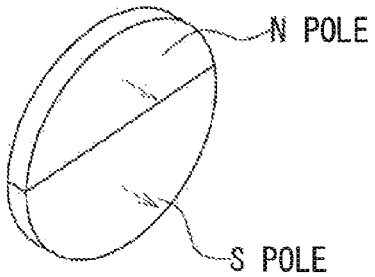

The rotary disc 210 has a circular plate-shaped rotary disc body (a rotor plate) (can also be embodied as a "rotating body") 212, a ring-shaped magnet (a second magnet) 214 attached to a front-side surface of the rotary disc body 212, and a tubular portion 216 provided on a rear surface of the rotary disc body 212. The tubular portion 216 is axially, fixedly supported by the rotary shaft 203 of the bobbin thread motor 202. Thereby, as a result of the rotary shaft 203 of the bobbin thread motor 202 being rotated, the rotary disc body 212 is rotated. Rotation of the rotary disc body 212 also results in rotation of the magnet section 214. The magnet section 214, a permanent magnet, is configured as shown in FIG. 14 such that one of partitions defined by means of a plane extending along the center of rotation comes to exhibit an N pole and that a remaining one of the partitions comes to exhibit an S pole. A direction of magnetization of the magnet section 214 corresponds to a plane direction (can also correspond to a thicknesswise direction). The direction of magnetization corresponding to the plane direction means that lines of magnetic force originate principally from the magnet section 214 in its thicknesswise direction [i.e., from a thicknesswise plane of the magnet section 214 (a planar portion of the magnet section 214) in its thicknesswise direction]. There is another meaning that, in a state of the magnet section 214 being attached to the rotary disc body 302, the lines of magnetic force exit principally from the magnet section 214 and substantially in parallel to the axial line of the rotary shaft 203 of the bobbin thread motor 202. Specifically, the magnet section 214 is a magnet both sides of which exhibit four poles, such as that shown in FIG. 38(*a*). Alternatively, the magnet section 214 can also be a magnet either side of which exhibits two poles, as shown in FIG. 38 (*b*). The magnet section 214 does not need to assume a ring shape, so long as the magnet is magnetized in its plane direction. The magnet section 214 may assume; for instance, a columnar shape. In other words, the magnet section 214 can also be a magnet both sides of which exhibit four poles, such as that shown in FIG. 38(*c*). Alternatively, the magnet section 214 can also be a magnet either side of which exhibits two poles, as shown in FIG. 38 (*d*). The essential requirement for the magnet section 214 is that at least one side of the magnet be formed so as to exhibit two poles.

The support 220 has a plate 221 and mounts 226 and 228 downwardly projecting from a lower surface of the plate 221. Specifically, the plate 221 has a substantially C-shaped portion 222 and a plate portion 224 extending from a rear-side end of the C-shaped portion 222 toward the rear side. One of a pair of leading ends on a front of the C-shaped portion 222 is fastened to one of a pair of upper ends of the outer shuttle 110, and the other of the leading ends of the C-shaped portion 222 is fastened to the other upper end of the outer shuttle 110. The mount 226 is fastened to the mount 204, and the mount 228 is fastened to the mount 206, whereby the support 220 supports the bobbin thread motor 202.

In a state where the support 220 of the bobbin thread tension control mechanism section 200 is fastened to the outer shuttle 110, the magnet section 214 of the rotary disc 210 remains in close proximity to, at spacing, the rear surface of the rear-side body 162 of the middle shuttle 150 placed in the outer shuttle 110.

Each of the shuttle actuation sections 250 includes the shuttle actuation motor 252, a support arm (which can be referred to also as an "arm" or an "arm section") 260 axially supported by a rotary shaft (a second rotary shaft) 253 of the shuttle actuation motor 252, the magnet section (a fourth magnet section) 270 provided at a leading end of the support arm 260, and the encoder 251 (see FIG. 1) connected to the shuttle actuation motor 252.

The shuttle actuation motor 252 is provided at a rear side (which is referred to also as a"direction of a rear surface") of the bobbin thread motor 202. An axis line (the axis line passing through the rotating center) (or referred to also as an "axial center core") of the rotary shaft 253 of the shuttle actuation motor 252 is set so as to be aligned to an axis line (the axis line passing through the rotating center) (referred to also as an "axial center core") of the rotary shaft 203 of the bobbin thread motor 202 and an axis line (the axis line passing through the rotating center) (referred to also as an "axial center core") of the middle shuttle 150. The shuttle actuation motor 252 is mounted on the bottom surface 7*a* of the shuttle base 7.

The support arm 260, assuming a substantially L-shaped geometry as a whole, has a substantially rod-shaped base end 262 and a leading end 264 continually extending from an extremity of the base end 262. The base end 262 is positioned in a direction orthogonal to the axial line of the rotary shaft 253 of the shuttle actuation motor 252, whereas the leading end 264 is positioned in parallel to the axial line of the rotary shaft 253 of the shuttle actuation motor 252. A length of the base end 262 is set such that the leading end 264 does not contact the shuttle actuation motor 252 and that the magnet section 270 attached to an extremity of the leading end 264 is located at a rear of the magnet section 190 (which may also be a rear direction of the magnet section 190). Likewise, a length of the leading end 264 is also set such that the magnet section 270 comes close to the back of the rear-side tapered portion 164. To be specific, the magnet section 270 stays in close proximity, at a spacing, to the rear surface of the rear-side tapered section 164.

The magnet section 270, a permanent magnet, assumes the geometry of a fan-shaped plate. The magnet section 270 is curved in agreement with the geometry of the rear surface of the rear-side tapered portion 164, so as to come as much close as possible to the rear surface of the rear-side tapered portion 164 of the middle shuttle 150.

The magnet section 270 and the magnet section 190 are configured so as to attract each other. When a surface of the magnet section 270 facing the rear-side tapered portion 164 of the middle shuttle 150 exhibits either the N pole or the S pole, a surface of the magnet section 190 facing the rear-side tapered portion 164 is set so as to exhibit the remaining pole. When the shuttle actuation motor 252 is driven, the rotary shaft 253 of the shuttle actuation motor 252 is thereby rotated. The support arm 260 then rotates as a result of rotation of the rotary shaft 253, whereupon the magnet section 270 rotates in a circumferential direction. Since the magnet section 270 and the magnet section 190 attract each other, the middle shuttle 150 rotates in conjunction with rotation of the magnet section 270.

The bobbin 300 has the bobbin body 302 and the magnet (a first magnet) 310 disposed on a rear surface of the bobbin body 302 (the rear surface opposes the rear portion 161 of the middle shuttle 150 when the bobbin is axially supported on the shaft 184).

Each of the bobbin bodies 302 has a similar configuration as that of an ordinary bobbin. The bobbin body 302 has a circular plate 302*a* a center of which is opened in the form of a circular aperture; another plate 302*b* equal to the plate 302*a* in both a size and a shape; and a cylindrical portion 302*c* interposed between the aperture of the plate 302*a* and an aperture of the plate 302*b*. A bobbin thread can be wound in a space existing between the plate 302*a* and the plate 302*b*. A hole 304 in the cylindrical portion 302*c* acts as a hole into which the shaft 184 of the middle shuttle 150 is to be inserted.

The magnet section 310, a permanent magnet, has a configuration similar to that of the magnet section 214 of the bobbin thread tension control mechanism section 200. The magnet section 310 is configured such that one of partitions defined by means of a plane extending along the center of rotation comes to exhibit an N pole and that a remaining one of the partitions comes to exhibit an S pole. A direction of magnetization of the magnet section 310 matches a plane direction. The direction of magnetization corresponding to the plane direction means that lines of magnetic force originate principally from the magnet section 310 in its thicknesswise direction [i.e., from a thicknesswise plane of the magnet section 310 (a planar portion of the magnet section 310) in its thicknesswise direction]. Further, there is another meaning that, in a state of the magnet section 310 being attached to the bobbin body 302, the lines of magnetic force exit principally from the magnet section 310 and substantially in parallel to the axial line of the bobbin 300 (the axial line passing through the center of rotation). Specifically, the magnet section 310 is a magnet both sides of which exhibit four poles, such as that shown in FIG. 38(*a*). Alternatively, the magnet section 310 can also be a magnet either side of which exhibits two poles, as shown in FIG. 38(*b*). In other words, the magnet section 310, assuming a ring shape, is a magnet that is formed such that at least one side of the magnet exhibits two poles. The magnet section 310 is formed so as to become substantially identical with the magnet section 214 in terms of a size and a shape. Further, an outside diameter of the magnet section 310 is substantially equal to the outside diameter of the magnet section 214. When the bobbin thread motor 202 is activated, the rotary shaft 203 of the bobbin thread motor 202 is thereby rotated, which in turn rotates the rotary disc 210 and the magnet section 214. By means of rotation of the magnet section 214, the N poles and the S poles in the magnets 214 and 310 attract each other, whereupon the bobbin 300 is also rotated.

The sewing frame 22*d*, the middle shuttle 150, and the bobbin 300 also become machine elements in much the same way as the machine elements (the thread take-up levers 12*a*-1 to 12*a*-9, the needle bars 12*b*-1 to 12*b*-9, and the presser feet 12*c*).

The shuttle 100, the bobbin thread tension control mechanism section 200, the shuttle actuation section 250, and the bobbin 300 make up a shuttle-related mechanism.

The shuttle 100, the bobbin thread tension control mechanism section 200, the shuttle actuation section 250, the bobbin 300, and the control circuit 40 for controlling operation of the bobbin thread motor 202 and the shuttle actuation motor 252 make up a "sewing-machine bobbin thread tension controller."

Operation of the sewing machine 1205 of the first embodiment is now described by reference to FIG. 21 to FIG. 37.

First, the control circuit 90 generates main spindle data (see FIG. 21) for each stitch in accordance with the embroidery data stored in the memory device 92. Since the memory device 92 stores, for each stitch, information about an embroidery to be generated, like a stitch width, a stitching direction, and thread attributes (a thread material and a thread thickness), main spindle data are generated according to the stitch width, the stitching direction, and the thread attributes for each stitch. As shown in FIG. 21, the main spindle data are data pertaining to a main spindle angle (i.e., the rotational position of the main spindle motor 20) achieved per unit time in a chronological order. For instance, when the stitch width is large, an amount of change in main spindle angle is decreased. On the contrary, when the stitch width is small, the amount of change in main spindle angle is increased. Moreover, when the stitching direction is opposite to the stitching direction employed last time, the amount of change in main spindle angle is decreased. Specifically, when an angle which the stitching direction forms with a direction of an immediately preceding stitch (an angle $\alpha 3$ in FIG. 43) is small, an amount of change in main spindle angle is decreased. In contrast, when the angle which the stitching direction forms with the direction of the immediately preceding stitch is large, the amount of change in main spindle angle is increased.

When the control circuit 90 generates the main spindle data, an entirety of embroidery data made up of a plurality of stitches can have been generated in advance. Alternatively, there can also be generated main spindle data pertaining to a stitch located several stitches ahead of a stitch by means of which the respective machine elements (the needle bar, the thread take-up lever, the shuttle, and the like) actually perform embroidering. Thereby, actual embroidering can also be performed while the main spindle data are being generated.

Figure 22:
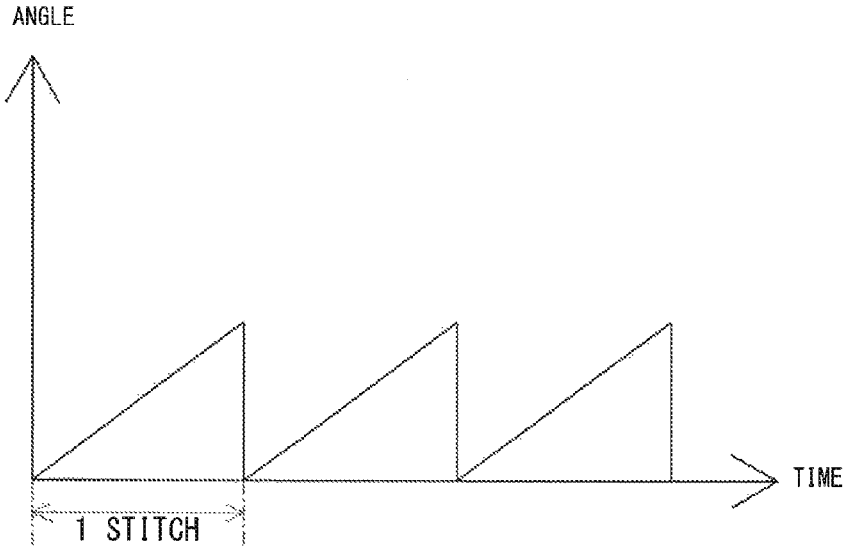
[FIG. 22] It is an explanatory view showing the main spindle data.

FIG. 22 shows example main spindle data. The main spindle data shown in FIG. 22 pertain to a case where the main spindle keeps rotating with constant velocity. When the respective stitches have a constant stitch width and when angles of the stitches are also oriented in the same direction, such main spindle data can be adopted. Incidentally, when a certain stitch has a large width, a time consumed to make one stitch is made longer. By contrast, when a certain stitch has a smaller stitch width, a time for one stitch is made shorter.

Figure 23:
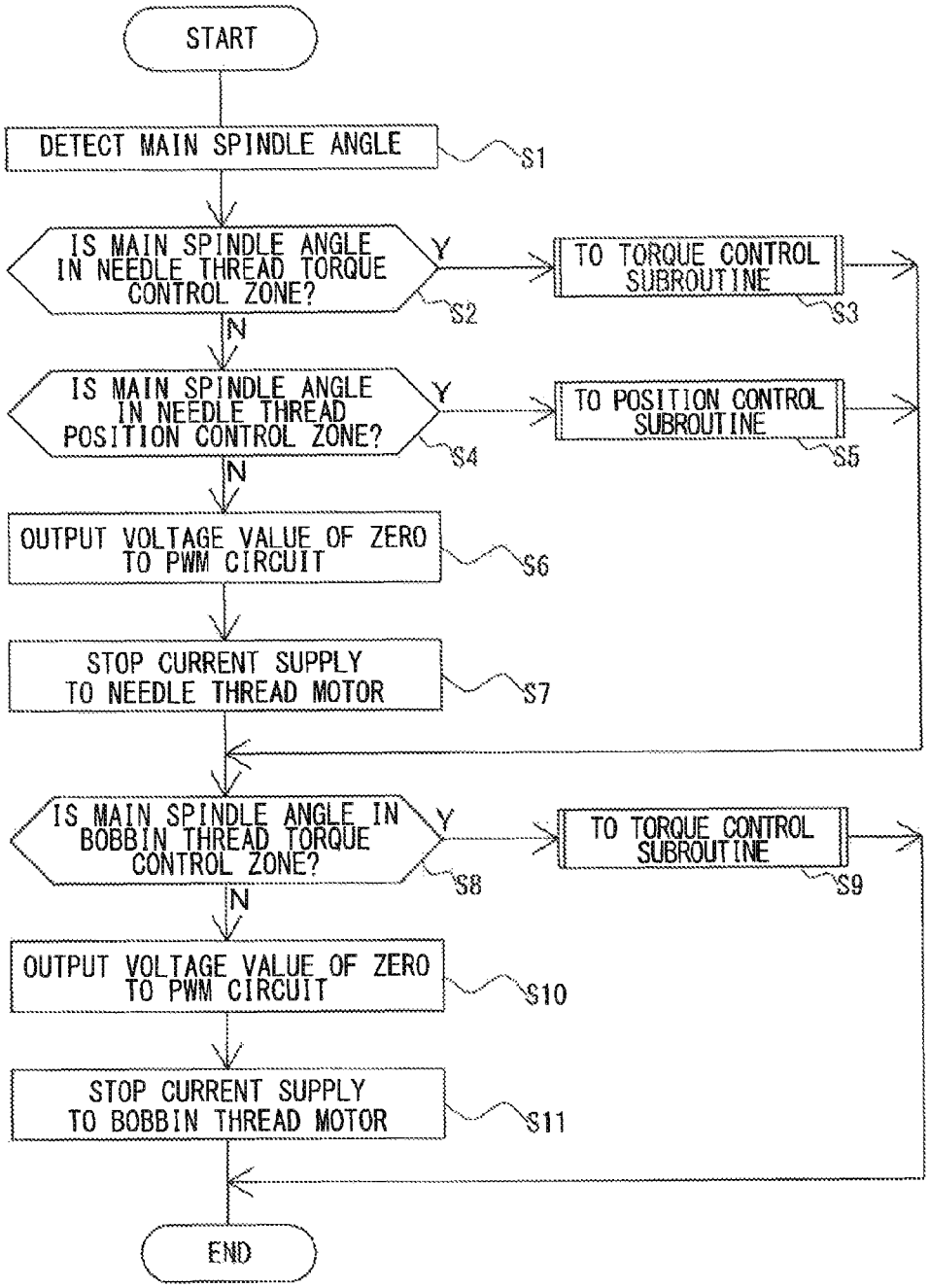
[FIG. 23] It is a flowchart that illustrates a method for controlling a needle thread motor and a bobbin thread motor.

Operation to be performed during actual embroidering is described. As shown in FIG. 23, a main spindle angle is first detected (S1). Specifically, a main spindle angle is detected from information about the encoder 21 connected to the main spindle motor 20. The main spindle angle is detected at a predetermined cycle (in other words, processing shown in FIG. 23 is carried out at predetermined cycles); for instance, a cycle that is one-tenths to one-thousandths of a cycle for one stitch.

Since the needle bar is provided in numbers, a needle bar is selected from among the plurality of needle bars (in short, a thread is selected), to be exact, a main spindle angle is detected (S1), and a determination is then made as to whether or not a change is made to a needle thread. When a change is made to the needle thread, the needle bar case 1314 is slid, to thus place the magnet sections 1250 and 1270 at a position of the selected thread. In addition, the turning arm 1281 of the turning section 1280 is moved to a position of the opening section 1342*b* corresponding to the needle thread so as to be able to retain and pull up the selected thread.

Specifically, a process of determining whether or not a change is made to the needle thread is set between step S1 and step S2. In the process of determining whether or not a change is made to a needle thread, a determination is made as to whether or not a detected main spindle angle is one that corresponds to a head of one stitch (for instance, a zero degree in FIG. 36; in other words, timing when a shift is made to the next stitch). When the main spindle angle corresponds to the head of one stitch, a process of determining from the embroidery data whether or not a change is made to the needle thread is set between step S1 and step S2. When a change is made to the needle thread, there is set a process of controlling sliding action of the needle bar case 1314. After sliding action of the needle bar case 1314, processing proceeds to step S2. When the detected angle of the main spindle is not the main spindle angle corresponding to the head of one stitch or when no change is made to the needle thread despite the detected main spindle angle corresponding to the head of one stitch, processing proceeds to step S2 without modifications.

In accordance with a detected main spindle angle, it is determined that the main spindle motor is situated in which one of zones as to the needle thread; namely, the torque control zone, the position control zone, and the other zone. In other words, as shown in FIG. 6, the memory device 92 stores information about the starting point and the end point of the torque control zone and information about the starting point and the end point of the position control zone. Hence, a determination is made by comparing the detected main spindle angle with the information.

Specifically, a determination is made as to whether or not the main spindle angle is in the needle thread torque control zone (S2). When the main spindle angle is in the torque control zone, processing proceeds to a torque control subroutine (S3).

When the main spindle angle does not is in the torque control zone, a determination is made as to whether or not the main spindle angle is in the needle thread position control zone (S4). When the main spindle angle is in the position control zone, processing proceeds to position control subroutine (S5).

When the main spindle angle is not in the position control zone, the CPU 90*a* outputs a voltage value of 0 to the PWM circuit 90*b* (S6), thereby halting a current supply to the needle thread motor 1286 (S7). As mentioned above, a period during which the current supply to the needle thread motor 1286 is halted corresponds to the area from the end point of the torque control zone to the starting point of the position control zone and the area from the end point of the position control zone to the starting point of the torque control zone which are shown in FIG. 36. Specifically, a current supply halt time is set in order to switch between torque control and position control after the opening and closing of the grip section main bodies 1241 and 1261 have been reliably switched. Opening and closing of the grip section main bodies 1241 and 1261 effected during control operation, such as torque control operation and position control operation, can thereby be performed without fail.

When switching response of the grip section main bodies 1241 and 1261 can be made quick, it is also possible to bring the starting point of the torque control zone in agreement with the end point of the position control zone and also bring the starting point of the position control zone in agreement with the end point of the torque control zone.

Figure 24:
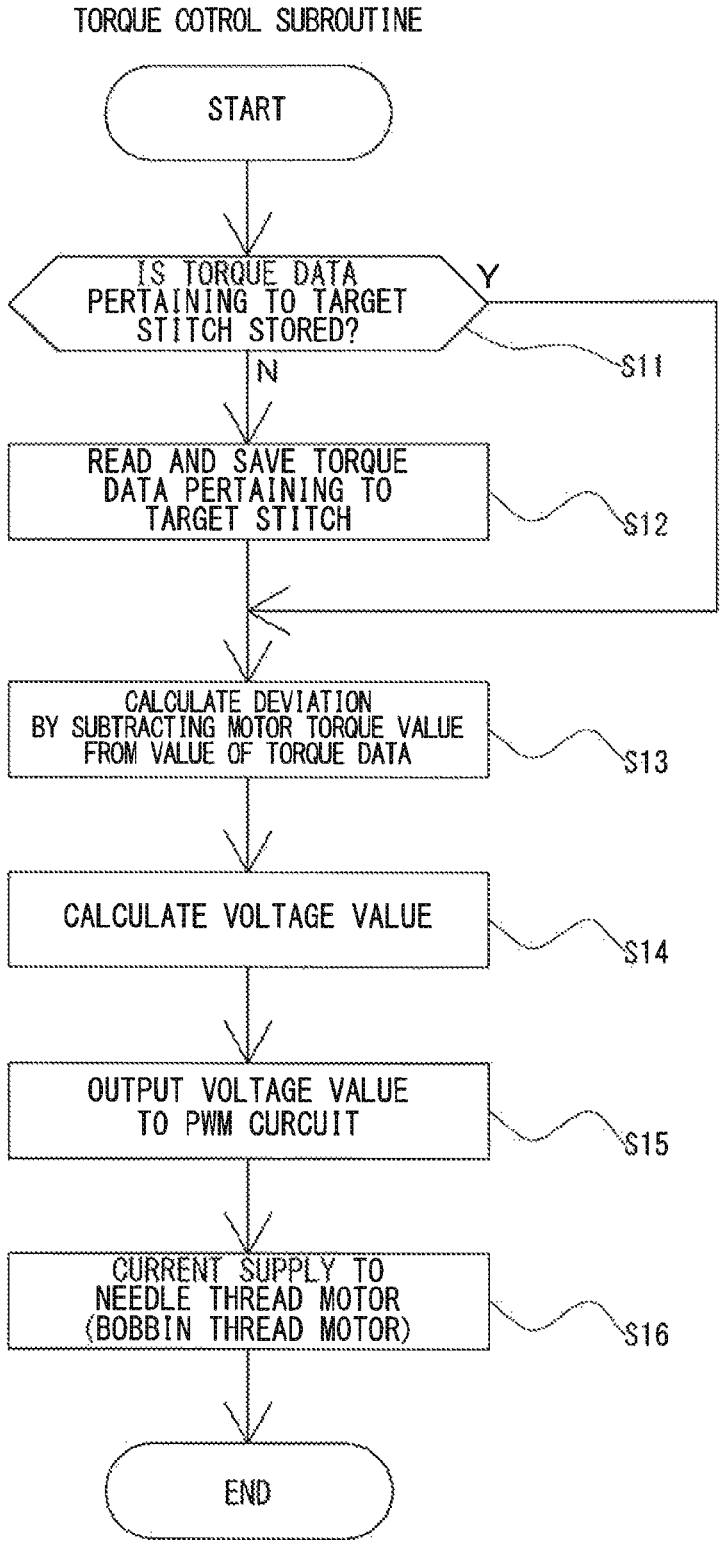
[FIG. 24] It is a flowchart that illustrates a method for controlling the needle thread motor and the bobbin thread motor; in particular, a torque control method.

Next, in the torque control subroutine, torque data (a torque value) pertaining to a target stitch are read from the needle thread control torque data value (torque data) at the starting point of the torque control zone. In the torque control zone for the stitch, torque is controlled in accordance with the thus-read needle thread control torque value. Specifically, as shown in FIG. 24, it is determined whether or not the torque data pertaining to the target stitch are stored in the control circuit 90 (S11). When the torque data are not yet retained at the starting point of the torque control zone, the torque data pertaining to the target stitch are read from the needle thread control torque data and retained in the control circuit 90 (S12).

Figure 29:
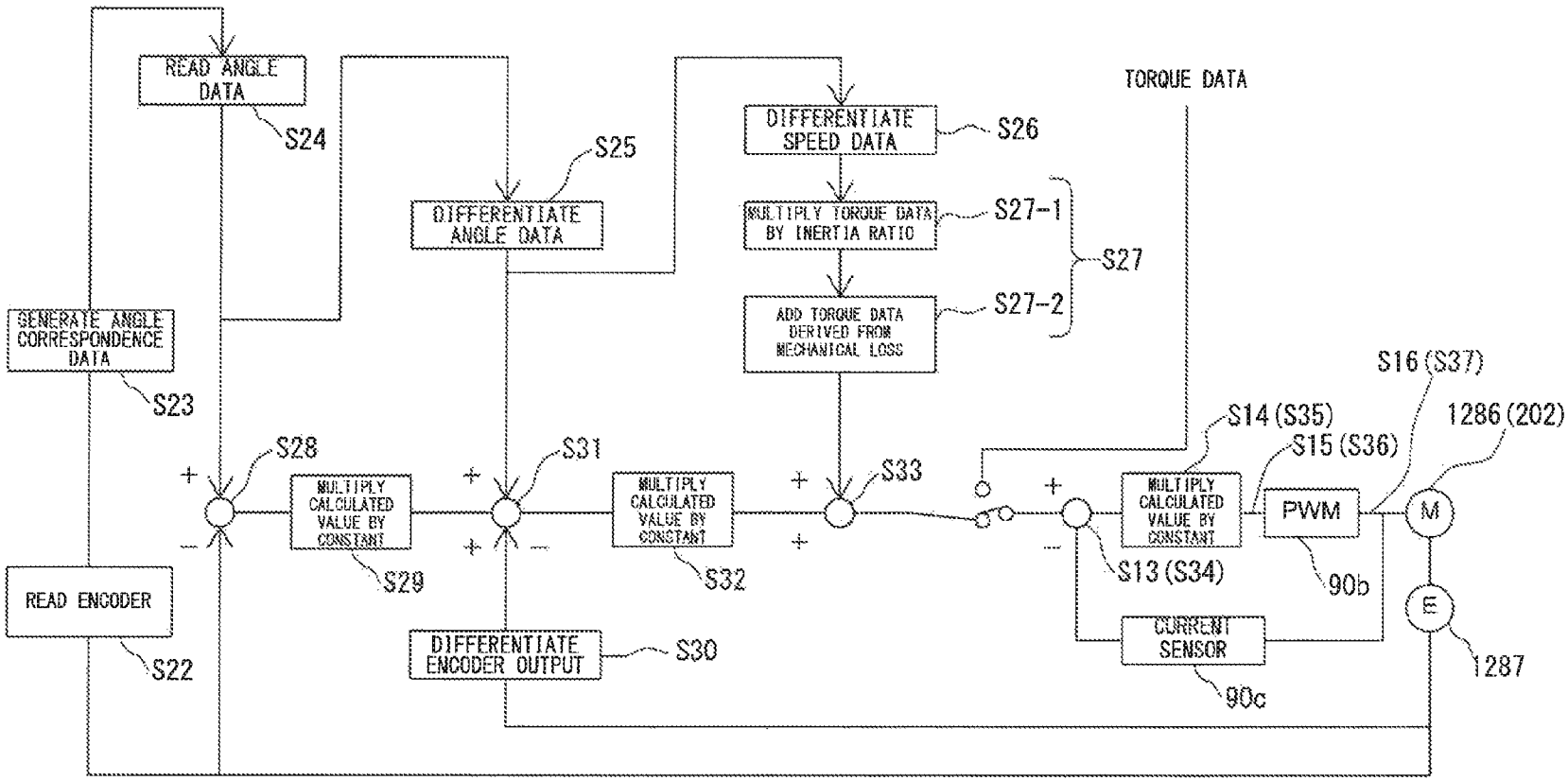
[FIG. 29] It is a functional block diagram showing a method for controlling the needle thread motor.

When the needle thread control torque value pertaining to the target stitch are retained, a torque value is read from the current sensor 90*c*, and the torque value thus detected by the current sensor 90*c* is subtracted from a value of the torque data pertaining to the target stitch (S13 shown in FIG. 24, and S13 shown in FIG. 29).

Next, the value calculated in step S13 is multiplied by a predetermined constant, thereby calculating a voltage value (a voltage command to the PWM circuit) to be output to the PWM circuit 90*b* (S14 shown in FIG. 24, and S14 shown in FIG. 29). The thus-calculated voltage value is output to the PWM circuit 90*b* (S15 shown in FIG. 24, and S15 shown in FIG. 29).

In accordance with the thus-input signal, the PWM circuit 90*b* outputs a pulse signal as a voltage signal, thereby supplying an electric current to the needle thread motor 1286 (S16 shown in FIG. 24, S16 shown in FIG. 29: a current supply step).

Control executed by the position control subroutine in the position control zone includes detecting an angle of the needle thread motor 1286; namely, a current rotational position of the needle thread motor 1286 (i.e., a rotational position of an output shaft of the needle thread motor 1286); preparing angle correspondence data for controlling the rotational position of the needle thread motor 1286 to its initial position (this may also expressed as "a position of origin"); and returning the needle thread motor 1286 to its initial position in accordance with the angle correspondence data through position control. First, in relation to the target stitch, a determination is made as to whether or not the angle correspondence data are generated (S21 shown in FIG. 25).

Figure 25:
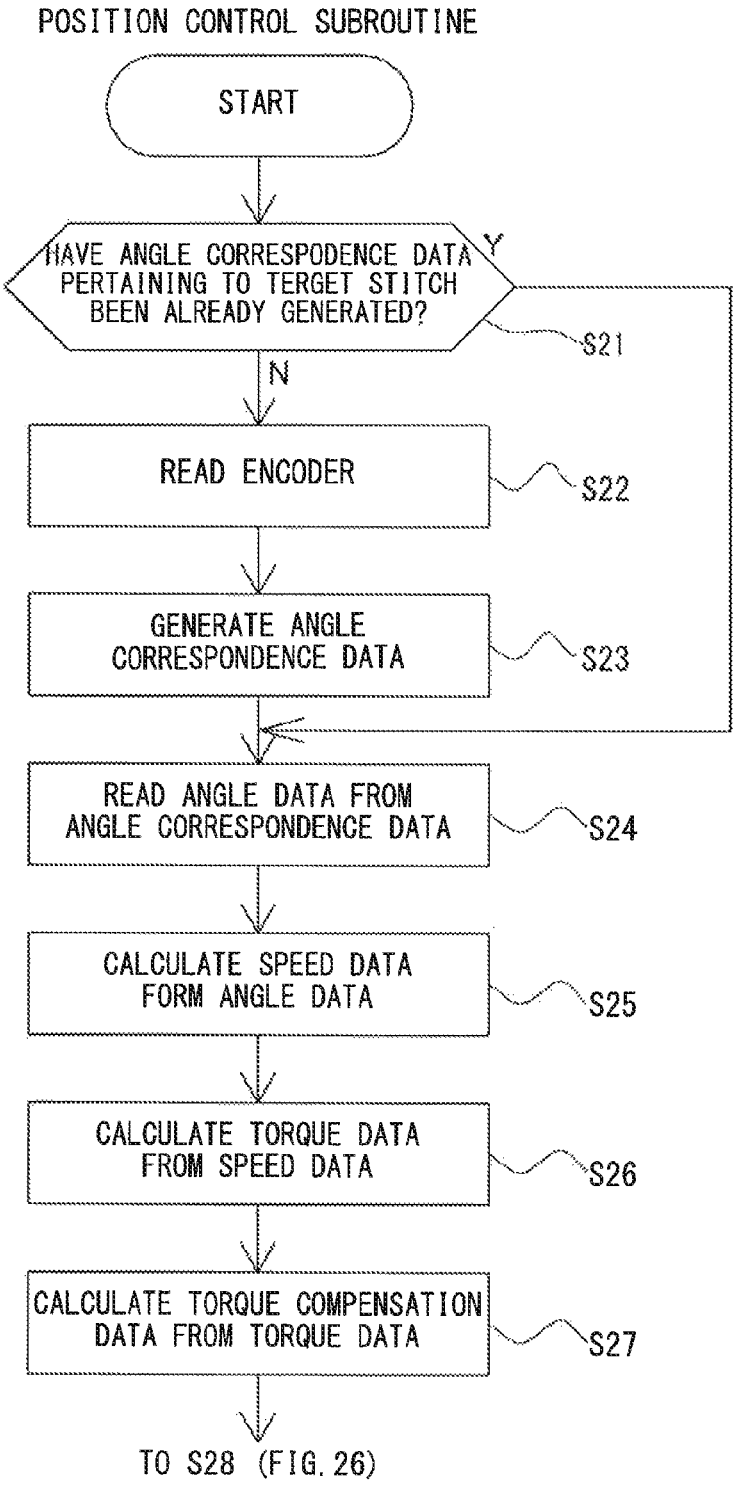
[FIG. 25] It is a flowchart that illustrates a method for controlling the needle thread motor; in particular, a position control method.
Figure 27:
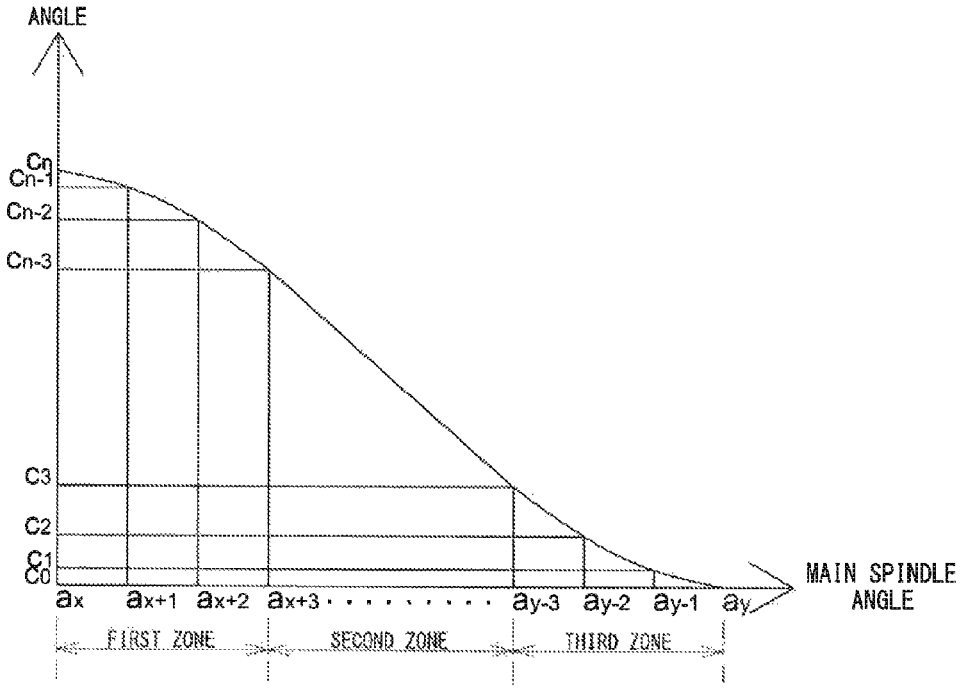
[FIG. 27] It is an explanatory view that illustrates a method for controlling a position of a needle thread motor.

When the angle correspondence data are not generated yet; namely, at the starting point of the position control zone, the angle of the needle thread motor 1286 is detected by means of the encoder 1287 (S22 shown in FIG. 25, and S22 shown in FIG. 29). In accordance with the thus-detected angle of the needle thread motor 1286, the angle correspondence data are generated (S23 shown in FIG. 25, and S23 shown in FIG. 29). As shown in FIG. 28, the angle correspondence data are data pertaining to a correspondence between the main spindle angle (i.e., the rotational position of the main spindle motor 20) and a needle thread motor angle (an angle of the needle thread motor) (the rotational position of the needle thread motor 1286). More specifically, the angle correspondence data are data pertaining to a correspondence between the main spindle angle and the needle thread motor angle from when the needle thread motor angle changes from $C_n$ achieved at the starting point of the position control zone (the main spindle angle achieved at the starting point of the position control zone is taken as $a_x$) to $C_\theta$ achieved at the end point of the position control zone (the main spindle angle achieved at the end point of the position control zone is taken as $a_y$). The main spindle angle and the needle thread motor angle represent rotational positions of the respective motors. The angle $C_\theta$ is an initial position angle of the needle thread motor 1286. On the occasion of generation of the angle correspondence data, a range from the main spindle angle $a_x$ corresponding to the starting point of the position control zone to the main spindle angle $a_y$ corresponding to the end point of the position control zone is divided into equal parts at predetermined intervals (unit angles) (namely, in units of one-$n^{th}$ ("n" is an integer). As shown in FIG. 27, in a first zone that is a predetermined area from the starting point of the position control zone (e.g., a main spindle angle $a_x$ to a main spindle angle $a_{x+3}$), a gradual increase occurs in an amount of change in the needle thread motor per unit angle, whereby a turning speed of the turning arm 1281 increases. In a second zone (e.g., the main spindle angle $a_{x+3}$ to a main spindle angle $a_{y-3}$) following the first zone, the amount of change in needle thread motor angle per unit angle becomes constant. In a third zone (e.g., a main spindle angle $a_{y-3}$ to a main spindle angle $a_y$) following the second zone, a gradual decrease occurs in the amount of change in needle thread motor angle per unit angle, whereby the turning speed of the turning arm 1281 decreases. An angular range of the first zone and an angular range of the third zone are assumed to be shorter than an angular range of the second zone.

Data pertaining to the needle thread motor angle are read from the angle correspondence data (S24 shown in FIG. 25 and S24 shown in FIG. 29). Specifically, a main spindle angle closest to the main spindle angle detected in step S1 is detected from the angle correspondence data (FIG. 29), and the needle thread motor angle corresponding to the main spindle angle is read. When data pertaining to two main spindle angles adjoining to the main spindle angle detected in step S1 are found in the angle correspondence data, the needle thread motor angle can also be calculated according to a ratio of the detected main spindle angle to the two adjoining main spindle angles.

Speed data are now calculated by detecting an amount of change per unit time from the thus-read needle thread motor angle (S25 shown in FIG. 25, S25 shown in FIG. 29: a speed data calculation step). Speed data are calculated by dividing the amount of change in angle data by a time. Specifically, a relationship between the main spindle angle and the needle thread motor angle is specified by the angle correspondence data shown in FIG. 28. Further, a relationship between a time and a main spindle angle is specified by the main spindle data shown in FIG. 21. The amount of change in needle thread motor angle per unit time is thereby detected. When no match exists between main spindle angle data of the main spindle data and the main spindle angle data of the angle correspondence data, all you need to do; for instance, is to calculate a time from a ratio of the main spindle angle data of the main spindle data to a difference between two main spindle angles adjoining the main spindle angle of the angle correspondence data (the main spindle angle of the main spindle data).

Torque data are now calculated by detecting an amount of change in speed data per unit time (S26 shown in FIG. 25, S26 shown in FIG. 29: a torque data calculation step). Specifically, torque data are calculated by dividing the amount of change in speed data by a time. In step S25, the speed data pertaining to the needle thread motor are calculated on a per-time basis; hence, torque data are calculated by differentiating the speed data.

Next, torque compensation data are calculated from the torque data calculated in step S26 (S27 shown in FIG. 25, and S27 shown in FIG. 29). Specifically, the torque data are multiplied by an inertia ratio (S27-1 shown in FIG. 29), torque derived from a mechanical loss is added to a value determined by multiplying the torque data by the inertia ratio, thereby calculating torque compensation data (S27-2 shown in FIG. 29). The inertia ratio is a constant previously determined according to amass of each of the machine elements, or the like. Further, the torque derived from a mechanical loss is a value previously determined in correspondence with each of the machine elements.

Figure 26:
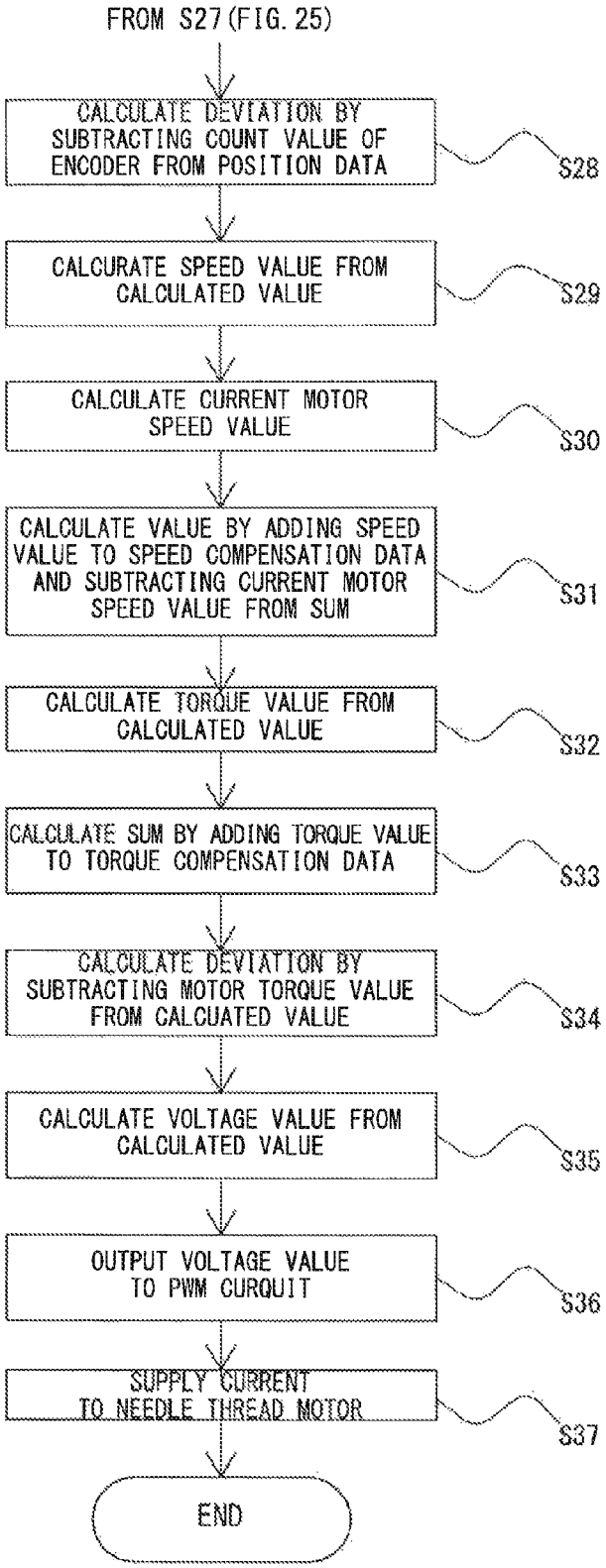
[FIG. 26] It is a flowchart that illustrates a method for controlling the needle thread motor; in particular, the position control method.

Data (a count value of the encoder) output from the encoder 1287 (the encoder corresponding to the needle thread motor 1286) are subtracted from the angle data read in step S24 (S28 shown in FIG. 26, S28 shown in FIG. 29: a location deviation calculation step). A value calculated in step S28 can be said to be a value of a location deviation.

The value calculated in step S28 is now multiplied by a predetermined constant, thereby calculating a speed value (S29 shown in FIG. 26 and S29 shown in FIG. 29).

A current motor speed value is calculated by differentiating the output from the encoder 87 (S30 shown in FIG. 26 and S30 shown in FIG. 29). Specifically, an amount of change in encoder count value per unit time is calculated, thereby calculating a current motor speed value.

Next, the current motor speed value calculated in step S31 is subtracted from the speed value calculated in step S30, and the speed data calculated in step S25 are added to a subtraction result (S31 shown in FIG. 26, S31 shown in FIG. 29: a speed deviation calculation step). A value calculated in step S31 can be said to be a value of speed deviation.

The value calculated in step S31 is multiplied by a predetermined constant, thereby calculating a torque value (S32 shown in FIG. 26 and S32 shown in FIG. 29).

Torque compensation data calculated in step S27 are added to the torque value calculated in step S32 (S33 shown in FIG. 26, and S33 shown in FIG. 29). Subsequently, the torque value output from the current sensor 90*c* is subtracted from the value calculated in step S33 (S34 shown in FIG. 26, S34 shown in FIG. 29: a torque deviation calculation step). The value calculated in step S34 can be said to be a torque deviation value.

The value calculated in step S34 is multiplied by a predetermined constant, thereby calculating a voltage value (a voltage command to the PWM circuit) output to the PWM circuit 90*b* (S35 shown in FIG. 26, S35 shown in FIG. 29). The voltage value is then output to the PWM circuit 90*b* (S36 shown in FIG. 26, and S36 shown in FIG. 29).

The PWM circuit 90*b* outputs a pulse signal as a voltage signal in accordance with an input signal, thereby supplying an electric current to the needle thread motor 1286 (S37 shown in FIG. 26, S37 shown in FIG. 29: a current supply step). As above, the needle thread motor 1286 is controlled by repetition of processing depicted by flowcharts shown in FIG. 23 to FIG. 26. In descriptions about the flowcharts shown in FIG. 23 to FIG. 26 in relation to needle thread control, the PWM circuit 90*b* and the current sensor 90*c* are the PWM circuit 90*b* and the current sensor 90*c* that correspond to the needle thread motor 1286.

A determination is now made as to whether or not the main spindle is in the bobbin thread torque control zone according to the main spindle angle detected in step S1 (S8). Specifically, as shown in FIG. 19, the memory device 92 stores information about the starting point and the end point of the bobbin thread torque control zone, and hence a determination is made by comparing the detected main spindle angle with the information.

It is determined whether or not the main spindle is in the bobbin thread torque control zone (S8). When the main spindle is in the torque control zone, processing proceeds to a torque control subroutine (S9).

When the main spindle is not in the torque control zone, the CPU 90*a* outputs a voltage value of zero to the PWM circuit 90*b* (S10), halting a current feed to the bobbin thread motor 202 (S11). As stated, the zone during which the current feed to the bobbin thread motor 202 is halted corresponds to a zone other than the zone T in FIG. 37.

Next, in the torque control subroutine, control is carried out in accordance with the flowchart shown in FIG. 24 as in the case with the needle thread. A bobbin thread control torque value (torque data) of a target stitch is in advance read from the bobbin thread control torque data at the starting point of the torque control zone. In the torque control zone of the stitch, torque control is performed according to the thus-read bobbin thread control torque value. Specifically, as shown in FIG. 24, it is determined whether or not the torque data pertaining to the target stitch are stored in the control circuit 90 (S11). When the torque data are not yet retained at the starting point of the torque control zone, the torque data pertaining to the target stitch are read from the needle thread control torque data and retained in the control circuit 90 (S12).

When the bobbin thread control torque value pertaining to the target stitch are retained, a torque value is read from the current sensor 90*c*, and the torque value thus detected by the current sensor 90*c* is subtracted from a value of the torque data pertaining to the target stitch (S13 shown in FIG. 24, and S13 shown in FIG. 29).

Next, the value calculated in step S13 is multiplied by a predetermined constant, thereby calculating a voltage value (a voltage command to the PWM circuit) to be output to the PWM circuit 90*b* (S14 shown in FIG. 24, and S14 shown in FIG. 29). The thus-calculated voltage value is output to the PWM circuit 90*b* (S15 shown in FIG. 24, and S15 shown in FIG. 29).

In accordance with the thus-input signal, the PWM circuit 90*b* outputs a pulse signal which is to serve as a voltage signal, subsequently supplying an electric current to the bobbin thread motor 202 (S16 shown in FIG. 24, S16 shown in FIG. 29: a current supply step). Processing pertinent to S13 to S16 in FIG. 29 pertain to the bobbin thread control.

When the rotary shaft 203 of the bobbin thread motor 202 rotates, the rotary disc 210 rotates, and the magnet section 214 then rotates. The N and S poles of the magnet section 214 and the N and S poles of the magnet section 310 attract each other as a result of rotation of the magnet section 214, thereby imparting rotating force to the bobbin 300. In relation to a rotational direction of the bobbin thread motor 202, the bobbin thread motor 202 is rotated such that the rotary disc 210 is rotated in a direction opposite to the rotational direction (a forward direction) of the bobbin 300 achieved when the bobbin thread R is withdrawn. Rotating force is thereby imparted to the bobbin 300 in a direction opposite to the forward direction, so that a knot between the needle thread J and the bobbin thread R can be tightened.

Processing pertinent to the flowcharts shown in FIG. 23 to FIG. 26 is iterated as above, whereby the bobbin thread motor 202 is controlled. In the descriptions about the flowcharts shown in FIG. 23 to FIG. 26 in relation to bobbin thread control, the PWM circuit 90*b* and the current sensor 90*c* are the PWM circuit 90*b* and the current sensor 90*c* that correspond to the bobbin thread motor 202.

As shown in FIG. 36, in relation to control of switching between the upstream grip section 1240 and the downstream grip section 1260, the grip section main body 1241 of the upstream grip section 1240 is opened, and the grip section main body 1261 of the downstream grip section 1260 is closed from the end point of the torque control zone to the end point of the position control zone of the needle thread motor 1286. In the meantime, the grip section main body 1241 of the upstream grip section 1240 is closed, and the grip section main body 1261 of the downstream grip section 1260 is opened from the end point of the position control zone to the end point of the torque control zone.

Figure 30:
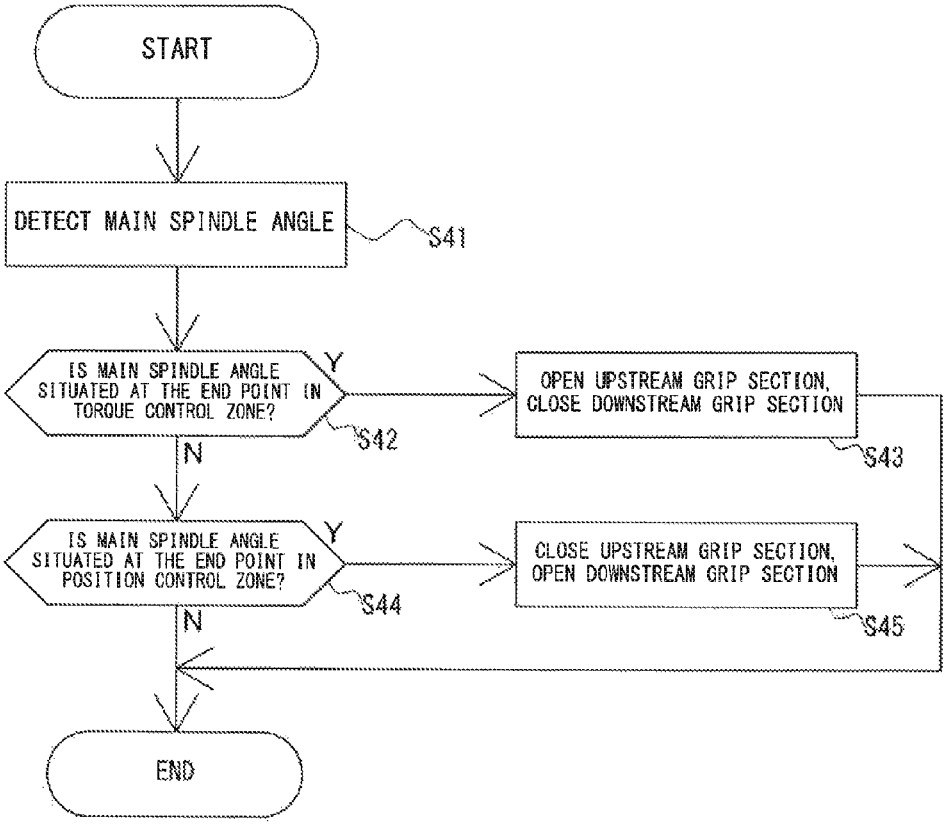
[FIG. 30] It is a flowchart showing operation of an upstream grip section and operation of a downstream grip section.

Specifically, explanations are given along a flowchart shown in FIG. 30. A main spindle angle is detected (S41) (detection of a main spindle angle is performed in the same manner as described in connection with the stitch S1). A determination is made as to whether or not the main spindle angle is situated at the end point of the torque control zone (S42). When the main spindle angle is at the end point of the torque control zone, the grip section main body 1241 of the upstream grip section 1240 is opened, and the grip section main body 1261 of the downstream grip section 1260 is closed. Specifically, the needle thread J is not fixed by the grip section main body 1241 but fixed by the grip section main body 1261. Even when the main spindle angle has not reached the end point of the torque control zone yet on the occasion of detection of the previous main spindle angle (S41) and when the main spindle angle has passed on the end point of the torque control zone on the occasion of detection of the current main spindle angle (S41), the main spindle angle is determined to be at the end point of the torque control zone.

Further, when the main spindle angle is not at the end point of the torque control zone, a determination is made as to whether or not the main spindle angle is at the end point of the position control zone (S44). When the main spindle angle is at the endpoint of the position control zone, the grip section main body 1241 of the upstream grip section 1240 is closed, and the grip section main body 1261 of the downstream grip section 1260 is opened. Incidentally, even when the main spindle angle has not reached the end point of the position control zone yet on the occasion of detection of a previous main spindle angle (S41) and when the main spindle angle has passed on the end point of the position control zone on the occasion of detection of a current main spindle angle (S41), the main spindle angle is determined to be at the end point of the position control zone.

In the torque control zone, the grip section main body 1241 is closed, and the grip section main body 1261 is opened as mentioned above. In the position control zone, the grip section main body 1241 is opened, and the grip section main body 1261 is closed. When the grip section main bodies 1241 and 1261 are closed, the gripped needle thread is fixed. In contrast, when the grip section main bodies 1241 and 1261 are opened, the needle thread is released from a fixed state.

As a result of activation of the magnet section 1250, the first plate-like section of the first plate-like section unit corresponding to the position of the magnet section 1250, among the first plate-like section main units 1242-1 to 1242-9, is attracted by magnetic force. Spacing between the first plate-like section 1242*a* and the second plate-like section 1244 is thereby closed tightly, and the grip section main body 1241 is also closed. Thus, there is achieved a closed state in which the needle thread J is pinched between the first plate-like section 1242*a* and the second plate-like section 1244. As shown in; for instance, FIG. 3, FIG. 4, FIG. 5, FIG. 6, and FIG. 7, when the magnet section 1250 is situated on the back side of the first plate-like section 1242*a* of the first plate-like section unit 1242-8, the magnet section 1250 is activated, whereby the spacing between the first plate-like section 1242*a* and the second plate-like section 1244 is tightly closed. Thus, the needle thread is gripped between the first plate-like section 1242*a* and the second plate-like section 1244. When the magnet section 1250 is not activated, the spacing between the first plate-like section 1242*a* and the second plate-like section 1244 is not tightly closed (namely, the first plate-like section and the second plate-like section remain in simple contact with each other). Hence, the grip section main body 1241 is opened, thereby achieving an open state in which the needle thread is released. As above, the magnet section 1250 acting as the upstream drive section switches between the closed state in which the grip section main body 1241 grips the needle thread and the open state in which the needle thread is released.

Likewise, as a result of activation of the magnet section 1270, the first plate-like section of the first plate-like section unit corresponding to the position of the magnet section 1270, among the first plate-like sections 1262-1 to 1262-9, is attracted by magnetic force. Spacing between the first plate-like section 1262*a* and the second plate-like section 1264 is thereby tightly closed, and the grip section main body 1261 is also closed. Thus, there is achieved a closed state in which the needle thread J is pinched between the first plate-like section 1262*a* and the second plate-like section 1264. As shown in; for instance, FIG. 3, FIG. 4, FIG. 5, FIG. 6, and FIG. 7, when the magnet section 1270 is situated on the back side of the first plate-like section 1262*a* of the first plate-like section unit 1262-8, the magnet section 1270 is activated, whereby the spacing between the first plate-like section 1262*a* and the second plate-like section 1264 is tightly closed. Thus, the needle thread is gripped between the first plate-like section 1262*a* and the second plate-like section 1264. When the magnet section 1270 is not activated, the spacing between the first plate-like section 1262*a* and the second plate-like section 1264 is not tightly closed (specifically, the first plate-like section and the second plate-like section remain in simple contact with each other). Hence, the grip section main body 1261 is opened, thereby achieving an open state in which the needle thread is released. As above, the magnet section 1270 acting as the upstream drive section switches between the closed state in which the grip section main body 1261 grips the needle thread and the open state in which the needle thread is released.

Specifically, an explanation is given to operation of the needle thread control section 1230. When the main spindle angle is at the end point of the position control zone, the turning arm 1281 assumes a position of the top dead center (the initial position). Specifically, the hook section 1284 of the turning arm 1281 is situated at an obliquely upward position (a position designated by 1281(A) shown in FIG. 6 and FIG. 7). The leading end of the turning arm 1281 is exposed to the front side of the plate section 1341 from the opening section 1342*b* at the initial position. When a change is made to the needle thread to be selected, the turning arm 1281 is receded. Therefore, the turning arm 1281 is turned to the initial position. On this occasion, the turning arm 1281 is upwardly turned, thereby turning the needle thread to the initial position while remaining in contact with and retaining the needle thread supported by the needle thread supporting member 1288.

When entered the torque control zone, the needle thread motor 1286 is subjected to torque control while the grip section main body 1241 is closed and while the grip section main body 1261 is opened, whereby the needle thread motor 1286 imparts upward rotating force to the turning arm 1281. Thereby, in a state in which the turning arm 1281 is pulling the needle thread J against a direction (a pull-up direction) in which a thread take-up lever (any thread take-up lever to be actuated (hereinafter called an "actuation thread take-up lever") from among the thread take-up levers 12*a*-1 to 12*a*-9) pulls the needle thread J, the actuation thread take-up lever upwardly rotates, thereby pulling up the needle thread J with respect to the process fabric. As the actuation thread take-up lever pulls up the needle thread J (i.e., the actuation thread take-up lever shifts to the top dead center (the other dead center)), the turning arm 1281 rotates in the direction (the downward direction) in which the actuation thread take-up lever pulls the needle thread J.

A torque value set in the needle thread control torque data is set to a value such that, as the actuation thread take-up lever pulls the needle thread J, the turning arm 1281 turns in the direction (the downward direction) in which the actuation thread take-up lever pulls the needle thread J and does not hinder the actuation thread take-up lever from pulling the needle thread J.

When the main spindle angle enters the position control zone, the needle thread motor 1286 is subjected to position control while the grip section main body 1241 is opened and while the grip section main body 1261 is closed, whereupon the turning arm 1281 turns in a direction (an upward direction) in which the needle thread J is pulled. Reference numeral 1281(A) shown in FIG. 6 and FIG. 7 shows a state where the turning arm 1281 turned to its initial position (or a position of origin) as a result of the needle thread motor 286 having returned to the initial position at the end point of the position control zone.

When the torque value is large, the needle thread J is hardly pulled during torque control, so that a stitch is tightly sewn. On the contrary, when the torque value is small, the needle thread J is weakly pulled, so that a corresponding stitch is softly sewn.

As above, in connection with a control zone for each stitch, in a torque control zone including at least a portion of an area from the bottom dead center to the top dead center of the actuation thread take-up lever, that is a zone during which the actuation thread take-up lever, pulls the needle thread with respect to the processed fabric to be sewn with the needle thread, there is performed torque control for imparting rotating force to the turning arm 1281 in accordance with the torque value in such a way that tension is imparted to the needle thread against the direction in which the actuation thread take-up lever, pulls the needle thread, while the grip section main body 1241 is closed and while the grip section main body 1261 is opened, in the meantime, in a position control zone that is at least a portion of the zone other than the torque control zone, there is performed position control for imparting rotating force to the turning arm 1281 in accordance with angular position data pertaining to the needle thread motor 1286 in such a way that the angle of the needle thread motor 1286 returns to its initial angular position which is a rotational position of the needle thread motor 1286, while the grip section main body 1241 is opened and while the grip section main body 1261 is closed, thereby drawing the needle thread from upstream.

Control of the main spindle motor 20 is now described. Control of the main spindle motor 20 is performed in the same manner as in the case of position control of the needle thread motor 1286.

Figure 31:
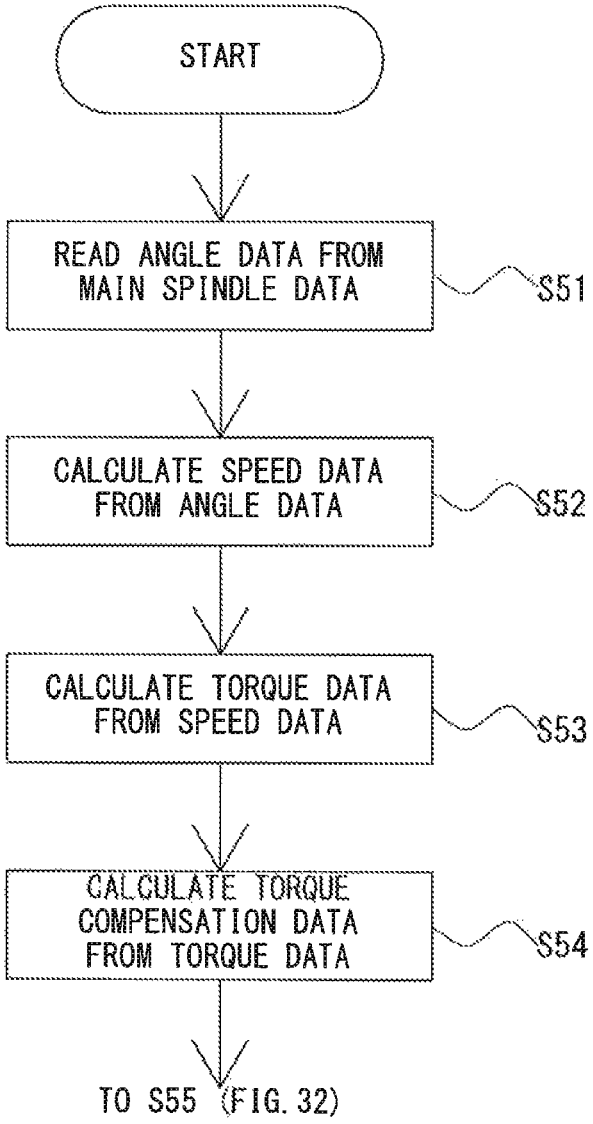
[FIG. 31] It is a flowchart showing a method for controlling the main spindle motor.
Figure 33:
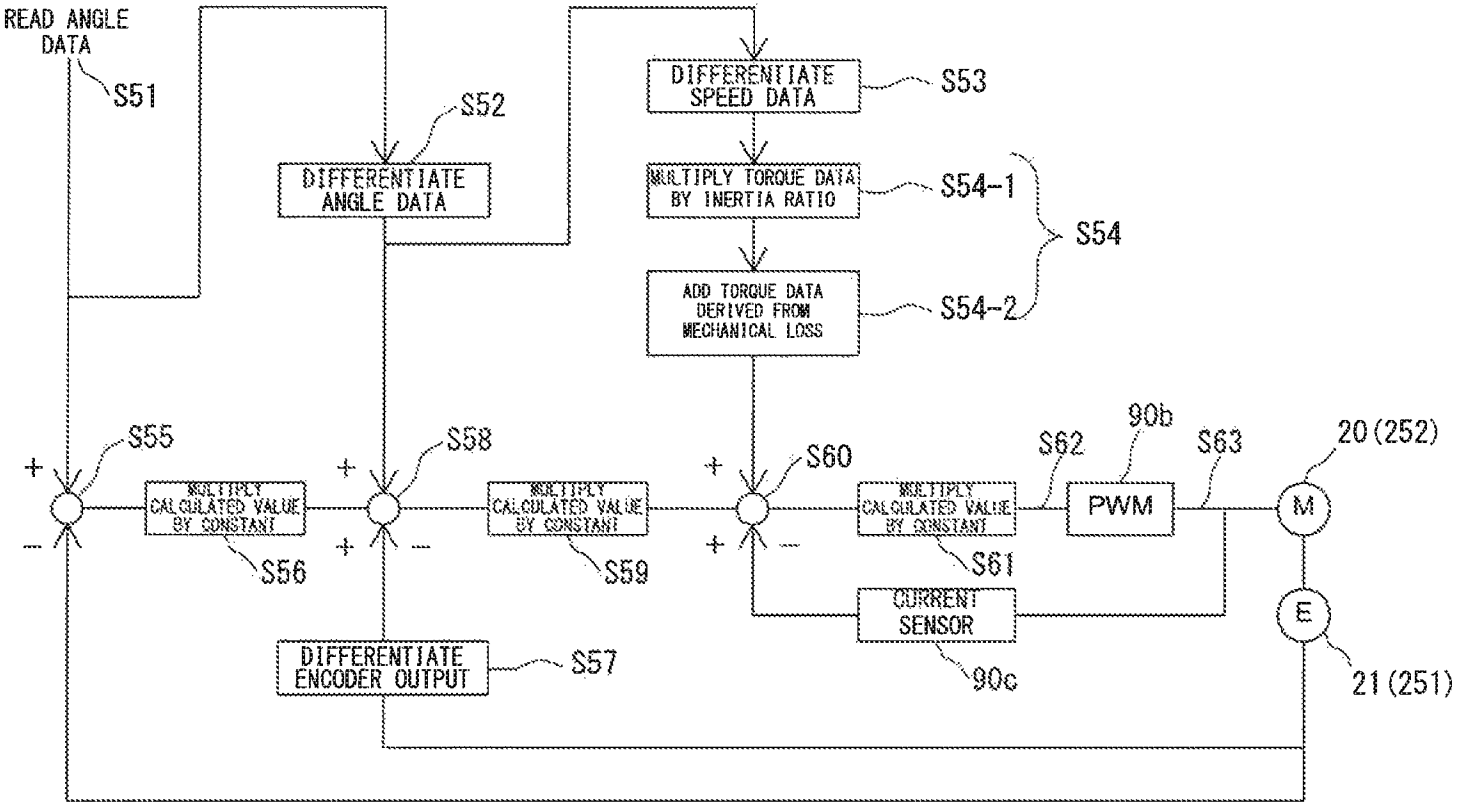
[FIG. 33] It is a functional block diagram showing the method for controlling the main spindle motor.

First, angle data (this can also be taken as position data) are read from the main spindle data (S51 shown in FIG. 31, S51 shown in FIG. 33: a reading step). Specifically, an angle (a main spindle angle) corresponding to a time that is an objective of processing is detected from the main spindle data, and data pertaining to the angle are read.

Next, there is detected an amount of change in the thus-detected main spindle angle per unit time, and speed data are calculated (S52 shown in FIG. 31, S52 shown in FIG. 33: a speed data calculation step). On the occasion of calculation of speed data, the amount of change in angle data is divided by a time, thereby calculating speed data. Namely, the speed data are calculated by differentiating the angle data.

The amount of change in speed data per unit time is detected, thereby calculating torque data (S53 shown in FIG. 31, S53 shown in FIG. 33: a torque data calculation step). On the occasion of calculation of torque data, the amount of change in speed data is divided by a time, thereby calculating torque data. Namely, torque data are calculated by differentiating the speed data. Speed data required to calculate the amount of change in speed are previously retained by the CPU 90*a*.

Torque compensation data are calculated from the torque data calculated in step S53 (S54 shown in FIG. 31, S54 shown in FIG. 33). Specifically, torque data are multiplied by an inertia ratio (S54-1 shown in FIG. 33), and torque derived from a mechanical loss is added to a value determined by multiplying the torque data by the inertial ratio, thereby calculating the torque compensation data (S54-2 shown in FIG. 33). The inertia ratio is a constant previously determined according to a mass of each of the machine elements, or the like. Further, the torque derived from a mechanical loss is a value previously determined in correspondence with each of the machine elements.

Data (a count value of the encoder) output from the encoder 21 are subtracted from the angle data read in step S51 (S55 shown in FIG. 32, S55 shown in FIG. 33: a location deviation calculation step). A value calculated in step S55 can be said to be a value of a location deviation.

The value calculated in step S55 is now multiplied by a predetermined constant, thereby calculating a speed value (S56 shown in FIG. 32 and S56 shown in FIG. 33).

A current motor speed value is calculated by differentiating the output from the encoder 21 (S57 shown in FIG. 32 and S57 shown in FIG. 33). Specifically, an amount of change in encoder count value per unit time is calculated, thereby calculating a current motor speed value.

Next, the current motor speed value calculated in step S57 is subtracted from the speed value calculated in step S56, and the speed data calculated in step S52 are added to a subtraction result (S58 shown in FIG. 32, S58 shown in FIG. 33: a speed deviation calculation step). A value calculated in step S58 can be said to be a value of speed deviation.

The value calculated in step S58 is multiplied by a predetermined constant, thereby calculating a torque value (S59 shown in FIG. 32 and S59 shown in FIG. 33).

The torque value output from the current sensor 90*c* is subtracted from the torque value calculated in step S59. Further, torque compensation data calculated in step S54 are added to a subtraction result (S60 shown in FIG. 32, and S60 shown in FIG. 33: a torque deviation calculation step). The value calculated in step S60 can be said to be a torque deviation value.

The value calculated in step S60 is multiplied by a predetermined constant, thereby calculating a voltage value (a voltage command to the PWM circuit) output to the PWM circuit 90*b* (S61 shown in FIG. 32, S61 shown in FIG. 33). The voltage value is then output to the PWM circuit 90*b* (S62 shown in FIG. 32, and S62 shown in FIG. 33).

The PWM circuit 90*b* outputs a pulse signal as a voltage signal in accordance with an input signal, thereby supplying an electric current to the main spindle motor 20 (S63 shown in FIG. 32, S63 shown in FIG. 33: a current supply step). In the description about the flowcharts of FIG. 31 and FIG. 32 in relation to control of the main spindle motor 20, the PWM circuit 90*b* and the current sensor 90*c* are the PWM circuit 90*b* and the current sensor 90*c* that correspond to the main spindle motor 20.

The shuttle actuation motor 252 is controlled in the same manner as is the main spindle motor 20. Specifically, as in the case with the main spindle motor 20, control is carried out according to flowcharts shown in FIG. 31 and FIG. 32 except use of a middle shuttle angle instead of the main spindle angle. Specifically, in step S51, according to the main spindle data and the shuttle actuation data, a middle shuttle angle corresponding to a time that is an objective of processing is detected from the main spindle data, and data pertinent to the angle is read. More specifically, the main spindle angle is detected from the main spindle data, and a middle shuttle angle corresponding to the thus-detected main spindle angle is detected from the shuttle actuation data. In addition, in step S52, speed data are calculated by detecting an amount of change per unit time in the middle shuttle angle.

In step S55, data (a count value of the encoder) output from the encoder 251 is subtracted from the angle data read in step S51. In step S57, an output from the encoder 251 is differentiated, thereby calculating a value of a current motor speed.

In control of the shuttle actuation motor 252 designated by the flowcharts shown in FIG. 31 and FIG. 32, the PWM circuit 90*b* and the current sensor 90*c* are the PWM circuit 90*b* and the current sensor 90*c* that correspond to the shuttle actuation motor 252.

When the rotary shaft 253 of the shuttle actuation motor 252 is rotated pursuant to operation control of the shuttle actuation motor 252, the support arm 260 is rotated by means of rotation of the rotary shaft 253. The magnet section 270 then rotates in a circumferential direction. Since the magnet section 270 and the magnet section 190 attract each other, the middle shuttle 150 comes to rotate in conjunction with rotation of the magnet section 270. Specifically, since the middle shuttle 150 is a half-turn middle shuttle, the middle shuttle is controlled so as to rotate back and forth within a range of half-turn rotation.

Figure 34:
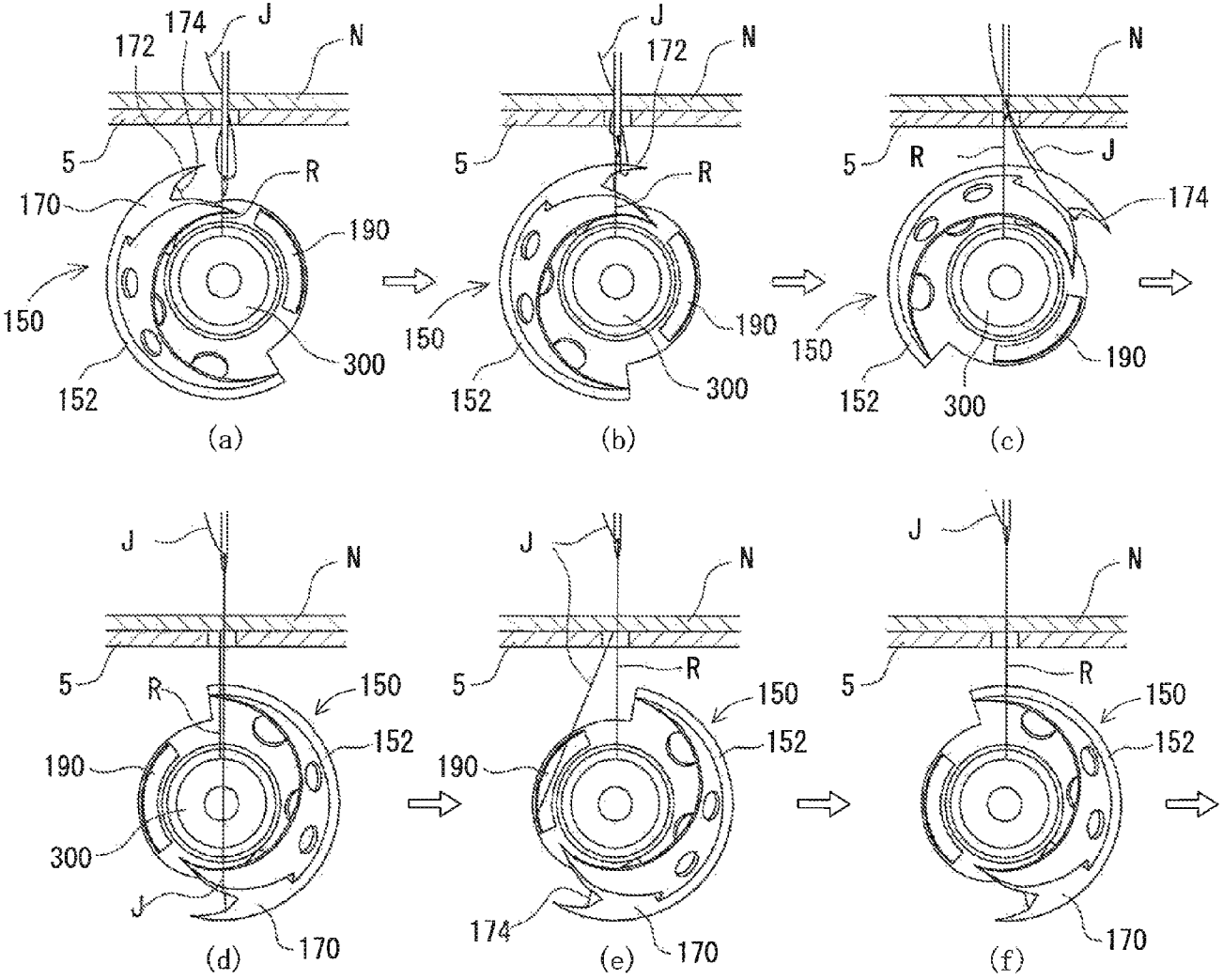
[FIG. 34] It is an explanatory view showing operation of the middle shuttle.
Figure 35:
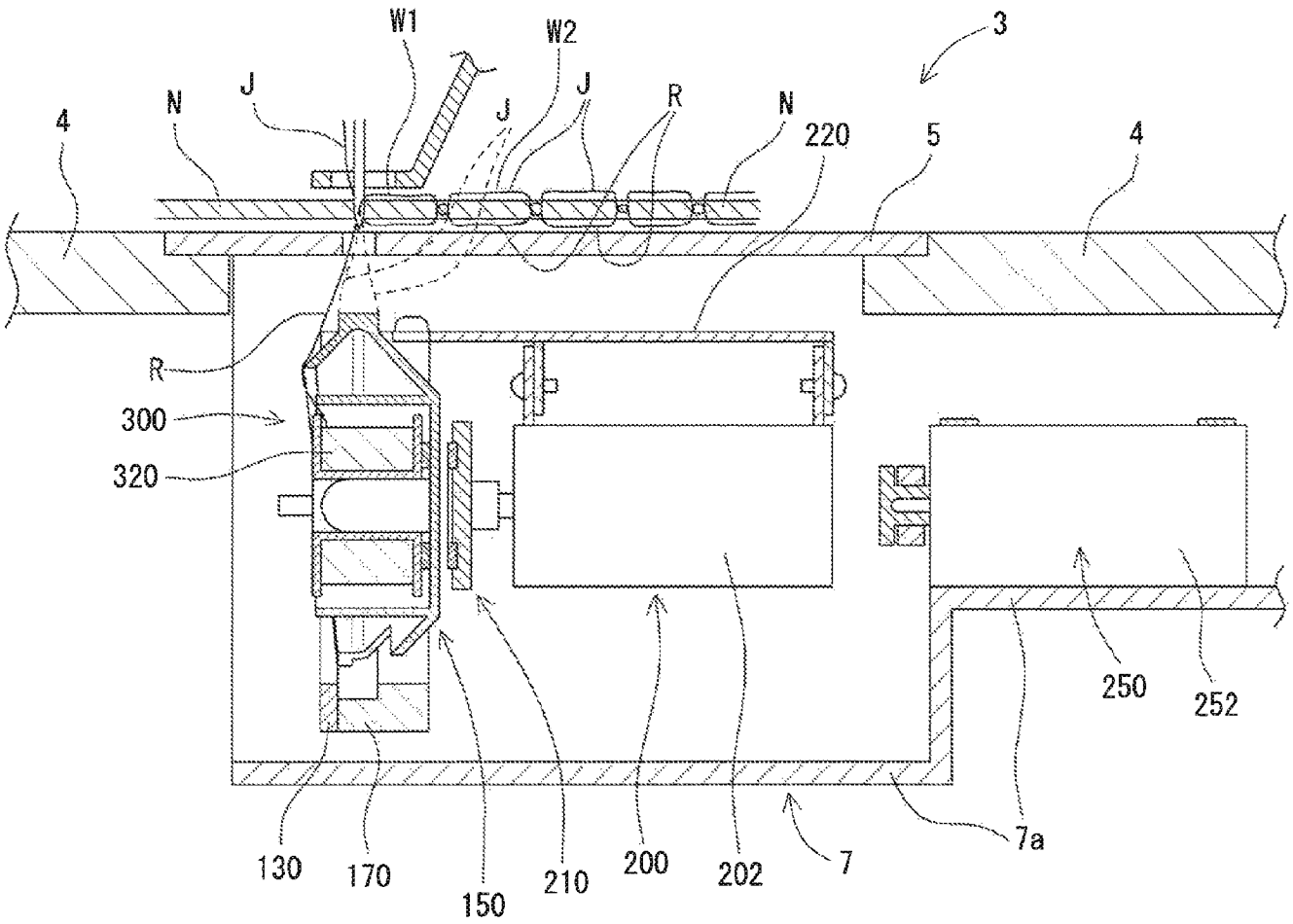
[FIG. 35] It is a longitudinal cross sectional view showing operation of the middle shuttle.

Specific operation of the middle shuttle 150 is now described by reference to FIG. 34. The middle shuttle 150 rotates back and forth between a state where the middle shuttle stays at one end of the rotation range shown in FIG. 34(*a*) and a state where the middle shuttle stays at the other end of the rotation range shown in FIG. 34(*e*). When the middle shuttle makes a right rotation in the state shown in FIG. 34(*a*) when viewed from the front, the point 172 is inserted into the needle thread J as shown in FIG. 34(*b*). FIG. 34(*b*) shows a state in which the thread guard 174 stays at a top dead center (the highest position with respect to the center of rotation). When the middle shuttle 150 makes an additional right rotation when viewed from the front, the needle thread J hooked on the thread guard 174 is pulled as shown in FIG. 34(*c*), to thus come into a state shown in FIG. 34(*e*) by way of a state shown in FIG. 34(*d*). FIG. 34 (*d*) shows a case where the thread guard 174 stays at a bottom dead center (the lowest position with respect to the center of rotation). When the state shown in FIG. 34 (*e*) is achieved, the sewing frame is actuated, and the thread take-up lever 22*a* simultaneously ascends, whereby the needle thread J hooked on the thread guard 174 is upwardly pulled and sewed along with the bobbin thread R. Incidentally, FIG. 35 is a drawing corresponding to FIG. 34(*c*).

During the operation, one end of the looped needle thread J passes by the rear side of the rear-side body 162 (see FIG. 34 (*d*)). Since space exists between the rotary disc 210 and the rear-side body 162 of the middle shuttle 150, the needle thread is not obstructed when passing by the rear side of the rear-side body 162.

FIG. 37 shows a motion diagram for a period of one stitch pertaining to the middle shuttle, the needle bar, and the thread take-up lever. Positions denoted by (a) in FIG. 37 correspond to the state shown in FIG. 34(*a*). Positions denoted by (b) in FIG. 37 correspond to the state shown in FIG. 34(*b*). Positions denoted by (d) in FIG. 37 correspond to the state shown in FIG. 34 (*d*). Positions denoted by (e) in FIG. 37 correspond to the state shown in FIG. 34 (*e*). The sewing frame 22*d* moves at least when the needle bar is positioned above the position of the throat plate.

When the bobbin 300 is replaced on occasion of use of the embroidery sewing machine 1205, the bobbin 300 is held in the bobbin accommodation section 180 by means of attractor force of the magnet section 310 and the magnet section 214. Therefore, the bobbin 300 is withdrawn against the attractor force stemming from the middle shuttle presser 130. Further, in order to let the bobbin accommodation section 180 accommodate a new bobbin 300, the bobbin 300 is put into the bobbin accommodation section 180 from the direction of the middle shuttle presser 130. The magnet section 310 and the magnet section 214 resultantly attract each other, whereby the bobbin 300 can be readily put into the bobbin accommodation section 180.

As mentioned above, the sewing machine of the embodiment can control a magnitude of tension exerted on the needle thread and the bobbin thread according to the needle thread control torque data and the bobbin thread control torque data stored in the memory device 92. In particular, the needle thread control torque value in the needle thread control torque data and the bobbin thread control torque value in the bobbin thread control torque data are specified on a per-stitch basis. Therefore, tension exerted on the needle thread and the bobbin thread can be controlled on a per-stitch basis. Thus, a stitch hardness can be controlled on a per-stitch basis. In each of the sewing units 1206, needle thread tension and bobbin thread tension are controlled according to the needle thread control torque data and the bobbin thread control torque data stored in the memory device 92. As a consequence, each of the sewing units 1206 (which can also be the heads 1207) can embellish process fabric with the same embroidery. Thus, the sameness of embroideries made by the respective sewing units 1206 (which can also be the heads 1207) can be considerably enhanced. In other words, in each of the sewing units 1206 of the sewing machine 1205, the tension exerted on the needle thread and the bobbin thread is controlled according to the needle thread control torque data and the bobbin thread control torque data stored in the memory device 92, whereby each of the sewing units controls the tension according to the same torque data. Accordingly, each of the sewing units can make the same broidery, and the sameness of embroideries made by the respective sewing units (in other words, the heads) can be considerably enhanced.

Even in the plurality of sewing machines 1205, the needle thread control torque data stored in the memory device 92 are made identical, and the bobbin thread control torque data stored in the memory device 92 are made identical. Thus, each of the sewing machines can embellish the process fabric with the same embroidery. The sameness of embroideries made by the respective sewing machines can be considerably enhanced.

Figure 47:
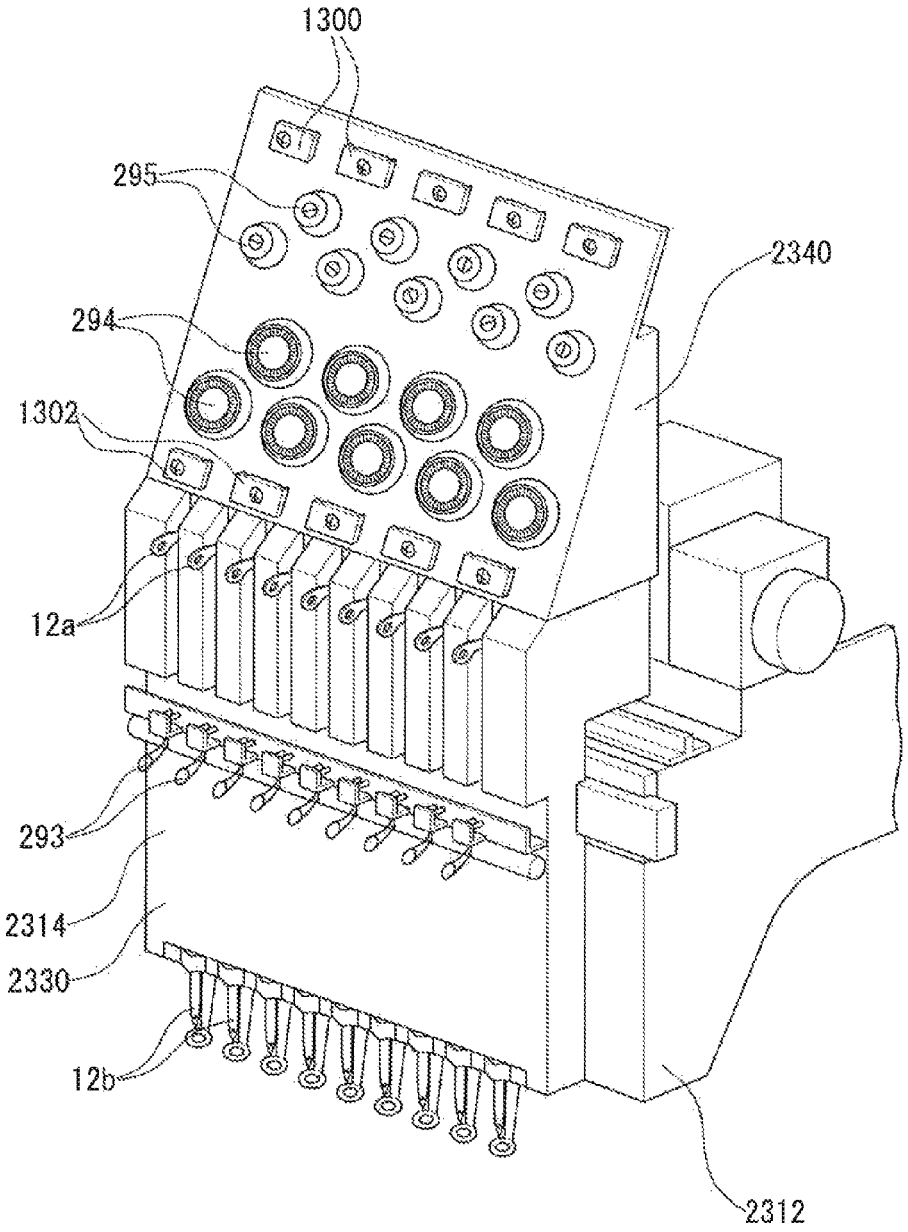
[FIG. 47] It is a forward perspective view showing the related-art sewing machine.

The needle thread control section 1230 is provided in lieu of the tension disc, the rotary tension component, and the tension spring of the related-art sewing machine (see FIG. 47). Thereby, the grip section main body 1241 becomes open in the position control zone where the needle thread J is drawn. Only the pretension component 296 is present at an upstream position with respect to the turning arm 1281 of the turning section 1280, and friction resistance does not exist between the tension disc and the rotary tension component. Moreover, since the grip section main body 1261 becomes closed, movements of the thread take-up lever will not pose any problems at the time of drawing of the needle thread. Consequently, the needle thread can be smoothly drawn from the thread roll, and the possibility of occurrence of a thread break can be reduced.

If a break has occurred in the needle thread, upward pulling of the turning arm 1281, which would otherwise occur when the thread take-up lever moves to the top dead center, is prevented in the torque control zone. Specifically, the turning arm 81 will not be pulled in a direction opposite to the direction in which the rotating force of the needle thread motor 1286 is imparted. Therefore, occurrence of a thread break can be detected by means of detecting that the turning arm 1281 is not pulled upward. Further, when there is not a thread break, the turning arm 1281 is pulled upward in the torque control zone, so that occurrence of a thread break can be detected accurately.

In the position control zone, a current position of the needle thread motor 1286 is detected, and angle correspondence data for controlling the position of the needle thread motor 1286 to its initial position are generated. Since there is performed control for returning the needle thread motor 1286 to its initial position through position control in accordance with the angle correspondence data, the needle thread can be drawn, in the torque control zone, by only the amount corresponding to a quantity of thread consumed as a result of pulling of the turning arm 1281. Hence, an excess or deficiency of the quantity of accumulated thread, which would otherwise be caused by drawing a needle thread, will not arise.

Further, the tension of the bobbin thread R is controlled by means of the magnet section 214 attached to the rotary disc 210 whose rotation is controlled by the bobbin thread motor 202 and the magnet section 310 of the bobbin 300. When compared with the case where tension is controlled by means of the friction between the bobbin thread and another member, tension control can be performed more accurately.

The tension imparted to the bobbin thread R is controlled by means of a value of the electric current applied to the bobbin thread motor 202. The bobbin thread tension is proportional to a current value; hence, bobbin thread tension can be elaborately controlled by elaborate control of the current value.

Since the middle shuttle 150 has the bobbin accommodation section 180, the bobbin 300 accommodated in the bobbin accommodation section 180 remains stably accommodated in the bobbin accommodation section 180 as a result of the magnet section 310 being attracted by the magnet section 214 of the rotary disc 210. Therefore, there is no necessity to additionally provide the middle shuttle 150 with a mechanism for attaching a bobbin. In the present embodiment, the bobbin 300 can be readily removably attached to the bobbin accommodation section 180. Specifically, the bobbin 300 can be easily accommodated in the bobbin accommodation section 180 by means of the attractor force of the magnet section 310 and the magnet section 214.

In the sewing machine 1205 of the present embodiment, the middle shuttle 150 is actuated by means of the corresponding shuttle actuation section 250, and the magnet section 270 and the magnet section 190 attract each other. The middle shuttle 150 rotates in conjunction with circumferential rotation of the magnet section 270; hence, actuation sound stemming from actuation of the middle shuttle can be lessened.

Although the middle shuttle has been described as a half-turn type in the above descriptions, the middle shuttle can also be configured as a full-turn type.

Figure 39:
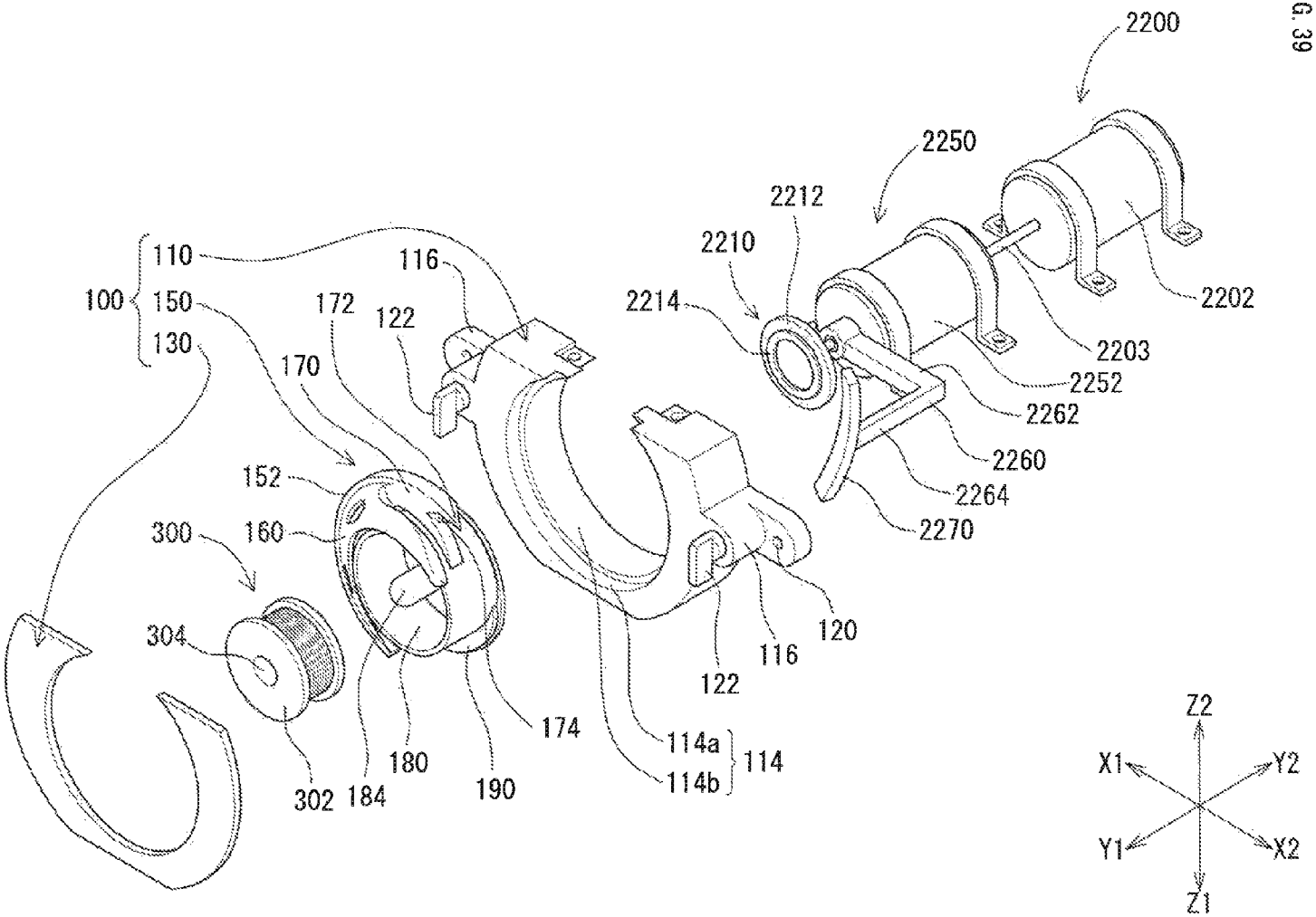
[FIG. 39] It is a forward exploded perspective view of a shuttle, a bobbin thread tension control mechanism section, a shuttle actuation section, and a bobbin employed in the case of a full-turn middle shuttle.

Specifically, in the case of a full-turn middle shuttle, the middle shuttle is configured as shown in FIG. 39; the shuttle 100, a bobbin thread tension control mechanism section 2200, and a shuttle actuation section 2250 are configured as shown in FIG. 39. The shuttle 100 is analogous, in terms of a configuration, to its counterpart shuttle 100 whose configuration is shown in FIG. 9 to FIG. 13.

The bobbin thread tension control mechanism section 2200 has a bobbin thread motor (which can also be a bobbin thread tension control motor) 202 and a rotary disc 2210 to be attached to a rotary shaft 2203 of the bobbin thread motor 2202.

The bobbin thread motor 2202 is configured so as to be rotatable forwardly and backwardly such that an axis line core of the rotary shaft 2203 (an axis line passing through the rotating center) (which may also be called an axial center core) is aligned to an axis line (an axis line passing through the rotating center) (which may also be called an axial center core) of the shaft 184 in the middle shuttle 150. In contrast with the configuration shown in FIG. 9 to FIG. 13, the bobbin thread motor 2202 is disposed at a rear surface of a shuttle actuation motor 2252. The rotary shaft 2203 of the bobbin thread motor 2202 is made so as to become longer than the rotary shaft 203 of the configuration shown in FIG. 9 to FIG. 13. The rotary shaft 2203 runs through an insert hole formed in the shuttle actuation motor 2252 and a tubular rotary shaft of the shuttle actuation motor 2252, to thus project to the front side of the shuttle actuation motor 2252. The bobbin thread motor 2202 is anchored to the shuttle base.

The rotary disc 2210 is analogous, in configuration, to the rotary disc 210 of the configuration shown in FIG. 9 to FIG. 13. The rotary disc 2210 has a circular plate-like rotary disc body 2212 and a ring-shaped magnet section (a second magnet section) 2214 attached to a front-side surface of the rotary disc body 2212. The rotary disc body 2212 is analogous, in configuration, to the rotary disc body 212 of the configuration shown in FIG. 9 to FIG. 13. The magnet section 2214 is also analogous, in configuration, to the magnet section 214 of the configuration shown in FIG. 9 to FIG. 13. Accordingly, their repeated, detailed explanations are omitted for brevity. A tubular portion analogous, in configuration, to the tubular portion 216 of the configuration shown in FIG. 9 to FIG. 13 is disposed on the rear surface of the rotary disc body 2212. The tubular portion is axially supported on and tightened to the rotary shaft 2203 of the bobbin thread motor 2202. In this regard, in a state in which the shuttle 100 and the bobbin thread tension control mechanism section 2200 are anchored to the shuttle base, the magnet section 2214 of the rotary disc 2210 remains in close proximity to, at spacing, a rear surface of a rear-side body 162 of the middle shuttle 150 placed in the outer shuttle 110.

Each of the shuttle actuation sections 2250 includes the shuttle actuation motor 2252, an support arm 2260 axially supported on a rotary shaft of the shuttle actuation motor 2252, and a magnet section 2270 (a fourth magnet) placed at an extremity of the support arm 2260.

The shuttle actuation motor 2252 is made in a tubular shape, and a columnar insert hole is opened in the shuttle actuation motor 2252 along its axial line. The rotary shaft of the shuttle actuation motor 2252 is also made in a tubular shape, and the axial line (an axis line passing through the rotating center) (or referred to also as an "axial center core") of the rotary shaft of the shuttle actuation motor 2252 is aligned to the axial line (an axis line passing through the rotating center) (or referred to also as an "axial center core") of the rotary shaft 1203 of the bobbin thread tension control motor 2202 and the axial line (an axis line passing through the rotating center) (or referred to also as an "axial center core") of the middle shuttle 150. The shuttle actuation motor 2252 is also anchored to the shuttle base in much the same way as the bobbin thread motor 1202. Since the middle shuttle 150 is of a full turn type, a unidirectional turn suffices for the shuttle actuation motor 2252. However, the shuttle actuation motor may also be configured so as to turn forwardly and backwardly.

The support arm 1260, assuming a substantial shape of the letter L as a whole, has a substantially rod-shaped base end 2262 and a leading end 2264 continually extending from an extremity of the base end 2262. The base end 2262 is disposed at a direction orthogonal to an axial line of the rotary shaft of the shuttle actuation motor 2252. The leading end 2264 is disposed parallel to the axial line of the rotary shaft of the shuttle actuation motor 2252. A length of the base end 2262 is set such that the leading end 2264 does not contact the rotary disc 2210 and that the magnet section 2270 attached to the extremity of the leading end 2264 is situated at a rear surface (i.e., in its rearward direction) of the magnet section 190. Likewise, a length of the leading end 2264 is also set such that the magnet section 2270 comes close to the rear side of the rear-side tapered portion 164.

The magnet section 2270 is analogous, in configuration, to the magnet section 270 of the configuration shown in FIG. 9 to FIG. 13 and assumes the shape of a fan-shaped plate. The magnet is curved in agreement with the geometry of the rear surface of the rear-side tapered portion 164, so as to come as closely as possible to the rear surface of the rear-side tapered portion 164 of the middle shuttle 150.

The magnet section 2270 and the magnet section 190 are configured so as to attract each other. When a surface of the magnet section 2270 facing the rear-side tapered portion 164 of the middle shuttle 150 exhibits either the N pole or the S pole, a surface of the magnet section 190 facing the rear-side tapered portion 164 is set so as to assume the remaining pole. By means of the configuration, a rotary shaft of the shuttle actuation motor 2252 is rotated as a result of actuation of the shuttle actuation motor 2252. Rotation of the rotary shaft in turn induces rotation of the support arm 2260, whereupon the magnet section 2270 makes a circumferential rotation. Since the magnet section 2270 and the magnet section 190 attract each other, the middle shuttle 150 rotates in conjunction with rotation of the magnet section 2270.

The bobbin thread tension control mechanism section 2200 and the shuttle actuation section 2250 are configured as mentioned above. In particular, the bobbin thread tension control motor 2202 is disposed at a rear surface (i.e., in its rearward direction) of the shuttle actuation motor 1252. Further, a surrounding area of the rotary disc 1210 is opened, and hence the support arm 2260 can make a full rotation.

The embroidery sewing machine of the embodiment is analogous to its counterpart described in connection with the configuration shown in FIG. 9 to FIG. 13 except the bobbin thread tension control mechanism section 2200 and the shuttle actuation section 2250 (e.g., the shuttle 100 and the bobbin 300 are identical, in configuration, to their counterparts described in connection with the configuration shown in FIG. 9 to FIG. 13), and hence their detailed explanations are omitted here for brevity.

Operation of the sewing machine using the configuration shown in FIG. 39 is analogous to operation of the sewing machine using the configuration shown in FIG. 9 to FIG. 13, and hence its repeated, detailed explanation is omitted.

When the rotary shaft of the shuttle actuation motor 2252 is rotated pursuant to operation control of the shuttle actuation motor 2252, the support arm 2260 is rotated by means of rotation of the rotary shaft. The magnet section 2270 then rotates in a circumferential direction. Since the magnet section 2270 and the magnet section 190 attract each other, the middle shuttle 150 comes to rotate in conjunction with rotation of the magnet section 2270. Specifically, since the middle shuttle 150 of the configuration shown in FIG. 39 is a full-turn middle shuttle, the shuttle actuation motor 2252 rotates in one direction.

The middle shuttle 150 performs specific operations as shown in FIGS. 34 (*a*) to 34 (*e*). Subsequently, the middle shuttle 150 rotates in one direction, to thus come to a state shown in FIG. 34 (*a*). The middle shuttle makes an additional rotation without hooking the needle thread, to thus enter the state shown in FIG. 34(*a*). Thus, operation for one stitch is performed.

Figure 40:
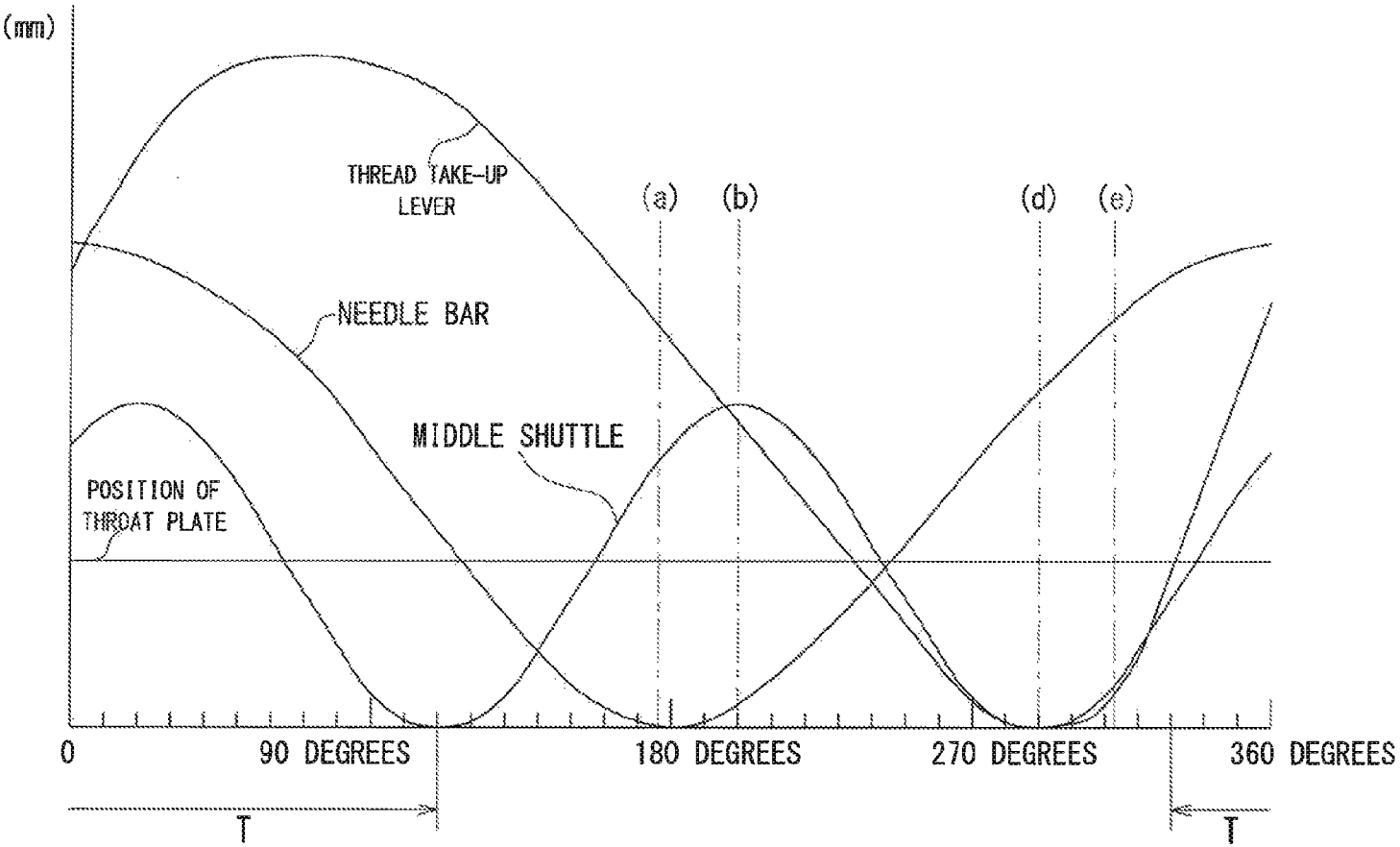
[FIG. 40] It is an explanatory view showing operation of the sewing machine performed in the case of the full-turn middle shuttle.

FIG. 40 shows a motion diagram for a period of one stitch pertaining to the middle shuttle, the needle bar, and the thread take-up lever, and the middle shuttle 150 makes two rotations during a period of one stitch. Positions denoted by (a) in FIG. 40 correspond to the state shown in FIG. 34 (*a*). Positions denoted by (b) in FIG. 40 correspond to the state shown in FIG. 34 (*b*). Positions denoted by (d) in FIG. 40 correspond to the state shown in FIG. 34(*d*). Positions denoted by (e) in FIG. 40 correspond to the state shown in FIG. 34(*e*). The sewing frame 12*d* moves at least when the needle bar is positioned above the position of the throat plate.

When the rotary shaft 2203 of the bobbin thread motor 2202 rotates according to control operation of the bobbin thread motor 2202, the rotary disc 2210 rotates, and the magnet section 1270 then rotates. When the magnet section 2214 rotates, the N poles and the S poles of the magnet section 2214 and the magnet section 310 attract each other, whereupon the bobbin 300 also rotates.

A method for controlling operation of the bobbin thread motor 2202 includes rotating the rotary disc 2210 in a direction opposite to a direction of rotation (i.e., the forward direction) of the bobbin 300 achieved when the bobbin thread R is withdrawn as in the case with the configuration shown in FIG. 9 to FIG. 13, whereby the knot between the needle thread J and the bobbin thread R can be strongly tightened.

In other words, timing at which the torque of the bobbin thread motor 2202 is to be controlled is set to; for instance, the period T (see FIG. 40) from when the sewing needle has penetrated through process fabric until when the sewing needle reaches a position past the top dead center of the thread take-up lever (or the top dead center) as in the case of the sewing machine 1205 using the configuration shown in FIG. 9 to FIG. 13; at least, the period from a substantial intermediate point between the bottom dead center to the top dead center of the thread take-up lever until the top dead center of the thread take-up lever. Specifically, it is possible to produce tighter finished embroidery by means of increasing a torque value for torque control of the bobbin thread motor 2202 during the period. In the meantime, it is also possible to produce soft finished embroidery by reducing the torque value for torque control of the bobbin thread motor 2202 during the period.

[Second Embodiment]

A sewing machine of a second embodiment is now described. The sewing machine of the second embodiment is analogous in configuration to that described in connection with the first embodiment. In the second embodiment, however, the sewing machine is different in that a needle thread torque table and a bobbin thread torque table 92*e* (hereinafter called a "torque table 92*e*") is provided; that needle thread control torque data and bobbin thread control torque data are generated for each stitch according to the embroidery data 92*a* and the torque table 92*e*; and that needle thread control and bobbin thread control are performed according to the thus-generated needle tread control torque data and the bobbin thread control torque data.

Figure 41:
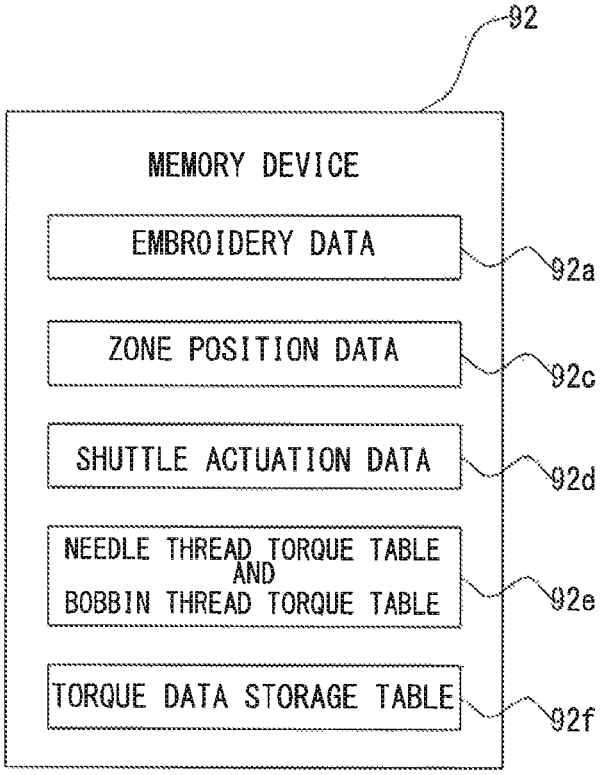
[FIG. 41] It is an explanatory view showing a configuration of the memory device.

In short, as shown in FIG. 41, the memory device (storage section) 92 stores the embroidery data 92*a*, the zone position data 92*c*, the shuttle actuation data 92*d*, the torque data 92*e*, and a torque data storage table 92*f*.

Since the embroidery data 92*a* are analogous in configuration to the embroidery data 92*a* of the first embodiment, and hence their detailed explanations are omitted here. The embroidery data 92*a* are input from the outside by way of the input-output device 94 and stored in the memory device 92.

Moreover, the zone position data 92*c* have a configuration similar to that of the zone position data 92*c* described in connection with the first embodiment. The shuttle actuation data 92*d* have a configuration similar to that of the shuttle actuation data 92*d* described in connection with the first embodiment, and hence their detailed explanations are omitted here.

As show in FIG. 42, the torque table 92*e* also specifies needle thread control torque values and bobbin thread control torque values that correspond to combinations of a stitch width (in other words, a values of a stitch width), a stitching direction (in other words, a value representing a stitching direction), and a thread type. In this regard, the needle thread torque data are made up of the combinations of a stitch width, a stitching direction, and a thread type and corresponding needle thread control torque values. The bobbin thread torque data are made up of combinations of a stitch width, a stitching direction, and a thread type and corresponding bobbin thread control torque values. The torque table 92*e* is previously stored in the memory device 92 by way of the input-output device 94. Specifics of the torque table 92*e* to be stored in the memory device 92 by the input-output device 94 can also be switched as required.

Figure 43:
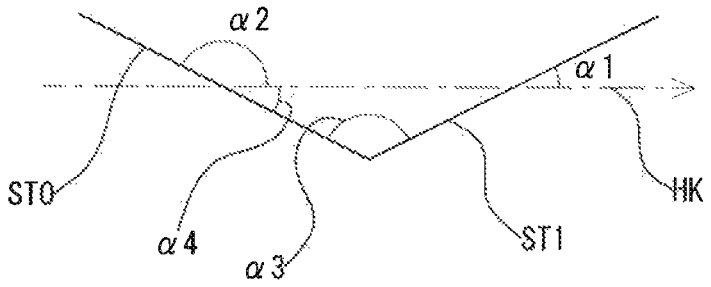
[FIG. 43] It is an explanatory view for illustrating a stitching direction achieved in the needle thread torque table and the bobbin thread torque table.
Figure 44:
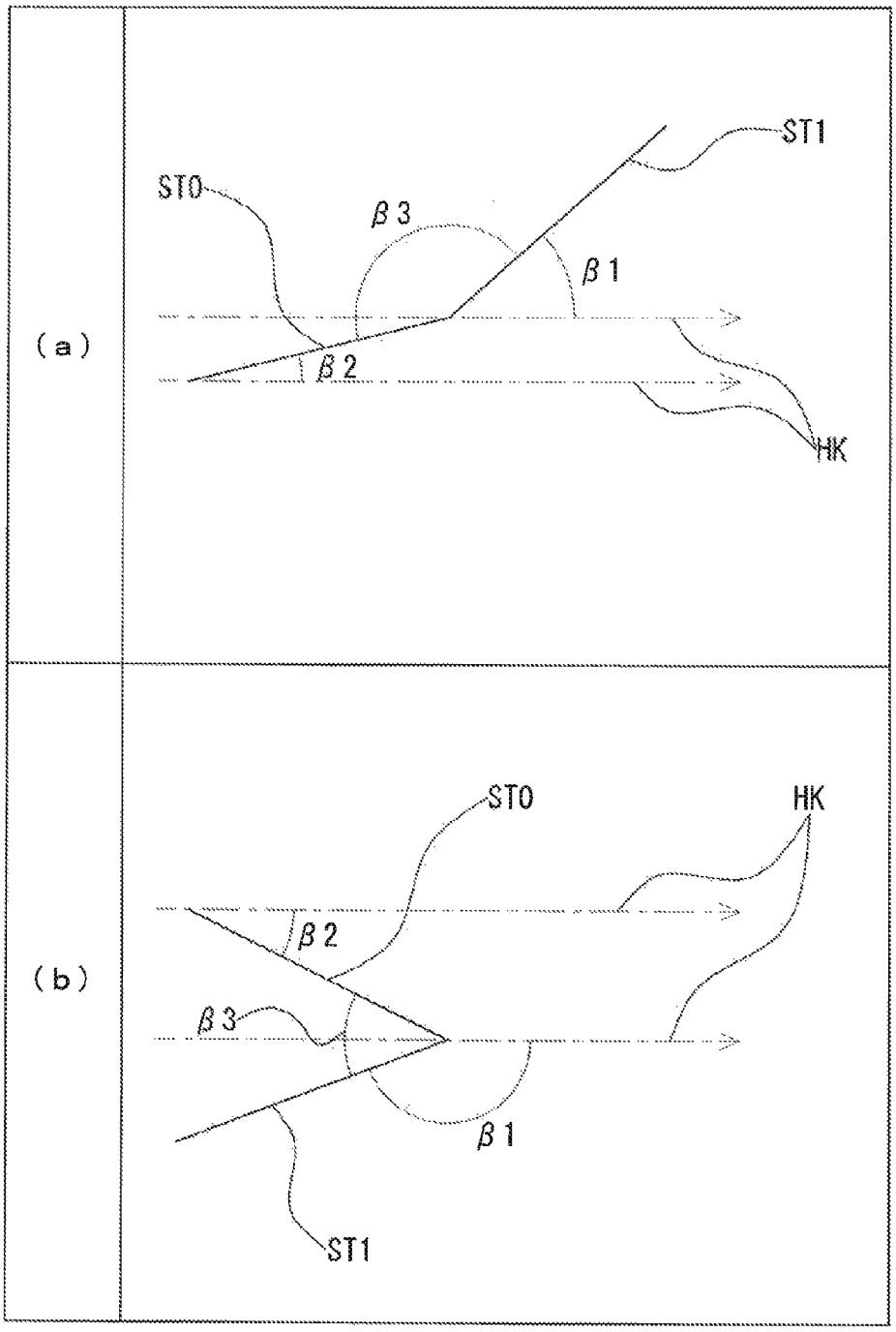
[FIG. 44] It is an explanatory view for illustrating a stitching direction achieved in the needle thread torque table and the bobbin thread torque table.

The stitching direction in the torque table 92*e* is a value based on a direction of a stitch. Specifically, the stitching direction is a value that represents a relationship between a direction of a stitch to be controlled and a direction of a stitch immediately preceding the current stitch to be controlled. More specifically, the stitching direction is a value of a difference between an angle of a direction of a current stitch (a stitch to be controlled) and an angle of a direction of a preceding stitch (a stitch immediately preceding the stitch to be controlled). An angle of a stitching direction is an angle between an angle of a current stitch and an angle of a predetermined direction in the horizontal direction. As shown in FIG. 43, for instance, an angle of a direction of a current stitch ST1 is angle $\alpha 1$ (a positive value) between the current stitch ST1 and a predetermined direction HK. An angle of a direction of a preceding stitch ST0 is $\alpha 4$ (a negative value). A value of an angular difference ($\alpha 1-\alpha 4$) determined by subtracting the angle $\alpha 4$ from the angle $\alpha 1$ represents a stitching direction. In addition, in an example shown in FIG. 44(*a*), an angle of the direction of the current stitch ST1 is angle $\beta 1$ (a positive value). An angle of a direction of the preceding stitch ST0 is $\beta 2$ (a positive value). A value of an angular difference ($\beta 1-\beta 2$) determined by subtracting the angle $\beta 2$ from the angle $\beta 1$ represents a stitching direction. In an example shown in FIG. 44 (*b*), an angle of the direction of the current stitch ST1 is angle $\beta 1$ (a negative value). An angle of a direction of the preceding stitch ST0 is $\beta 2$ (a negative value). A value of an angular difference ($\beta 1-\beta 2$) determined by subtracting the angle $\beta 2$ from the angle $\beta 1$ represents a stitching direction. To be specific, the stitching direction in the torque table 92*e* corresponds to data pertinent to an angular difference (an angular difference in the stitching direction) between the current stitch and the preceding stitch (the stitch immediately preceding the stitch to be controlled). In this sense, when a value determined by subtracting an angle value of the preceding stitch from an angle value of the current stitch is negative, an absolute value of the negative value is adopted. A value of a difference between an angle of a direction of the stitch to be controlled and an angle of a direction of the stitch immediately preceding the stitch to be controlled corresponds to a "value representing a relationship between the direction of the stitch to be controlled and the direction of the stitch immediately preceding the stitch to be controlled." A value of an angular difference is based on a value of an angle representing a stitching direction and accordingly can be said to correspond to a "value based on a stitching direction." Incidentally, the value of the angular difference can also be simply a value determined by subtracting an angle of the preceding stitching direction from an angle of the current stitching direction rather than an absolute value. Alternatively, an angle between the direction of the current stitch and the direction HK of the stitch ST0 can be taken as the angle $\alpha 2$, and an absolute value of a value determined by subtracting the angle $\alpha 2$ from the angle $\alpha 1$ (i.e., a value of the angle $\alpha 3$ that the stitch ST0 forms with the stitch ST1) can also be taken as a stitching direction.

An angle that a preceding stitch forms with a current stitch rather than an angular difference between stitching directions can also be taken as a stitching direction in the torque table 92*e*. In the case of an angle shown in FIG. 43, the angle $\alpha 3$ is an angle which the preceding stitch forms with the current stitch. In the case shown in FIGS. 44(*a*) and (*b*), the angle $\beta 3$ corresponds to an angle which the preceding stitch forms with the current stitch. The angle which the preceding stitch forms with the current stitch can be said to correspond to a "value representing a relationship between the direction of a stitch to be controlled and a direction of a stitch immediately preceding the stitch to be controlled." Further, since the angle is based on a value of an angle representing a stitching direction, the value can be said to correspond to a "value based on a stitching direction."

In the torque table 92*e*, in the case of a large stitch width, tightening of the needle thread must be augmented; therefore, the torque value is specified as a large value (the torque value is specified as a small value in the case of a small stitch width). Moreover, in relation to the stitching direction, when a large angular difference exists between a current stitching direction and a preceding stitching direction, tightening of the needle thread is originally hard, and consequently the torque value is specified as a small value (when a small angular difference exists between the current stitching direction and the preceding stitching direction, the torque value is specified as a large value). Furthermore, when a thread has a large thickness, the tightening of the needle thread must be augmented; therefore, the torque value is specified to a large value (when the thread has a small thickness, the torque value is specified as a small value). In relation to an angular difference between a current stitching direction and a preceding stitching direction, when a value determined by subtracting a value of a preceding stitch angle from a value of a current stitch angle rather than an absolute value is merely taken as a stitching direction, a torque value is specified in accordance with the absolute value. Namely, in the case of a large absolute value, a torque value is made small. In contrast, in the case of a small absolute value, the torque value is made large.

The torque table 92*e* specifies needle thread control torque values and bobbin thread control torque values that conform to combinations of a stitch width, a stitching direction, and a thread type. However, a needle thread torque table that specifies needle thread control torque values corresponding to combinations of a stitch width, a stitching direction, and a thread type and a bobbin thread torque table that specifies bobbin thread control torque values corresponding to combinations of a stitch width, a stitching direction, and a thread type can also be configured separately from each other.

The torque data storage table 92*f* corresponds to the needle thread control torque data and the bobbin thread control torque data 92*b* in which the needle thread control torque values and the bobbin thread control torque values are not stored. As a result of the needle thread control torque values and the bobbin thread control torque values being stored in the torque data storage table 92*f*, needle thread control torque data and bobbin thread control torque data, such as those shown in FIG. 18, are obtained. The torque data storage table 92*f* is previously stored in the memory device 92 by way of the input-output device 94.

In this respect, a storage medium that stores the data can also be used while connected to the input-output device 94 in lieu of the memory device 92 rather than the memory device 92 storing the embroidery data 92*a*, the zone position data 92*c*, the shuttle actuation data 92*d*, the torque table 92*e*, and the torque data storage table 92*f*. In short, the data are read directly from the storage medium. To be specific, in this case, the storage medium functions as a "storage section for storing a torque table that specifies needle thread control torque values and bobbin thread control torque values corresponding to combinations of a value of stitch width and a value based on a stitching direction (a value that represents a stitching direction shown in FIG. 42)."

The control circuit 90 generates needle thread control torque data and bobbin thread control torque data (see FIG. 18) according to the embroidery data 92*a* and the torque table 92*e*. In the needle thread torque control zone, the needle thread motor 1286 is subjected to torque control according to the thus-generated needle thread control torque data. Moreover, the control circuit 90 generates angle correspondence data, such as those shown in FIG. 28, in the position control zone and subjects the needle thread motor 1286 to position control according to the angle correspondence data.

In a zone ranging from the end point of the position control zone to the end point of the torque control zone, the control circuit 90 controls the magnet sections 1250 and 1270 so as to close the upstream grip section 1240 and open the downstream grip section 1260. In the meantime, in a zone ranging from the end point of the torque control zone to the end point of the position control zone, the control circuit 90 controls the magnet sections 1250 and 1270 so as to open the upstream grip section 1240 and close the downstream grip section 1260.

The control circuit 90 controls the shuttle actuation motor 252 according to the generated main spindle data and the shuttle actuation data (refer to FIG. 20). In the bobbin thread torque control zone (the torque control zone is prescribed by zone position data shown in FIG. 19), the control circuit 90 subjects the bobbin thread motor 202 to torque control according to the generated bobbin thread control torque data.

The control circuit 90 is analogous to its counterpart control circuit 90 described in connection with the first embodiment in view of the other configuration, and hence its detailed explanations are omitted.

The sewing machine described in connection with the second embodiment is analogous, in view of the configuration other than those described in connection with the second embodiment, to the sewing machine described in connection with the first embodiment and hence its detailed explanations are omitted.

Operation of the sewing machine of the second embodiment is now described. The operation of the sewing machine described in connection with the second embodiment is analogous to the sewing machine described in connection with the first embodiment but differs in that the needle thread control torque data and the bobbin thread control torque data (see FIG. 18) are generated in accordance with the embroidery data 92*a* and the torque table 92*e* and that needle thread control and bobbin thread control are performed according to the thus-generated needle thread control torque data and the bobbin thread control torque data.

Figure 45:
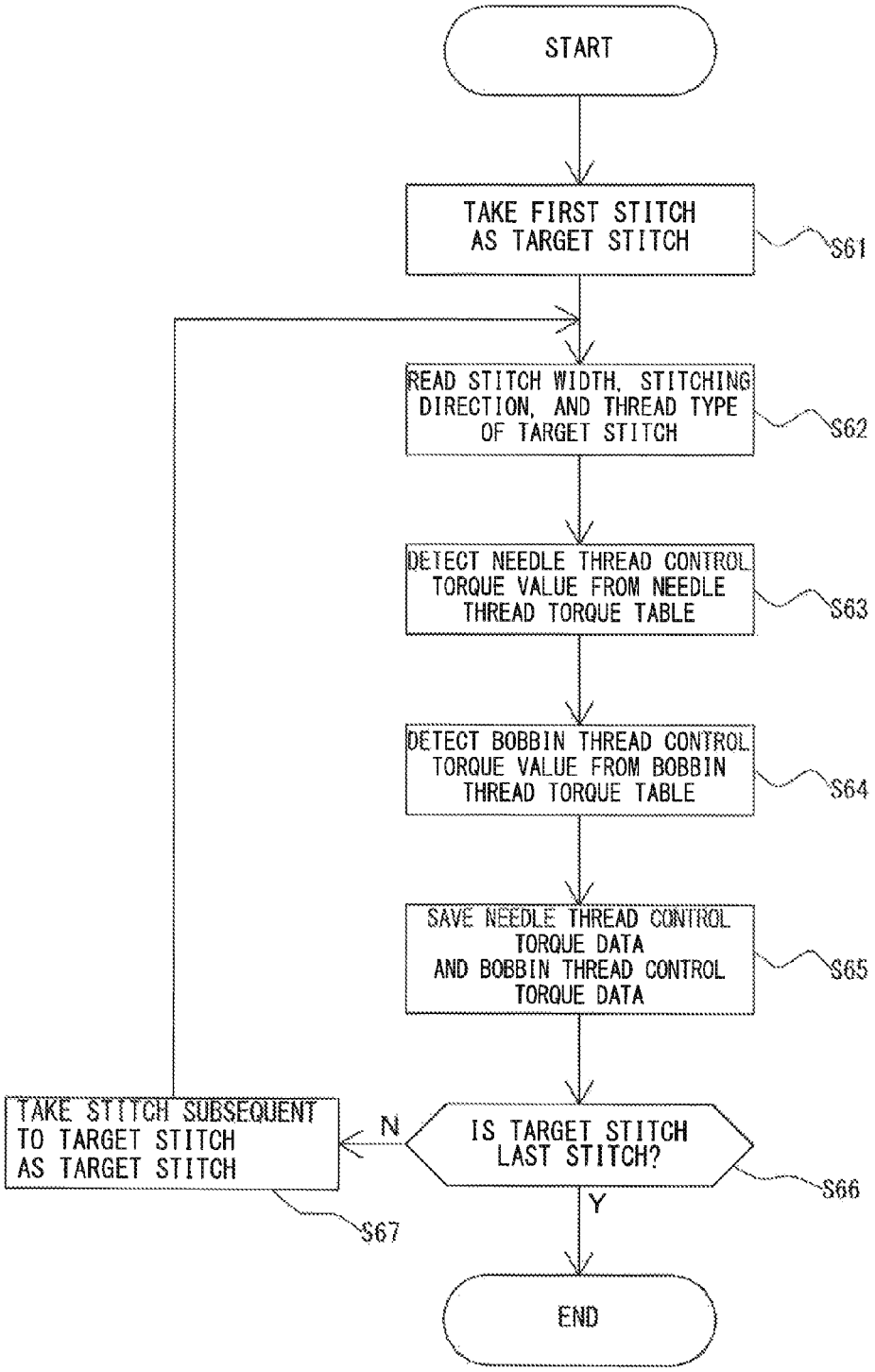
[FIG. 45] It is a flowchart for illustrating a method of generating the needle thread control torque data and the bobbin thread control torque data.

Specifically, the needle thread control torque data and the bobbin thread control torque data are first generated from the embroidery data 92*a* and the torque table 92*e* according to the flowchart shown in FIG. 45.

A first stitch of the embroidery data 92*a* is first taken as a target stitch (step S61).

A stitch width, a stitching direction, and a thread type that are pertinent to the target stitch are next read from the embroidery data 92*a* (step S62).

A needle thread control torque value conforming to the thus-read stitch width, the stitching direction, and the thread type is detected by reference to the needle thread torque table in the torque table 92*e* (step S63). A bobbin thread control torque value conforming to the thus-read stitch width, the stitching direction, and the thread type is detected by reference to the bobbin thread torque table in the torque table 92*e* (step S64).

On this occasion, the stitching direction in the torque table 92*e* corresponds to an angular difference between a stitching direction of an immediately preceding stitch and a stitching direction of the target stitch. Accordingly, an angular difference between the direction of the target stitch and the direction of an immediately preceding stitch in the embroidery data is detected, and a needle thread control torque value and a bobbin thread control torque value are detected by use of the thus-detected angular difference. In this respect, an immediately preceding stitch for the first stitch does not exist in the embroidery data. Hence, a needle thread control torque value and a bobbin thread control torque value are detected from the torque table 92*e* while the angular difference is taken as zero.

Next, the thus-detected needle thread control torque value and the bobbin thread control torque value are stored in the torque data storage table 92*f* (step S65). Specifically, the needle thread control torque value and the bobbin thread control torque value are stored in accordance with the target stitch.

A determination is then made as to whether or not the target stitch is the final stitch (step S66). When the target stitch is the final stitch, processing is completed. In contrast, when the target stitch is not the final stitch, a stitch subsequent to the target stitch is taken as another target stitch (step S67), and processing returns to step S62. Processing pertinent to steps S62 to S65 is iterated until the final stitch.

Data pertinent to a stitching direction of the target stitch in the embroidery data are used on the occasion of detection of an angular difference in processing of the next target stitch. Hence, in step S67, when the next stitch is taken as a target stitch, the control circuit 90 stores data pertinent to the stitching direction of the current target stitch.

The needle thread control torque values and the bobbin thread control torque values are stored until the final stitch in the embroidery data, whereby the needle thread control torque data and the bobbin thread control torque data configured as shown in FIG. 18 are generated.

After the needle thread control torque data and the bobbin thread control torque data are generated as above, the sewing machine is activated in the same manner as described in connection with the first embodiment. Since specific operation is analogous to that described in connection with the first embodiment, its detailed explanation is omitted here.

The needle thread control torque value (torque data) pertinent to needle thread control and the bobbin thread control torque value pertinent to bobbin thread control are read from the thus-generated needle thread control torque data and the bobbin thread control torque data, respectively.

The thus-generated needle thread control torque data and the bobbin thread control torque data are output to the outside from the input-output device (the output section) 94 and stored, by way of the input-output device 94, in the memory device 92 of another sewing machine 1205 having the configuration described in connection with the first embodiment. Tension on a needle thread and a bobbin thread can be controlled in accordance with the thus-generated needle thread control torque data and the bobbin thread control torque data. A plurality of sewing machines are operated in accordance with identical needle thread control torque data and identical bobbin thread control torque data, whereby process fabric can be embellished with the same embroidery. Thus, the sameness of the embroideries formed by the plurality of sewing machines can be enhanced significantly.

Although the torque table 92*e* has been described as specifying the needle thread control torque value and the bobbin thread control torque value that correspond to a combination of a stitch width, a stitching direction, and a thread type, a needle thread control torque value and a bobbin thread control torque value that correspond to a combination of a stitch width and a stitching direction can also be specified without use of thread type data. In this regard, as shown in FIG. 42, the needle thread control torque value and the bobbin thread control torque value that correspond to a combination of a stitch width, a stitching direction, and a thread type are specified in the torque table 92*e*, whereby more apt torque control taking into account a thread type becomes feasible when compared with a case where a needle thread control torque value and a bobbin thread control torque value that correspond to a combination of a stitch width and a stitching direction are specified.

Even the sewing machine having the configuration described in connection with the second embodiment can input needle thread control torque data and bobbin thread control torque data from the outside, store the thus-input torque data in the torque data storage table 92*f*, and control tension of a needle thread and tension of a bobbin thread according to the needle thread control torque data and the bobbin thread control torque data rather than generating the needle thread control data and the bobbin thread control torque data that correspond to the embroidery data by use of the torque table.

In the sewing machines of the embodiments, the needle thread control torque data and the bobbin thread control torque data that conform to the embroidery data are generated by use of the torque table; tension of a needle thread is controlled according to the needle thread control torque data; and tension of a bobbin thread is controlled according to the bobbin thread control torque data. Hence, there is no necessity to separately generate and input the needle thread control torque data and the bobbin thread control torque data.

The same advantage to the advantage of the first embodiment can be obtained. For example, the sewing machine of the embodiment can control a magnitude of tension exerted on the needle thread and the bobbin thread according to the generated needle thread control torque data and the generated bobbin thread control torque data. In particular, the needle thread control torque value in the needle thread control torque data and the bobbin thread control torque value in the bobbin thread control torque data are specified on a per-stitch basis. Therefore, tension exerted on the needle thread and the bobbin thread can be controlled on a per-stitch basis. Thus, a stitch hardness can be controlled on a per-stitch basis. In each of the sewing units 1206, needle thread tension and bobbin thread tension are controlled according to the generated needle thread control torque data and the generated bobbin thread control torque data stored in the memory device 92. As a consequence, each of the sewing units 1206 (which can also be the heads 1207) can embellish process fabric with the same embroidery. Thus, the sameness of embroideries made by the respective sewing units 1206 (which can also be the heads 1207) can be considerably enhanced. In other words, in each of the sewing units 1206 of the sewing machine 1205, the tension exerted on the needle thread and the bobbin thread is controlled according to the generated needle thread control torque data and the generated bobbin thread control torque data, whereby each of the sewing units controls the tension according to the same torque data. Accordingly, each of the sewing units can make the same broidery, and the sameness of embroideries made by the respective sewing units (in other words, the heads) can be considerably enhanced.

Identical needle thread control torque data and identical bobbin thread control torque data are generated even for a plurality of embroidery sewing machines, so long as contents of the torque table are made identical. Hence, the respective sewing machines can embellish process fabric with the same embroidery, and the sameness of the embroideries made by the respective sewing machines can be considerably enhanced.

Since another advantage of the sewing machine of the second embodiment is the same as that yielded by the sewing machine of the first embodiment, its detailed explanations are omitted.

The middle shuttle may assume either a half-turn configuration or a full-turn configuration as in the case with the sewing machine of the first embodiment.

Throughout the drawings of the embodiments, direction Y1-Y2 is orthogonal to direction X1-X2, and direction Z1-Z2 is orthogonal to the direction X1-X2 and the direction Y1-Y2.

DESCRIPTIONS OF THE REFERENCE NUMERALS AND SYMBOLS

10 MACHINE ELEMENT GROUP
12*a*-1, 12*a*-2, 12*a*-3, 12*a*-4, 12*a*-5, 12*a*-6, 12*a*-7, 12*a*-8, 12*a*-9 THREAD TAKE-UP LEVER
12*b*-1, 12*b*-2, 12*b*-3, 12*b*-4, 12*b*-5, 12*b*-6, 12*b*-7, 12*b*-8, 12*b*-9 NEEDLE BAR
12*ba* SEWING NEEDLE
12*bb* PIN HOLE
12*d* SEWING FRAME
14*a* NEEDLE BAR CONNECTING STUD
14*b* NEEDLE BAR ACTUATION MEMBER
14*c* BASE NEEDLE BAR
20 MAIN SPINDLE MOTOR
21, 1287, 251 ENCODER
22 MAIN SPINDLE
24 FRAME ACTUATOR
90 CONTROL CIRCUIT
92 MEMORY DEVICE
100 SHUTTLE
110 OUTER SHUTTLE
130 MIDDLE SHUTTLE PRESSER
150 MIDDLE SHUTTLE
152 RACE SECTION
160 MAIN MIDDLE SHUTTLE
161 REAR SECTION
162 REAR-SIDE BODY
162*a* FLAT PLATE-LIKE SECTION
162*b* RECESS
162*b*-1 RECESSED PERIPHERY
162*b*-2 RECESSED DEPTH
164 REAR-SIDE TAPERED SECTION
164*a* FIRST REGION
164*b* SECOND REGION
166 FRONT-SIDE TAPERED SECTION
170 LEADING END
172 POINT
174 THREAD GUARD
180 BOBBIN ACCOMMODATION SECTION
182 TUBULAR SECTION
184 SHAFT
190, 214, 270, 310, 1250, 1270, 2214, 2270 MAGNET SECTION
200, 2200 BOBBIN THREAD TENSION CONTROL MECHANISM SECTION
202, 2202 BOBBIN THREAD MOTOR
210, 2210 ROTARY DISC
212, 2212 ROTARY DISC BODY
220 SUPPORT
250, 2250 SHUTTLE ACTUATION SECTION
252, 2252 SHUTTLE ACTUATION MOTOR
260, 2260 SUPPORT ARM
300 BOBBIN
302 BOBBIN BODY
1205 SEWING MACHINE
1206 SEWING UNIT
1207 HEAD
1230 NEEDLE THREAD CONTROL SECTION
1240 UPSTREAM GRIP SECTION
1241, 1261 GRIP SECTION MAIN BODY
1260 DOWNSTREAM GRIP SECTION
1280 TURNING SECTION
1281 TURNING ARM
1282 MAIN BODY SECTION
1286 NEEDLE THREAD MOTOR
1310 CASE
1242-1 TO 1242-9, 1262-1 TO 1262-9 FIRST PLATE-LIKE SECTION UNIT
1242A, 1262*a* FIRST PLATE-LIKE SECTION
1244, 1264 SECOND PLATE-LIKE SECTION
1252, 1254, 1272, 1274, 1290, 1336 GUIDE MEMBER
1284 HOOK
1288 NEEDLE THREAD SUPPORTING MEMBER
1337 TENSION SPRING
1312 ARM
1314 NEEDLE BAR CASE
1342*a*, 1342*b*, 1342*c* OPENING SECTION
1330 NEEDLE BAR CASE MAIN BODY
1340 NEEDLE THREAD CONTROL MOUNTING SECTION
1341 PLATE SECTION
J NEEDLE THREAD
R BOBBIN THREAD

The invention claimed is:

1. A sewing machine comprising:
a plurality of sewing units, each of which includes:
thread take-up lever formed in a swayable manner;
a needle thread control section that is disposed at an upstream position in a needle thread path of the thread take-up lever, that controls tension on a needle thread, and that includes
an upstream grip section including
an upstream grip section main body which grips a needle thread in a pinching manner and
an upstream actuation section that performs, with respect to the upstream grip section main body, switching between a closed state in which the needle thread is gripped and an open state in which the needle thread is released from a gripped state,
a downstream grip section that is disposed at a downstream position in the needle thread path of the upstream grip section and that has
a downstream grip section main body which grips a needle thread in a pinching manner and
a downstream actuation section that performs, with respect to the downstream grip section main body, switching between a closed state in which the needle thread is gripped and an open state in which the needle thread is released from a gripped state, and
a turning section that turns the needle thread between the upstream grip section main body and the downstream grip section main body and that has
a turning arm which contacts the needle thread and
a needle thread motor which turns the turning arm;
an outer shuttle which has a guide groove formed in a circular-arc inner peripheral surface;
a middle shuttle which rotates along the guide groove of the outer shuttle, which retains the needle thread, at least a rear section and a shaft of which are formed from a non-magnetic substance, and which has
a race section that is formed along a peripheral edge of the middle shuttle in the form of a circular arc and which is supported so as to be slidable over the guide groove, a rear section continually extending from an end of a rear-side, that is one side with respect to an axial direction, in an inner circumferential edge of the race, and the shaft which is formed on a front side of the rear section and which is formed along a rotating center of the rear section;

a bobbin which has a hole into which the shaft of the middle shuttle is inserted, which is axially supported within the middle shuttle as a result of the shaft being inserted into the hole, and which has a first magnet section that is provided on a rear side surface which is a surface opposing a rear section of the middle shuttle when the bobbin is axially supported by the shaft; and a bobbin thread control section which has a bobbin thread motor which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section which is rotated by the bobbin thread motor and provided in close proximity to the rear section of the middle shuttle and which rotates the first magnet section;

a storage section for storing needle thread control torque data for which a needle thread control torque value is stored for each stitch in embroidery data and bobbin thread control torque data for which a bobbin thread control torque value is stored for each stitch in the embroidery data; and a control section that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that controls the needle thread motor in each of the sewing units in accordance with position data pertinent to a needle thread motor angle such that an angle of the needle thread motor, which is a position of the needle thread motor in a rotating direction, returns to an initial angular position of the needle thread motor, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from the one dead point to the another dead point of the thread take-up lever.

2. The sewing machine according to claim 1, further comprising an input section for inputting and storing in a storage section embroidery data, needle thread control torque data, and bobbin thread control torque data.

3. The sewing machine according to claim 1, wherein the sewing unit further comprises:

a third magnet section provided on an outer periphery portion of the portion that faces the surface of the bobbin provided with the first magnet section in the rear section of the middle shuttle, a shuttle actuation section having a fourth magnet section that is provided in close proximity to the third magnet section and a shuttle actuation motor that rotates the fourth magnet section around an axis line that is to serves as a rotating center of the middle shuttle.

4. The sewing machine according to claim 1, wherein the guide groove is provided on a front side of a circular-arc inner peripheral surface of the outer shuttle, and wherein a middle shuttle presser for preventing the middle shuttle housed in the outer shuttle from falling from the outer shuttle is provided on a front side of the outer shuttle.

5. The sewing machine according to claim 1, wherein the sewing unit further includes an arm making up an enclosure of the sewing machine;

a needle bar case that is provided so as to be slidable in a horizontal direction with respect to the arm and that includes first opening sections made at positions between the upstream grip section main body and the downstream grip section main body in a vertical direction such that a leading end of the turning arm of a turning section can be exposed to the front side, a second opening section which is provided above the first opening section and on which the upstream magnet section fronts, and a third opening section which is provided below the first opening section and on which a downstream magnet section fronts;

a plurality of needle bars provided in the needle bar case; and needle thread supporting members that each is provided in the needle bar case and that each supports the needle thread in its horizontal direction at the position of the first opening section, wherein the thread take-up lever is placed while being exposed from a position in the needle bar case below the downstream grip section to a front;

the turning arm is turned while remaining in contact with the needle thread supported by the needle thread supporting member, thereby turning the needle thread;

the upstream grip section main body is placed on a front side of the needle bar case and, and has upstream first plate-like sections which is formed into a shape of a plate from a magnetic substance; that is, a material attracted by the magnet and which is provided for the respective needle bars and an upstream second plate-like section which is provided at back side of the upstream first plate-like sections and on a front side of the second opening section and which is formed into a shape of a plate from a non-magnetic substance unattracted by the magnet;

the upstream actuation section is a magnet section serving as the upstream magnet section and secured to the arm-side at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state;

the downstream grip section main body is placed on a front side of the needle bar case and below the upstream grip section main body and has downstream first plate-like sections which are formed from a magnetic substance which is attracted by the magnet into a shape of a plate and which are provided for the respective needle bars and a downstream second plate-like section which is provided at back side of the downstream first plate-like sections and on a front side of the second opening section and which is formed into a shape of a plate from a non-magnetic substance unattracted by the magnet; and the downstream actuation section is a magnet section serving as the downstream magnet section and secured to the arm-side at a back side of the downstream second plate-like section and switches between a closed state in which the downstream first plate-like section is attracted by magnetic force, to thus pinch to thereby grip the needle thread between the downstream first plate-like section and the downstream second plate-like section and an open state in which the needle thread is released from the gripped state by means of canceling attraction caused by the magnetic force.

6. The sewing machine according to claim 1, wherein the control section detects, at a starting point of the position control zone, a current angle position of the needle thread motor in the position control zone, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up lever, and controls a position of the needle thread motor to its angle of the needle thread motor corresponding to the angle of the main spindle motor as the angle of the main spindle motor changes as a result of rotation of the main spindle motor.

7. A sewing machine comprising:

a plurality of sewing units, each of which includes:

thread take-up lever formed in a swayable manner;

a needle thread control section that is disposed at an upstream position in a needle thread path of the thread take-up lever, that controls tension on a needle thread, and that includes an upstream grip section including an upstream grip section main body which grips a needle thread in a pinching manner and an upstream actuation section that performs, with respect to the upstream grip section main body, switching between a closed state in which the needle thread is gripped and an open state in which the needle thread is released from a gripped state, a downstream grip section that is disposed at a downstream position in the needle thread path of the upstream grip section and that has a downstream grip section main body which grips a needle thread in a pinching manner and a downstream actuation section that performs, with respect to the downstream grip section main body, switching between a closed state in which the needle thread is gripped and an open state in which the needle thread is released from a gripped state, and a turning section that turns the needle thread between the upstream grip section main body and the downstream grip section main body and that has a turning arm which contacts the needle thread and a needle thread motor which turns the turning arm;

an outer shuttle which has a guide groove formed in a circular-arc inner peripheral surface;

a middle shuttle which rotates along the guide groove of the outer shuttle, which retains the needle thread, at least a rear section and a shaft of which are formed from a non-magnetic substance, and which has a race section that is formed along a peripheral edge of the middle shuttle in the form of a circular arc and which is supported so as to be slidable over the guide groove, a rear section continually extending from an end of a rear-side, that is one side with respect to an axial direction, in an inner circumferential edge of the race, and the shaft which is formed on a front side of the rear section and which is formed along a rotating center of the rear section;

a bobbin which has a hole into which the shaft of the middle shuttle is inserted, which is axially supported within the middle shuttle as a result of the shaft being inserted into the hole, and which has a first magnet section that is provided on a rear side surface which is a surface opposing a rear section of the middle shuttle when the bobbin is axially supported by the shaft; and a bobbin thread control section which has a bobbin thread motor which is provided at the rear side of the middle shuttle and has a rotary shaft coaxial to the rotating center of the middle shuttle and which rotates the rotary shaft in a direction opposite to a direction in which the bobbin rotates on occasions of a bobbin thread wound around the bobbin being withdrawn, and a second magnet section which is rotated by the bobbin thread motor and provided in close proximity to the rear section of the middle shuttle and which rotates the first magnet section;

a storage section for storing a torque table that specifies a needle thread control torque value and a bobbin thread control torque value which correspond to a combination of a value of a stitch width and a value based on a stitching direction; and a control section that detects, according to the torque table, a needle thread control torque value and a bobbin thread control torque value for each stitch in the embroidery data which store, for each stitch, data pertinent to a value of a stitch width and data pertinent to a value representing a stitching direction, thereby generating needle thread control torque data which store, for each stitch, a needle thread control torque value and bobbin thread control torque data which stored, for each stitch, a bobbin thread control torque value; that, when performing embroidery sewing according to embroidery data and in connection with the needle thread, in a control zone for each stitch, controls the needle thread motor in each of the sewing units in accordance with a torque value of the needle thread control torque data while closing the upstream grip section main body and while opening the downstream grip section main body such that tension is imparted to the needle thread against a direction in which the thread take-up lever draws the needle thread, thereby imparting rotating force to a turning arm, within a control zone; namely, within a needle thread torque control zone which is a zone including at least a portion of a zone from one dead point to another dead point of the thread take-up lever during which the thread take-up lever draws the needle thread with respect to processed fabric to be sewn with the needle thread; that controls the needle thread motor in each of the sewing units in accordance with position data pertinent to a needle thread motor angle such that an angle of the needle thread motor, which is a position of the needle thread motor in a rotating direction, returns to an initial angular position of the needle thread motor, while opening the upstream grip section main body and closing the downstream grip section main body, within a position control zone which is at least a portion of a zone other than the torque control zone, thereby imparting rotating force to the turning arm to draw the needle thread from an upstream position; and that, in connection with the bobbin thread, controls the bobbin thread motor in each of the sewing units in accordance with a torque value of the bobbin thread control torque data, within a bobbin thread torque control zone which is at least a portion of a zone from the one dead point to the another dead point of the thread take-up lever.

8. The sewing machine according to claim 7, further comprising an output section for outputting to the outside needle thread control torque data and bobbin thread control torque data that are generated in accordance with a torque table.

9. The sewing machine according to claim 8, further comprising an input section for inputting and storing in the storage section the embroidery data and data pertinent to the torque table.

10. The sewing machine according to claim 8, wherein a value based on a stitching direction of the torque table is a value that shows a relationship between a direction of a stitch to be controlled and a direction of a stitch immediately preceding the stitch to be controlled.

11. The sewing machine according to claim 8, wherein a value based on a stitching direction of the torque table is a value of an angular difference between the direction of the stitch to be controlled and the direction of a stitch immediately preceding the stitch to be controlled.

12. The sewing machine according to claim 8, wherein the embroidery data store, for each stitch, data pertinent to a thread type in addition to the data pertinent to a value of a stitch width and a value based on a stitching direction; wherein the needle thread control torque value is provided, in the torque table, in correspondence with an additional combination of a thread type as well as with the value of the stitch width and a value based on the stitching direction; and wherein the bobbin thread control torque value is provided, in the torque table, in correspondence with an additional combination of a thread type as well as with the value of the stitch width and the value based on the stitching direction.

13. The sewing machine according to claim 7, further comprising an input section for inputting and storing in the storage section the embroidery data and data pertinent to the torque table.

14. The sewing machine according to claim 7, wherein a value based on a stitching direction of the torque table is a value that shows a relationship between a direction of a stitch to be controlled and a direction of a stitch immediately preceding the stitch to be controlled.

15. The sewing machine according to claim 7, wherein a value based on a stitching direction of the torque table is a value of an angular difference between the direction of the stitch to be controlled and the direction of a stitch immediately preceding the stitch to be controlled.

16. The sewing machine according to claim 7, wherein the embroidery data store, for each stitch, data pertinent to a thread type in addition to the data pertinent to a value of a stitch width and a value based on a stitching direction; wherein the needle thread control torque value is provided, in the torque table, in correspondence with an additional combination of a thread type as well as with the value of the stitch width and a value based on the stitching direction; and wherein the bobbin thread control torque value is provided, in the torque table, in correspondence with an additional combination of a thread type as well as with the value of the stitch width and the value based on the stitching direction.

17. The sewing machine according to claim 7, wherein the sewing unit further comprises:

a third magnet section provided on an outer periphery portion of the portion that faces the surface of the bobbin provided with the first magnet section in the rear section of the middle shuttle, a shuttle actuation section having a fourth magnet section that is provided in close proximity to the third magnet section and a shuttle actuation motor that rotates the fourth magnet section around an axis line that is to serves as a rotating center of the middle shuttle.

18. The sewing machine according to claim 7, wherein the guide groove is provided on a front side of a circular-arc inner peripheral surface of the outer shuttle, and wherein a middle shuttle presser for preventing the middle shuttle housed in the outer shuttle from falling from the outer shuttle is provided on a front side of the outer shuttle.

19. The sewing machine according to claim 7, wherein the sewing unit further includes an arm making up an enclosure of the sewing machine;

a needle bar case that is provided so as to be slidable in a horizontal direction with respect to the arm and that includes first opening sections made at positions between the upstream grip section main body and the downstream grip section main body in a vertical direction such that a leading end of the turning arm of a turning section can be exposed to the front side, a second opening section which is provided above the first opening section and on which the upstream magnet section fronts, and a third opening section which is provided below the first opening section and on which a downstream magnet section fronts;

a plurality of needle bars provided in the needle bar case; and needle thread supporting members that each is provided in the needle bar case and that each supports the needle thread in its horizontal direction at the position of the first opening section, wherein the thread take-up lever is placed while being exposed from a position in the needle bar case below the downstream grip section to a front;

the turning arm is turned while remaining in contact with the needle thread supported by the needle thread supporting member, thereby turning the needle thread;

the upstream grip section main body is placed on a front side of the needle bar case and, and has upstream first plate-like sections which is formed into a shape of a plate from a magnetic substance; that is, a material attracted by the magnet and which is provided for the respective needle bars and an upstream second plate-like section which is provided at back side of the upstream first plate-like sections and on a front side of the second opening section and which is formed into a shape of a plate from a non-magnetic substance unattracted by the magnet;

the upstream actuation section is a magnet section serving as the upstream magnet section and secured to the arm-side at a back side of the upstream second plate-like section and switches between a closed state in which the upstream first plate-like section is attracted by magnetic force, to thus pinch and grip the needle thread between the upstream first plate-like section and the upstream second plate-like section and an open state in which attraction caused by the magnetic force is released to thereby release the needle thread from the gripped state;

the downstream grip section main body is placed on a front side of the needle bar case and below the upstream grip section main body and has downstream first plate-like sections which are formed from a magnetic substance which is attracted by the magnet into a shape of a plate and which are provided for the respective needle bars and a downstream second plate-like section which is provided at back side of the downstream first plate-like sections and on a front side of the second opening section and which is formed into a shape of a plate from a non-magnetic substance unattracted by the magnet; and the downstream actuation section is a magnet section serving as the downstream magnet section and secured to the arm-side at a back side of the downstream second plate-like section and switches between a closed state in which the downstream first plate-like section is attracted by magnetic force, to thus pinch to thereby grip the needle thread between the downstream first plate-like section and the downstream second plate-like section and an open state in which the needle thread is released from the gripped state by means of canceling attraction caused by the magnetic force.

20. The sewing machine according to claim 7, wherein the control section detects, at a starting point of the position control zone, a current angle position of the needle thread motor in the position control zone, generates angle correspondence data which specify an angle of the needle thread motor from the current angle position to an initial angle position of the needle thread motor for each angle of a main spindle motor representing a rotational position of the main spindle motor which rotates a main spindle for transmitting power to the thread take-up lever, and controls a position of the needle thread motor to its angle of the needle thread motor corresponding to the angle of the main spindle motor as the angle of the main spindle motor changes as a result of rotation of the main spindle motor.

* * * * *